US006692223B2

(12) United States Patent
Ikeda et al.

(10) Patent No.: US 6,692,223 B2
(45) Date of Patent: Feb. 17, 2004

(54) AIR CONDITIONER

(75) Inventors: Takashi Ikeda, Tokyo (JP); Yoshihiro Tanabe, Tokyo (JP); Kunihiro Morishita, Tokyo (JP); Hidetomo Nakagawa, Tokyo (JP); Makoto Yoshihashi, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/129,823

(22) PCT Filed: Aug. 6, 2001

(86) PCT No.: PCT/JP01/06726

§ 371 (c)(1),
(2), (4) Date: May 9, 2002

(87) PCT Pub. No.: WO02/29331

PCT Pub. Date: Apr. 11, 2002

(65) Prior Publication Data

US 2002/0172588 A1 Nov. 21, 2002

(30) Foreign Application Priority Data

Sep. 29, 2000 (JP) ..... 2000-299409

(51) Int. Cl.[7] ..... F04D 17/04

(52) U.S. Cl. ..... 415/53.1; 415/119; 415/203; 165/122; 62/262

(58) Field of Search ..... 415/53.1, 53.2, 415/53.3, 119, 203, 204, 206, 212.1; 165/122, 135, 151; 62/262, 298, 404, 407, 263

(56) References Cited

U.S. PATENT DOCUMENTS

| | | | | | |
|---|---|---|---|---|---|
| 4,733,543 | A | * | 3/1988 | Blair | 62/263 |
| 5,746,577 | A | * | 5/1998 | Ito et al. | 416/178 |
| 5,988,979 | A | * | 11/1999 | Wang | 416/178 |
| 6,050,772 | A | * | 4/2000 | Hatakeyama et al. | 415/1 |
| 6,086,324 | A | | 7/2000 | Ikeda et al. | |
| 6,182,460 | B1 | * | 2/2001 | Hernandez et al. | 62/262 |

FOREIGN PATENT DOCUMENTS

| | | |
|---|---|---|
| JP | 110598/1987 | 7/1987 |
| JP | 5-44686 | 2/1993 |
| JP | 8-200283 | 8/1996 |
| JP | 9-72297 | 3/1997 |
| JP | 11-83062 | 3/1999 |
| JP | 11-201487 | 7/1999 |
| JP | 2001-280288 | 10/2001 |

* cited by examiner

*Primary Examiner*—Edward K. Look
*Assistant Examiner*—J. M. McAleenan
(74) *Attorney, Agent, or Firm*—Oblon, Spivak, McClelland, Maier & Neustadt, P.C.

(57) ABSTRACT

To obtain an air conditioning apparatus which provides a favorable atmosphere to the ear and saves energy even if the suction resistance of the impeller becomes high due to such as dust in the air conditioning apparatus. The air conditioning apparatus is provided with an impeller which is formed by a plurality of vanes and a ring for supporting the plurality of vanes, and includes a nozzle portion formed by a stabilizer and an air outlet, a cross flow fan formed by a guide wall, and a heat exchanger. The ratio H/ϕD2 of the outside diameter ϕ D2 of the impeller to the height H of the air conditioning apparatus is 2.2 or above and 3.0 or below.

17 Claims, 54 Drawing Sheets

θ 1 IS SMALL

AIR CONDITIONER

TECHNICAL FIELD

The present invention relates to an air conditioning apparatus such as an air conditioner, a dehumidifier and an air purifier, and more particularly to an air conditioning apparatus in which a cross flow fan is mounted to be used as a blowing means.

BACKGROUND ART

Hereafter, a description will be made of an air conditioning apparatus, such as an air conditioner, a dehumidifier and an air purifier, in which a conventional cross flow fan is mounted. An example of the conventional cross flow fan entitled "Indoor Unit for Air Conditioner" is disclosed in Japanese Unexamined Patent Publication No. Hei 11-83062, for instance. FIG. 50 is a longitudinal cross-sectional view of the main body of an air conditioning apparatus disclosed in Japanese Unexamined Patent Publication No. Hei 11-83062. FIG. 51 is a perspective view of the impeller of a conventional cross flow fan. FIG. 52 is a longitudinal cross-sectional view of the cross flow fan of FIG. 51. FIG. 53 is a cross-sectional view of a vane shown in FIG. 52. FIG. 54 is a diagram illustrating the frequency characteristic of noise of the air conditioning apparatus in which the conventional cross flow fan is mounted.

With referring to FIGS. 50, 51 and 52, the conventional cross flow fan is formed by an impeller 101, a guide wall 102, a stabilizer 103, and a motor 104. The impeller 101 is formed by two or more units 110*a* which are connected in the direction of the shaft, each unit being formed by a plurality of vanes 101*b* and a ring 101*c* for supporting the plurality of vanes. The guide wall 102 surrounds the impeller 101 in such a manner as to cover one side of the peripheral surface of the impeller 101. The stabilizer 103 is disposed in such a manner as to face the guide wall 102. The motor 104 rotates and operates the impeller 101 as indicated by an arrow J.

According to the air conditioning apparatus in which the thus configured conventional cross flow fan is mounted, as shown in FIG. 50, air is sucked in through a detachable front facing grill and a detachable top facing inlet grill, then dust is removed from the air by using a filter, and thereafter the air is heated or refrigerated by means of a heat exchanger which is formed in such a manner as to surround the impeller 101. Heat-exchanged air after passing through the heat exchanger is sucked into the impeller 101, passes through a row of vanes on the side of the heat exchanger, and then is blown off again through a row of vanes on the side of an air outlet. Then, the air is blown off through the air outlet to the room by blowing-direction changing vanes, including up/down vanes and left/right vanes, changing the blowing direction of the air. Thus, the room is air-conditioned.

With referring now to the vane 101*b* in a cross-sectional shape shown in FIG. 53, a reference numeral A20 denotes a tip of a vane's peripheral end portion A2 in the shape of a circular arc of the vane 101*b*. A reference numeral A10 denotes a tip of a vane's internal circumferential end portion A1 in the shape of a circular arc of the vane 101*b*. A reference mark O denotes the center of the rotating shaft of the impeller 101, and a reference numeral 1 denotes the center of a camber line P0 formed into a single circular arc of the vane 101*b*. A reference numeral P2 denotes a pressure face of the vane 101*b* on a side facing the direction of rotation of the impeller, and a reference numeral P3 denotes a suction surface opposing to the pressure face P2. O-A20 indicates a first straight line connecting the tip of the vane's peripheral end portion A20 of the vane 101*b* and the center O. O1-A20 indicates a second straight line connecting the tip of the vane's peripheral end portion A20 of the vane 101*b* and the center O1 of the camber line P0. Further, a reference mark n denotes a first perpendicular of the first straight line O-A20 to the tip of the vane's peripheral end portion A20, and a reference mark m denotes a second perpendicular of the second straight line O1-A20 to the tip of the vane's peripheral end portion A20. An exit angle β2 is an acute angle formed by the first perpendicular and the second perpendicular.

With referring to the cross flow fan, for example, by expanding the outside diameter φD2 of the impeller 101 in a similar shape, the flow rate is increased and the noise level is lowered. However, if the flow rate is increased and the noise level is lowered in such a manner, singular noise S1 is generated in a low frequency range as shown in the diagram illustrating the frequency characteristic of noise of FIG. 54. In addition to that, there may be a case where the noise level at the same flow rate is increased and a resultant atmosphere to the ear is made worse. For that reason, according to the conventional cross flow fan, the singular noise S1 is tried to be reduced by setting the exit angle β2 of the vane 101*b* to 23 degrees or less. Furthermore, by setting the exit angle β2 to 18 degrees or more, the noise level at the same flow rate is lowered and a resultant atmosphere to the ear is controlled not to be aggravated.

Furthermore, by forming the vane 101*b* such that $t_{max}/t_{min}$ =1.3~1.5, a blowing performance at a high flow rate may be obtained, where $t_{max}$ denotes a maximum thickness of the vane 101*b* and $t_{min}$ denotes the thickness of the vane's peripheral end portion, which is the thickness of a portion of the vane 101 excluding a roundish portion at a mounting end of the vane 101 on the vane's peripheral side. In addition to that, this also allows to obtain an interior unit of an air conditioner which has less opportunities of generating the singular noise in a low frequency range.

However, according to an air conditioning apparatus using the conventional cross flow fan disclosed in Japanese Unexamined Patent Publication No. Heill-83062, in the case that the suction resistance of the impeller 101 becomes high due to a decrease in the fin pitch of the heat exchanger, or dust accumulated on the filter, a circulating vortex C1 caused near the stabilizer 103, which is a typical phenomenon of a cross flow fan, may develop from a solid circle to a broken bold circle. Then, air after passing through the heat exchanger flows towards a cross flow vortex having a lower pressure, and then sucked into the impeller 101 as indicated by the arrow of FIG. 50. As a result, in an area F1, the flow of air may be detached from the vane 101*b*, and then an air turbulent vortex G1 may be generated at a rear portion of the vane 101*b*. Consequently, as shown in the diagram illustrating the frequency characteristic of noise of FIG. 54, there may be a case where the singular noise Sm having a frequency width fs is generated in a low frequency range of around 40 to 80 percent of the generation frequency of the rotation noise (NZ sound) depending upon the number of vanes Z and the rotational frequency N [r.p.m] of the impeller 101. For that reason, a jarring noise other than the rotational noise may be generated, which produces an aggravated atmosphere to the ear, and this has been a problem.

Furthermore, because the vane's exit angle β2 is reduced, thereby narrowing a vane's distance, when the flow of air passes between vanes, a resistance occurs. As a result, the shaft output for operating the impeller is increased, which increases the power consumption of the motor.

Hence, the present invention has been devised to solve the above described problems, and an object is to obtain an air conditioning apparatus which provides a favorable atmosphere to the ear and saves energy by controlling noise not to be aggravated even if the suction resistance of the impeller becomes high due to such as noise and dust during its operation, and further, by minimizing the generation of the singular noise in a low frequency range and the rotation noise, and minimizing the power consumption of the motor.

DISCLOSURE OF THE INVENTION

An air conditioning apparatus according to a first invention is characterized by having a cross flow fan which includes an impeller being formed by a plurality of vanes and a ring for supporting the plurality of vanes, and a heat exchanger. Then, the cross flow fan includes a nozzle portion which is formed by a stabilizer and an outlet, and a guide wall. A ratio H/ϕD2 of a height H of a main body of the air conditioning apparatus to an outside diameter ϕD2 of the impeller is 2.2 or above and 3.0 or below.

An air conditioning apparatus according to a second invention is characterized by an impeller of a cross flow fan in which a vane's exit angle β2 is between 23 degrees and 30 degrees.

An air conditioning apparatus according to a third invention is characterized by an impeller of a cross flow fan in which a ratio tm/t2 of a maximum thickness tm of the vane of the impeller of the cross flow fan to a minimum thickness t2 of the vane is at least 1.5 or above and 3.5 or below when the minimum thickness t2 is a diameter of a peripheral end portion of the vane in a shape of a circular arc so as to reduce singular noise generated in a frequency range lower than that of rotation noise, and a thickness of the vane is gradually varied.

An air conditioning apparatus according to a fourth invention is characterized by an impeller of a cross flow fan in which a maximum thickness of a vane of the impeller of the cross flow fan is between 0.9 mm and 1.5 mm when a minimum thickness t2 of the vane of the impeller of the cross flow fan is between 0.2 mm and 0.6 mm and the minimum thickness t2 of the vane is a diameter of a peripheral end portion of the vane in a shape of a circular arc.

An air conditioning apparatus according to a fifth invention is characterized by an impeller of a cross flow fan in which the maximum thickness of the vane of the impeller of the cross flow fan is between 0.9 mm and 1.5 mm when the minimum thickness t2 of the vane of the impeller of the cross flow fan is between 0.2 mm and 0.6 mm and the minimum thickness t2 is the diameter of the peripheral end portion of the vane in the shape of the circular arc.

An air conditioning apparatus according to a sixth invention is characterized by an impeller of a cross flow fan in which the vane is formed into a shape of an edge obtained by cutting the vane along a circle passing through a peripheral end portion of the vane where a center of the circle is a center O of a rotating shaft of the impeller.

An air conditioning apparatus according to a seventh invention is characterized by an impeller of a cross flow fan in which the vane is formed into a shape of an edge obtained by cutting the vane along a circle passing through the peripheral end portion of the vane where a center of the circle is a center O of a rotating shaft of the impeller.

An air conditioning apparatus according to an eighth invention is characterized by an impeller of a cross flow fan in which the plurality of vanes is fitted with an irregular space between the vanes in pitch.

An air conditioning apparatus according to a ninth invention is characterized by an impeller of a cross flow fan in which the plurality of vanes of the impeller of the cross flow fan is fitted with an irregular space between the vanes in pitch.

An air conditioning apparatus according to a tenth invention is characterized by a cross flow fan in which the stabilizer is formed at a lower front portion of the air conditioning apparatus in such a manner that an acute angle formed by a straight line, and a horizontal line is between 30 degrees and 70 degrees when the straight line connects a closest point of the stabilizer to the impeller of the cross flow fan to a center O of a rotating shaft of the impeller and a horizontal line and the horizontal line passes through the center O of the rotating shaft of the impeller.

An air conditioning apparatus according to an eleventh invention is characterized by the stabilizer which is formed in such a manner that an acute angle formed by two straight lines is between 15 degrees and 40 degrees when the two straight lines connect a center O of the impeller of the cross flow fan, respectively, to a closest point of the stabilizer to the impeller of the cross flow fan and to a lower portion of the stabilizer.

An air conditioning apparatus according to a twelfth invention is characterized by a cross flow fan in which the guide wall is formed at an upper rear portion of the air conditioning apparatus in such a manner that an angle θ3 formed by a straight line and a horizontal line is between 35 degrees and 80 degrees when the straight line connects a closest point of the guide wall to the impeller of the cross flow fan and a center of a rotating shaft of the impeller and the horizontal line passes through the center O of the rotating shaft of the impeller, An air conditioning apparatus according to a thirteenth invention is characterized by an impeller of a cross flow fan in which a shape of a peripheral end portion of the vane extends to a peripheral side of the impeller in a shape of an inclining parallelogram forward in a direction of rotation of the impeller, but the shape is not projecting outside a periphery of the ring for supporting the plurality of vanes, in a cross-sectional view at right angles to a line of a rotating shaft of the impeller of the cross flow fan.

An air conditioning apparatus according to a fourteenth invention is characterized by an impeller of a cross flow fan in which two vertexes of a peripheral end portion of the vane facing a peripheral side of the impeller are formed in a fixed shape of R when the vertexes extend to the peripheral side of the impeller in a shape of parallelogram.

An air conditioning apparatus according to a fifteenth invention is characterized by an impeller of a cross flow fan in which each of the plurality of vanes of the impeller of the cross flow fan is inclined by a fixed angle to a rotating shaft of the cross flow fan.

An air conditioning apparatus according to a sixteenth invention is characterized by an impeller of a cross flow fan in which a peripheral end portion of the vane of the impeller of the cross flow fan is formed by an elastic body.

BEST MODE FOR CARRYING OUT THE INVENTION

Hereafter, descriptions will be made in detail of the embodiments of the air conditioning apparatus of the present invention with reference to the drawings.

Embodiment 1

Figure 1:
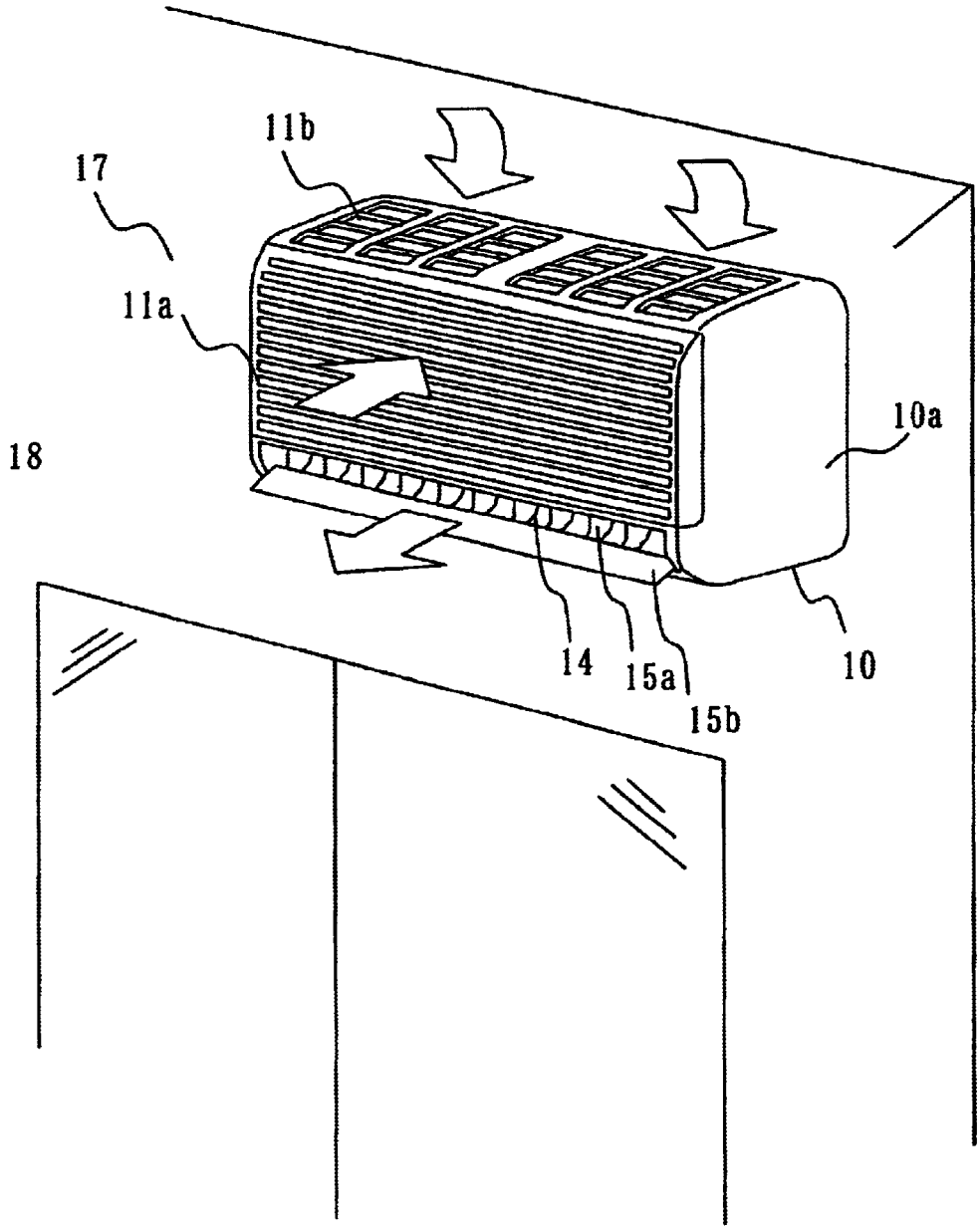
FIG. 1 is an external view illustrating the structure of an air conditioning apparatus according to a first embodiment of the present invention.
Figure 2:
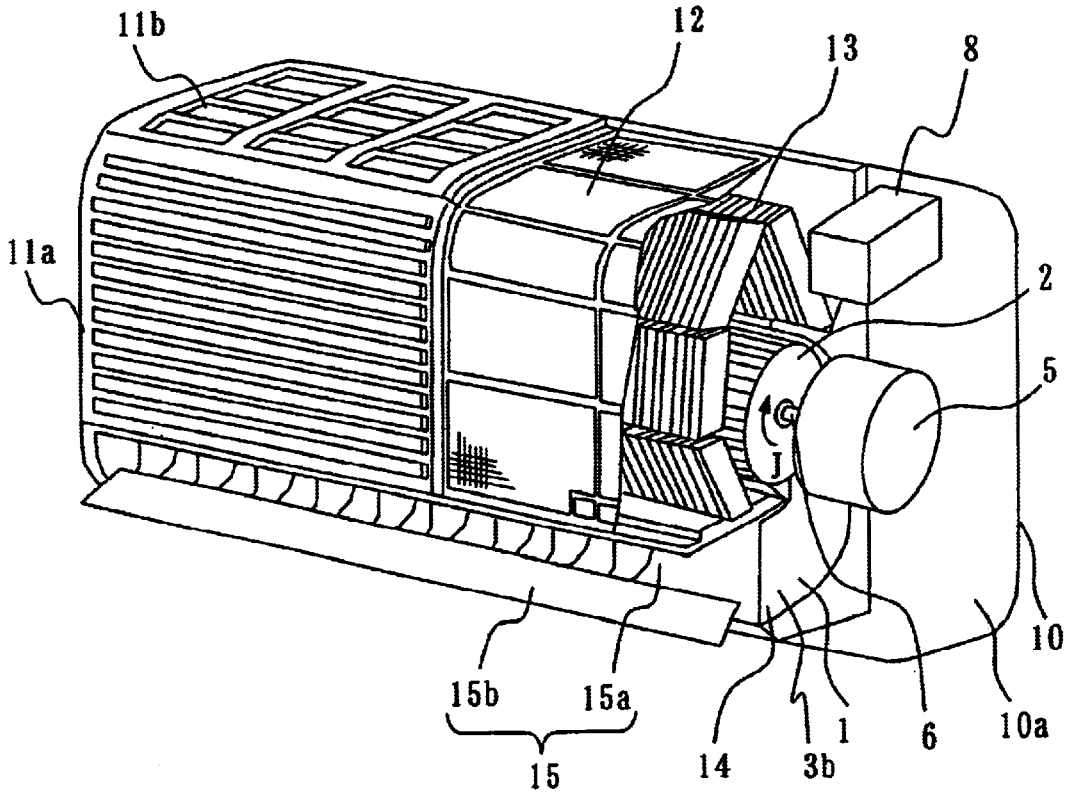
FIG. 2 is a partial cross-sectional view of the air conditioning apparatus of FIG. 1.
Figure 3:
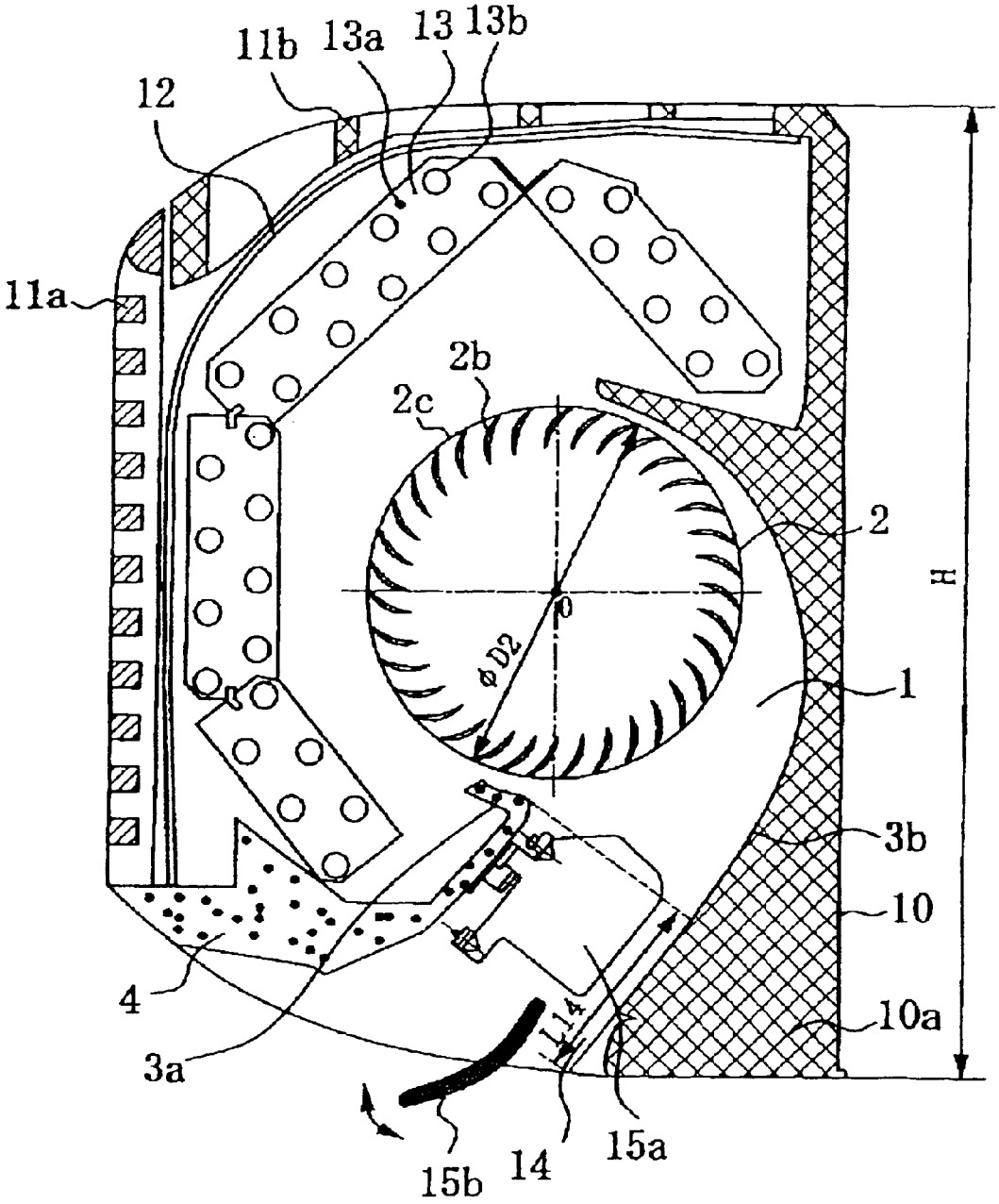
FIG. 3 is a longitudinal cross-sectional view of the air conditioning apparatus of FIG. 1.

FIG. 1 is an external view illustrating the structure of an air conditioning apparatus according to this invention. FIG. 2 is a partial cross-sectional view of the air conditioning apparatus of this invention. FIG. 3 is a longitudinal cross-sectional view of the air conditioning apparatus of this invention.

With referring to FIG. 1, FIG. 2 and FIG. 3, a reference numeral 10 denotes the main body of the air conditioning apparatus of this invention the height of which is H. A reference numeral 10*a* denotes a housing. A reference numeral 11*a* denotes a front air inlet grille and a reference numeral 11*b* denotes an upper air inlet grille. A reference numeral 12 denotes a filter for removing floating dust in room air. A reference numeral 13 denotes a heat exchanger, a reference numeral 13*a* denotes an aluminum fin and a reference numeral 13*b* denotes a pipe. A reference 14 denotes an air outlet. A reference numeral 15 denotes blowing-direction changing vanes, a reference numeral 15*a* denotes a left/right vane and a reference numeral 15*b* denotes an up/down vane. A reference numeral 1 denotes a cross flow fan. A reference numeral 2 denotes the impeller of the cross flow fan. A reference numeral 3*a* denotes a stabilizer. A reference numeral 3*b* denotes a guide wall. A reference numeral 4 denotes a nozzle. A reference numeral 5 denotes a fan motor for operating the impeller 2. A reference numeral 6 denotes a rotating shaft. A reference numeral 8 denotes a box for electric equipment.

The thus configured main body of the air conditioning apparatus 10 is installed on a wall 17 of a room 18. The outside of the main body is formed by the housing 10*a* and the detachable front air inlet grille 11*a*. Further, the housing 10*a* is formed by the upper air inlet grille 11*b*, the guide wall 3*b* near the back of the main body, and the nozzle 4 in a lower front portion of the main body. The air outlet 14 is formed by the nozzle 4 and the guide wall 3*b*. The nozzle 4 is formed in such a manner as to incorporate the stabilizer 3.

Besides, the front air inlet grille 11*a*, the upper air inlet grille 11*b* and the filter 12, and furthermore, the heat exchanger 13 are disposed on the air inlet side of the cross flow fan 1. Then, the box for electric equipment 8 stores an electrical substrate for controlling the blowing-direction changing vanes 15 and the fan motor 5.

Figure 4:
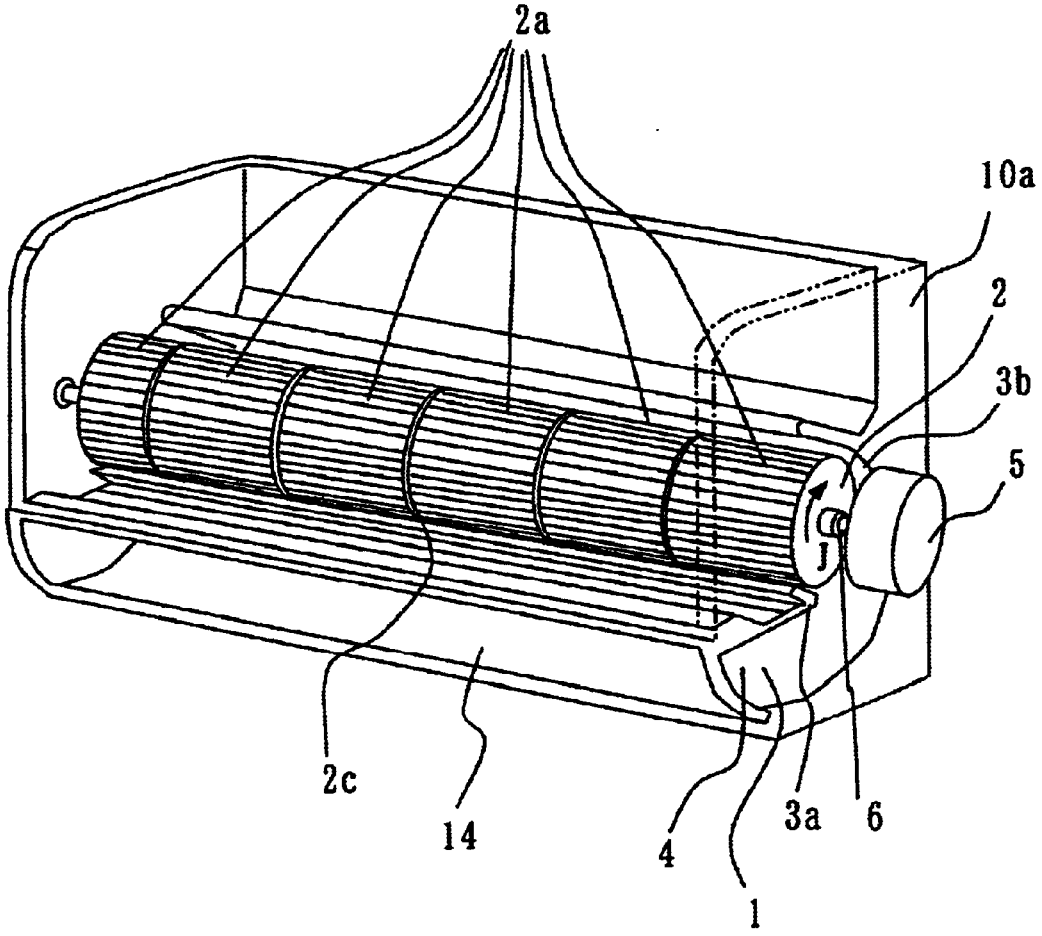
FIG. 4 is a perspective view of a cross flow fan in FIG. 1.
Figure 5:
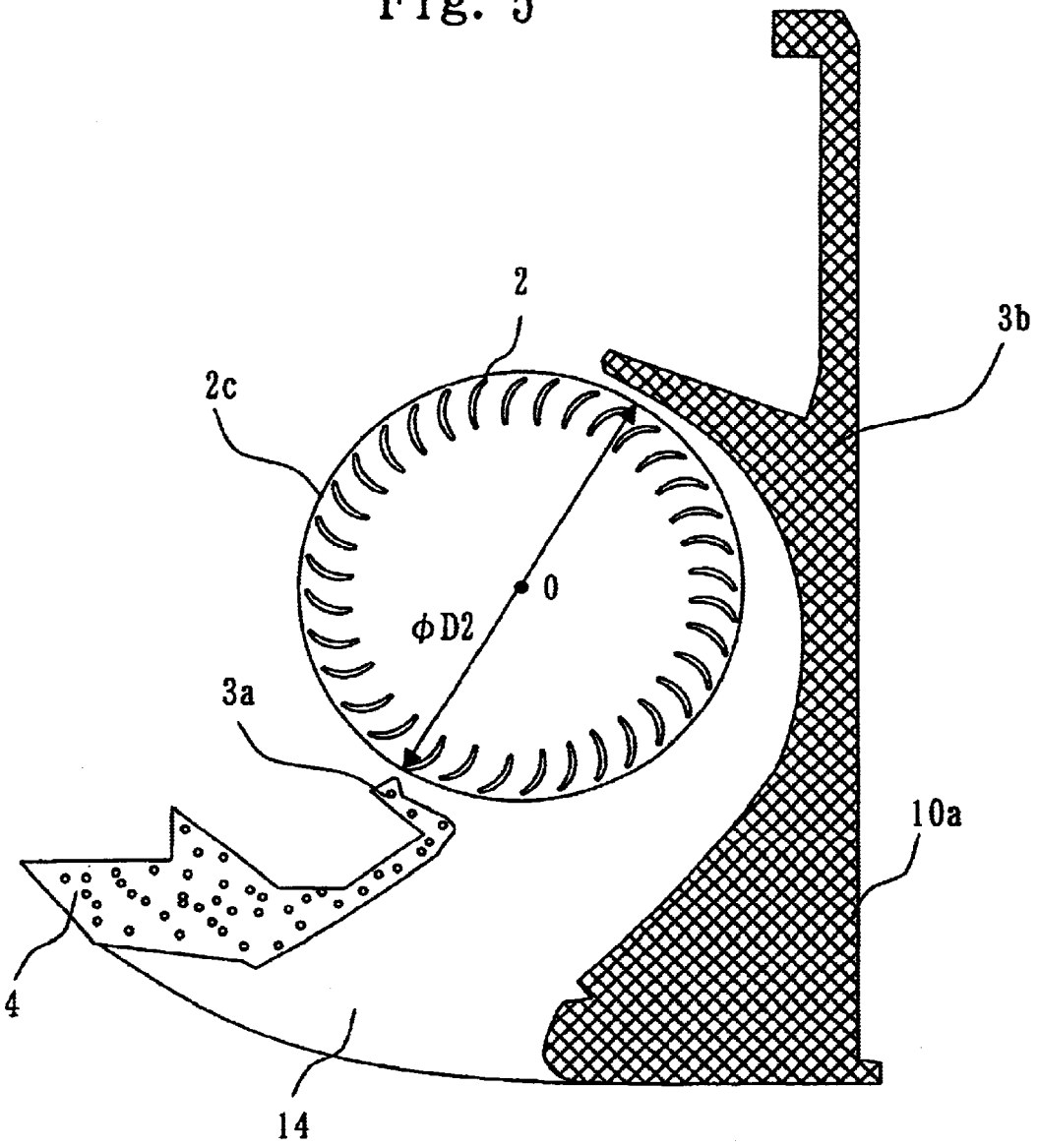
FIG. 5 is a longitudinal cross-sectional view of the cross flow fan of FIG. 4.

FIG. 4 is a perspective view of the cross flow fan. FIG. 5 is a longitudinal cross-sectional view of the cross flow fan, where ϕD2 indicates the outside diameter of the impeller. Referring now to the cross flow fan 1 shown in FIG. 4 and FIG. 5, a reference numeral 2*a* denotes impeller units, a reference numeral 2*b* denotes a vane of the impeller 2, and a reference numeral 2*c* denotes a ring of the impeller 2. The cross flow fan 1 is formed by the impeller 2, the guide wall 3*b* and the stabilizer 3*a*. The impeller 2 is formed by connecting a plurality of impeller units 2*a* in the direction of the shaft, each impeller unit being formed by a plurality of vanes 2*b* and the ring 2*c* for supporting the plurality of vanes. The guide wall 3*b* surrounds the impeller 2 in such a manner as to cover one side of the peripheral surface of the impeller for guiding the flow of air blown off from the impeller 2 to the air outlet 14. The stabilizer 3*a* is placed in such a manner as to face the guide wall 3*b* for controlling the position of a circulating vortex C1 which is generated inside the impeller 2 of the cross flow fan. The impeller 2 rotates and operates around the center of the rotating shaft 6 in the direction indicated by an arrow J. Still more, in this and the following embodiments, in a case where a magnesium alloy, for example, is used as a material for the impeller 2, the impeller will become recyclable.

Under this condition, an operation is to be started. When the impeller 2 of the cross flow fan 1 is rotated and operated by the fan motor 5 as indicated by the arrow J of FIG. 2, air in the room 18 is sucked in through the front air inlet grille 11*a* and the upper air inlet grille 11*b*, then passes through the filter 12 where floating dust in the room air is removed, then is refrigerated or heated by the heat exchanger 13, and then sucked into the impeller 2. The air blown off from the impeller 2 is blown off upward/downward and leftward/rightward into the room 18 through the up/down vane 15*b* and the left/right vane 15*a*, respectively, provided at the air outlet 14.

In the case of no change being made with the height H of the main body 10 of the thus described air conditioning apparatus, as the outside diameter ϕD2 of the impeller corresponding to the outside diameter of the ring of the impeller 2 of the cross flow fan becomes larger, the noise level is lowered at the same flow rate. In addition, the static air pressure of the impeller 2 becomes high. Therefore, even if the ventilating resistance is added on the air inlet side, the fan characteristic does not becomes worse easily. However, if the outside diameter ϕD2 of the impeller is too large, an interference occurs with the heat exchanger 13. Besides, the length L14 of the air outlet 14 becomes too short for the fan, and the flow of blown air becomes unstable. As a result, surging may be caused for the worst so that the noise level is increased. In addition to that, the air of the room 18 flows backwards towards the air outlet 14, so that dew is condensed when cooling. Furthermore, it causes the detachment of the flow of air on the surface of the vane 2*b*, which causes such singular noise Sm in a low frequency range as that discussed with reference to FIG. 54 in the conventional example. To the contrary, in the case that the outside diameter ϕD2 of the impeller is too small, it is required to rotate the impeller at a high rate in order to supply blowing wind at the same flow rate as that described above. In that case, the impeller 2 vibrates, thereby shaking the air conditioning apparatus, which may cause a fear of the air conditioning apparatus falling down in the end. In addition to that, the noise level is severely increased. Furthermore, an increase in the pressure of the impeller 2 is small, therefore if a resistance is added on the air inlet side, a decrease in the flow rate becomes extreme at the same rotational frequency. Still more, as the outside diameter ϕD2 of the impeller is increased or reduced, the size of the guide wall 3*b* and the size of the nozzle 4 incorporating the stabilizer 3*a* is increased or reduced, respectively, in a similar manner.

Hence, there is an optimal range for the relationship between the height H of the main body of the air conditioning apparatus 10 and the outside diameter ϕD2 of the impeller.

Figure 6:
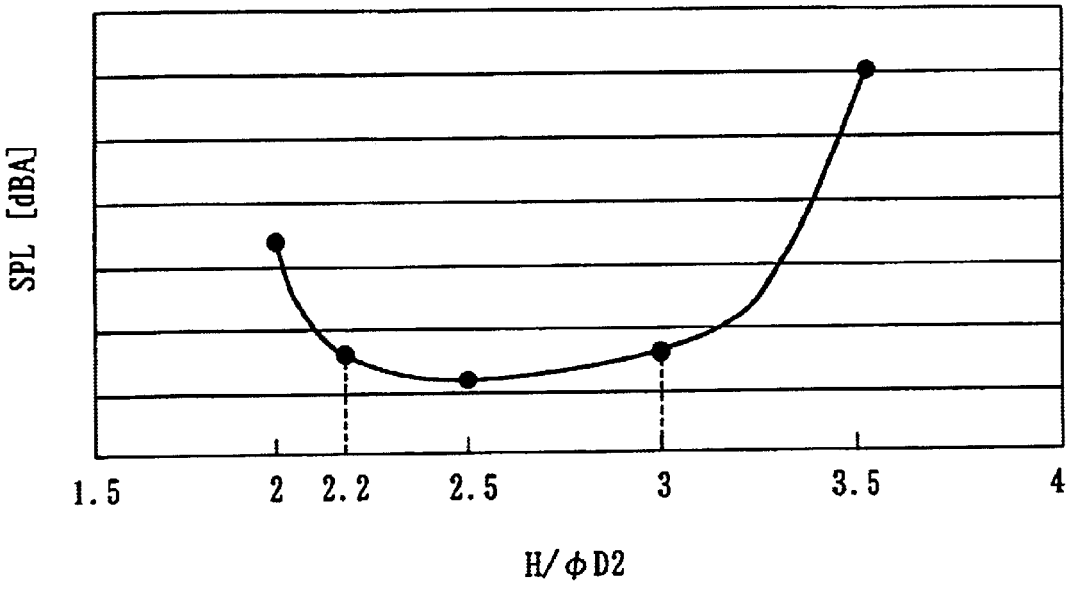
FIG. 6 is a diagram illustrating the relationship between a ratio H/ϕD2 of the outside diameter ϕD2 of an impeller to the height H of the main body and the noise level SPL[dBA] at the same flow rate Q[$m^3$/min].

FIG. 6 is a diagram illustrating the noise level SPL[dBA] in relation to the ratio H/ϕD2 of the outside diameter ϕD2 of the impeller to the height H of the main body. As shown in FIG. 6, if the ratio H/ϕD2 is 2.2 or above and 3.0 or below, the noise level changes only a little.

In the case of applying the ratio of the above ratio H/ϕD2 to an air conditioning apparatus, it is particularly effective to apply the ratio to a wall-mounted type of an air conditioning apparatus. The height H of the main body of the air conditioning apparatus should be between 240 mm and 310 mm, therefore it is low in height and compact, which is one of the product values of the air conditioning apparatus.

Furthermore, if the outside diameter ϕD2 of the impeller is too large and the ratio H/ϕD2 is too small, then the suction resistance of the impeller 2 becomes high, so that the singular noise Sm is generated.

Figure 7:
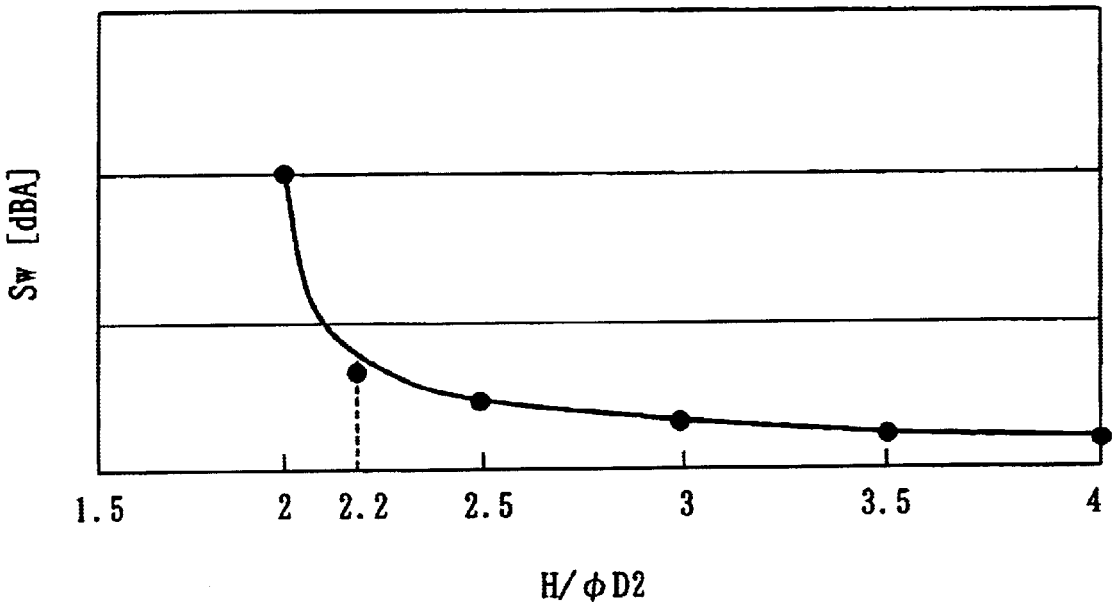
FIG. 7 is a diagram illustrating the relationship between the ratio H/ϕD2 and a maximum level of singular noise Sw[dBA].

As shown in a diagram illustrating the ratio H/ϕD2 and a maximum noise level Sw[dBA] of the singular noise Sw of FIG. 7, when H/ϕD2 is 2.2 or more, the singular noise Sm is small, therefore a favorable atmosphere may be achieved to the ear.

Still more, a mixture of plastic and grass fiber, for example, used as a material for a conventional impeller may not be used for the impeller 2. If a magnesium alloy is used, instead, as the magnesium alloy is more refractory, the strength of the product will be preserved even if a heating source such as a heater is placed near the impeller 2.

AS aforementioned, when cooling, dew does not condense at the air outlet, the noise level does not change much, and shaking is only small. In addition to that, no singular noise is generated, and even if the resistance in the passage of air on the air inlet side becomes high, the flow rate may be lowered only a little. Thus, an air conditioning apparatus which is reliable with a stable operation and silent with a favorable atmosphere to the ear may be obtained.

Embodiment 2

Figure 8:
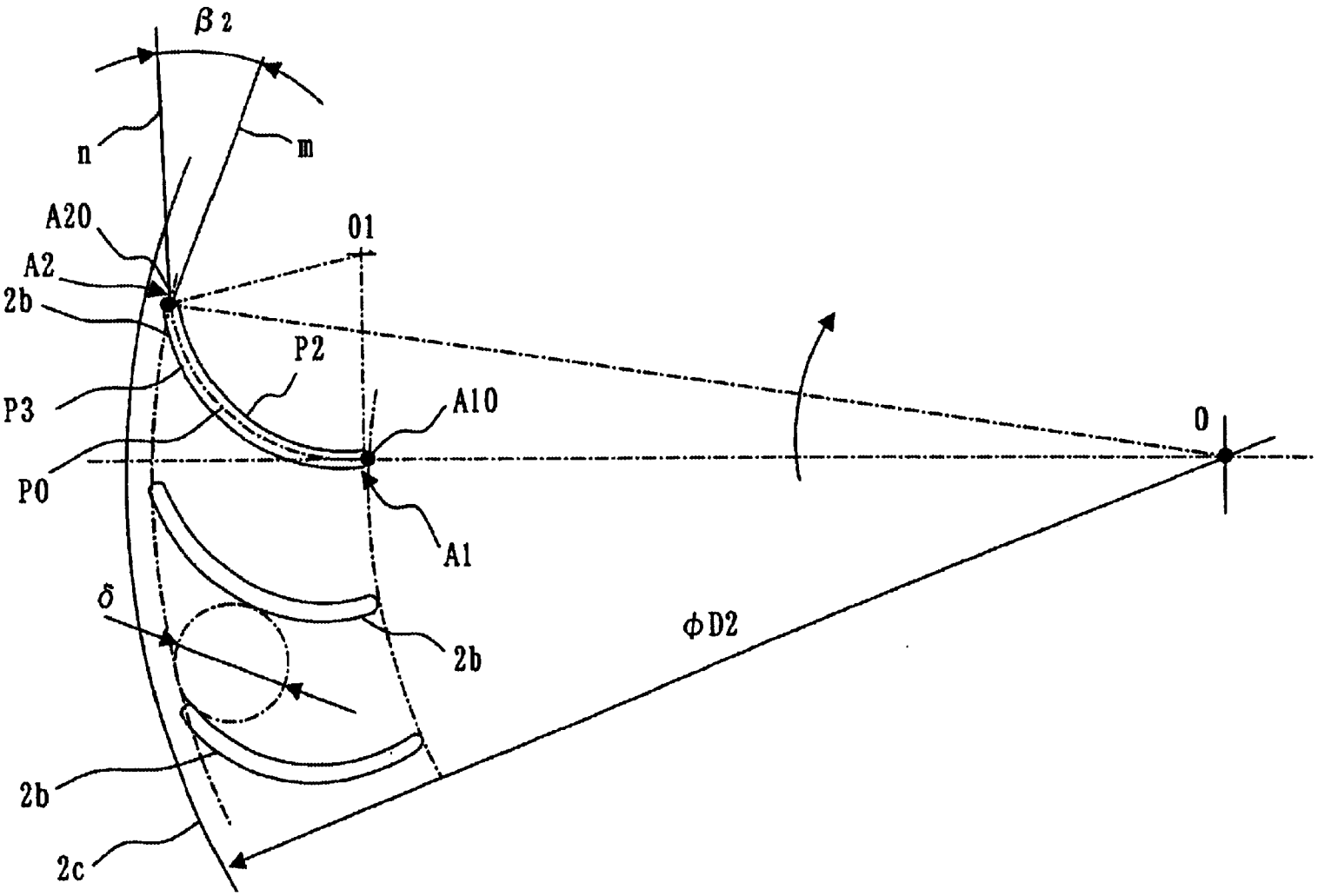
FIG. 8 is a diagram illustrating a shape of a vane 2*b* of the impeller of a cross flow fan to be used as an air blowing means for an air conditioning apparatus of a second embodiment of the present invention.

FIG. 8 is a diagram illustrating the shape of a vane 2*b* of the impeller of a cross flow fan to be used as an air blowing means for an air conditioning apparatus of a second embodiment of the present invention. It is to be noted that elements other than the vane 2*b* of this embodiment are the same as those of the air conditioning apparatus and the cross flow fan of FIG. 1 to FIG. 5 discussed in the first embodiment, therefore the same reference numerals as those of the embodiment are assigned to those elements and then the description will be omitted.

With referring to a cross-sectional shape of the vane 2*b* of FIG. 8, a reference numeral A20 denotes a tip of a vane's peripheral end portion A2 of the vane 2*b*. A reference numeral A10 denotes a tip of a vane's internal circumferential end portion A1 of the vane 2*b*. A reference mark O denotes the center of the rotating shaft of the impeller 2 of the cross flow fan, and a reference numeral O1 denotes the center of a camber line P0 formed in a single circular arc, the camber line being the center line of the thickness of the vane 2*b*. A reference numeral P2 denotes a pressure face of the vane 2*b* on a side facing the direction of rotation of the impeller, and a reference numeral P3 denotes a suction surface opposing to the pressure face P2. Further, O-A20 indicates a first straight line connecting the tip of the vane's peripheral end portion A20 of the vane 2*b* and the center O, and O1-A20 indicates a second straight line connecting the tip of the vane's peripheral end portion A20 of the vane 2*b* and the center O1 of the camber line P0. Further, a reference mark n denotes a first perpendicular of the first straight line O-A20 to the tip of the vane's peripheral end portion A20, a reference mark m denotes a second perpendicular line of the second straight line O1-A20 to the tip of the vane's peripheral end portion A20. An exit angle β2 is an acute angle formed by the first perpendicular and the second perpendicular.

Furthermore, the ratio H/ϕD2 of the height H of the main body of the air conditioning apparatus to the outside diameter ϕD2 of the impeller is 2.2 or above and 3.0 or below.

As the exit angle β2 of FIG. 8 becomes larger, a distance between vanes δ is more extended, where the distance δ is the diameter of a circle coming in contact with the respective surfaces of the pressure face P2 of the vane 2*b* and the suction surface P3 of the next vane 2*b*. Consequently, when the flow of air passes between vanes, the ventilating resistance becomes low. Therefore, the shaft power for operating the impeller 2 is reduced, which allows the power consumption of the motor to be reduced.

Figure 9:
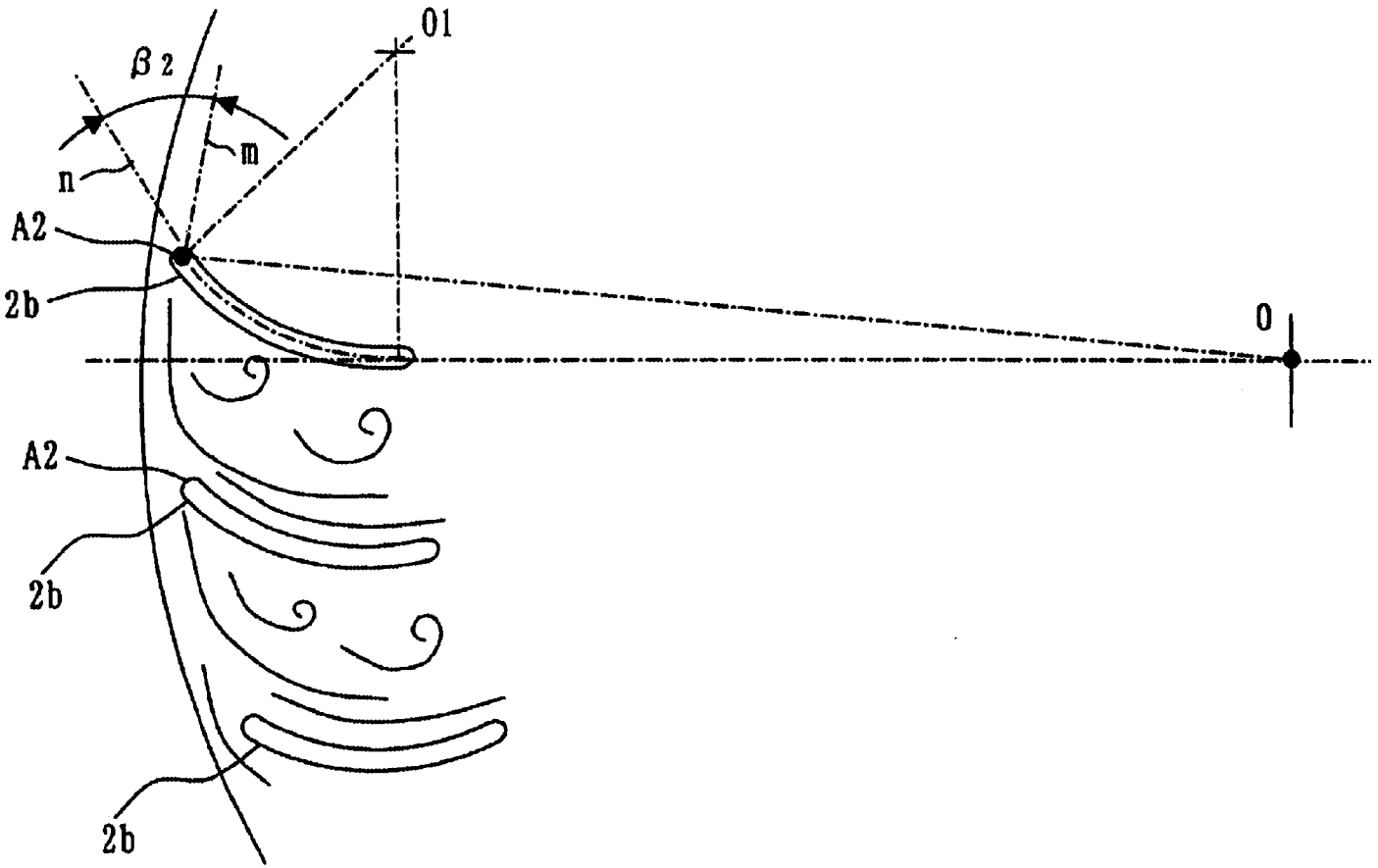
FIG. 9 is a diagram illustrating a state of a vane's peripheral end portion A2 of the vane 2*b* of the impeller 2 according to the air conditioning apparatus of this invention in a case where an exit angle 2 is too large.

However, if the exit angle β2 is too large, then the suction air of the impeller 2 detaches at the peripheral end portion A2 of the vane 2*b* as shown in FIG. 9, and the impeller is caused to stall. As a result, the movement of the impeller 2 of the cross flow fan becomes unstable, which may cause the wind blown off from the air outlet 14 of the air conditioning apparatus 10 to flow backwards into the impeller 2.

To the contrary, if the exit angle β2 is too small, then the distance between vanes δ is reduced. Consequently, when the flow of air passes between the vanes, the ventilating resistance becomes high. As a result, the shaft power for operating the impeller 2 is increased, thereby increasing the power consumption of the motor.

Hence, there is an optimal range for the exit angle β2 to achieve the situation that the movement of the impeller 2 become stable and the shaft power is reduced so that the power consumption of the motor is reduced.

Figure 10:
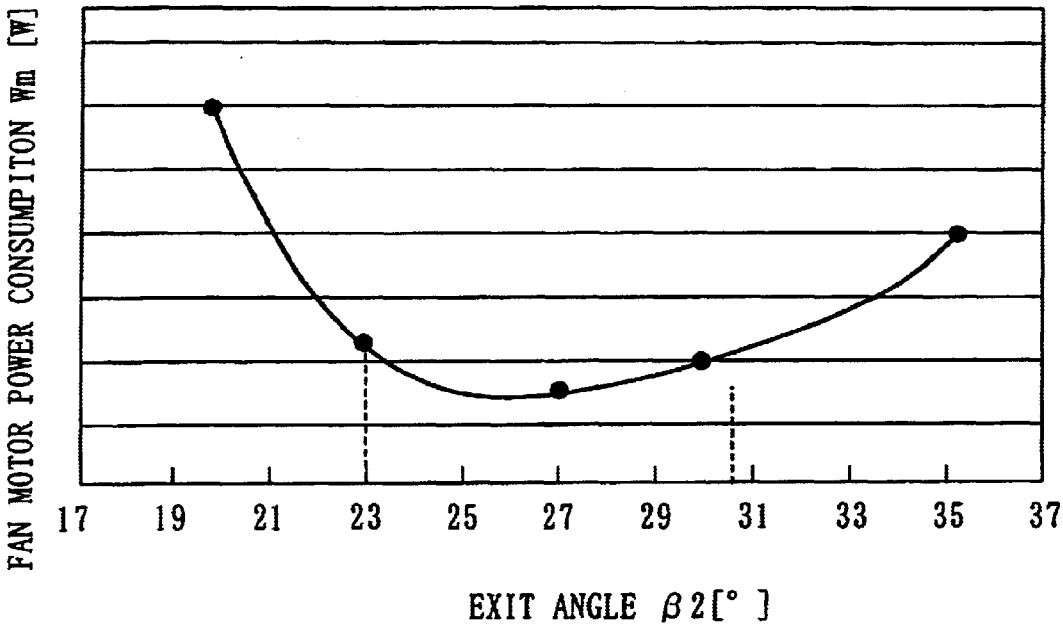
FIG. 10 is a diagram illustrating the relationship between the vane's exit angle β2 and the motor power consumption Wm[W] according to the air conditioning apparatus of this invention.

FIG. 10 shows the relationship between the exit angle β2 of the vane and the power consumption Wm[W] of the motor. As shown in FIG. 10, if the exit angle β2 is at least between 23 degrees and 30 degrees, an energy-saving air conditioning apparatus which achieves a reduced consumption of the motor power may be obtained.

Embodiment 3

Figure 11:
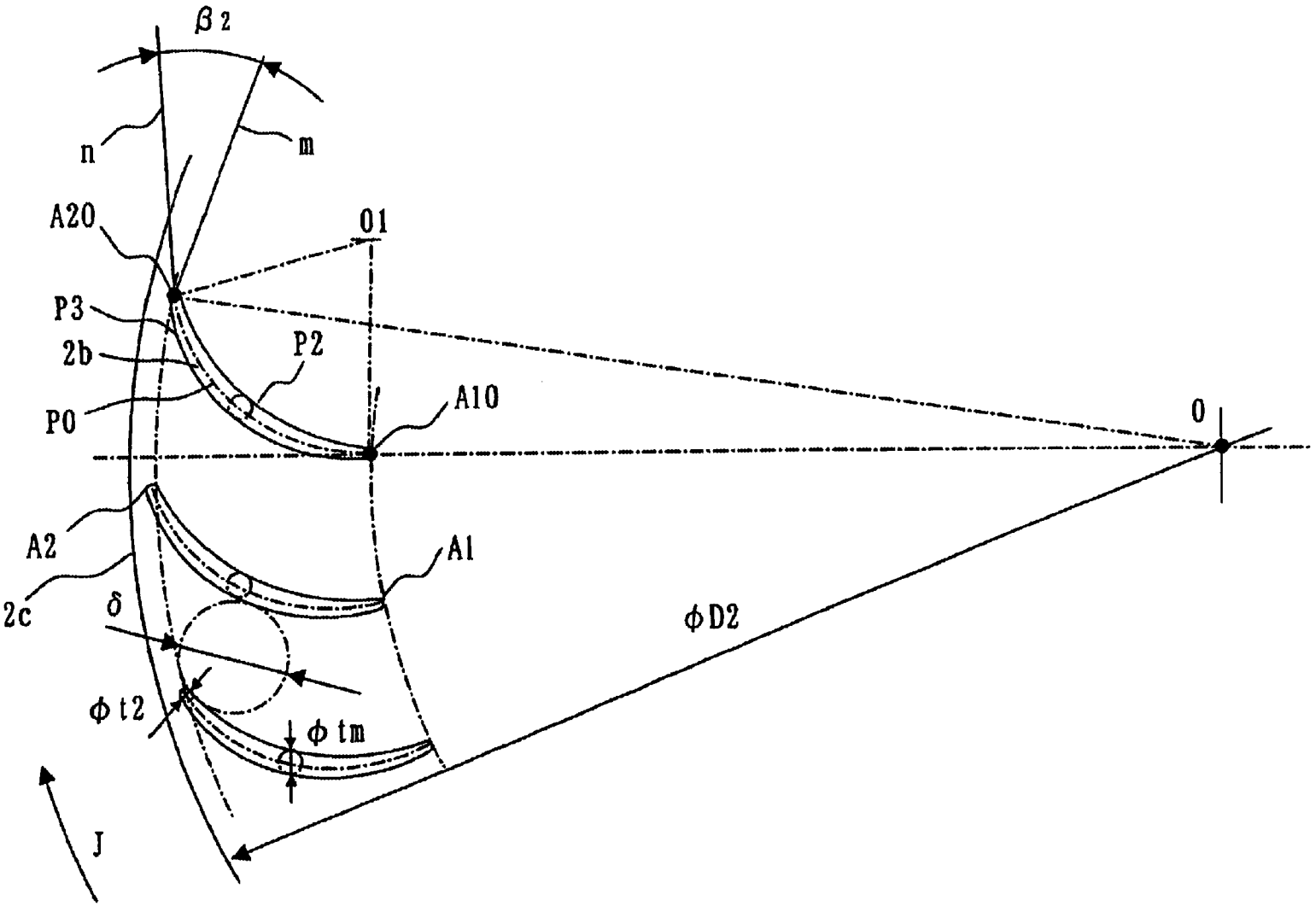
FIG. 11 is a diagram illustrating a shape of a vane 2*b* of the impeller of a cross flow fan to be used as an air blowing means for an air conditioning apparatus of a third embodiment of the present invention.

FIG. 11 is a diagram illustrating the shape of a vane 2*b* of the impeller of a cross flow fan to be used as an air blowing means for an air conditioning apparatus according to a third embodiment of the present invention. It is to be noted that elements other than the vane 2*b* in this embodiment are the same as those of the air conditioning apparatus and the cross flow fan of FIG. 1 to FIG. 5 discussed above in the first embodiment, therefore the same reference numerals as those of the embodiment are assigned to the elements and then the description will be omitted.

With referring to a cross-sectional shape of the vane 2*b* of FIG. 11, the reference numeral A20 denotes the tip of the vane's peripheral end portion A2 of the vane 2*b*. The reference numeral A10 denotes the tip of the vane's internal circumferential end portion A1 of the vane 2*b*. The reference mark O denotes the center of the rotating shaft of the impeller 2 of the cross flow fan, and the reference numeral O1 denotes the center of the camber line P0 formed into a single circular arc, the camber line being the center line of the vane 2*b* in the direction of the thickness. The reference numeral P2 denotes the pressure face of the vane 2*b* on a side facing the direction of rotation of the impeller, and the reference numeral P3 denotes the suction surface opposing to the pressure face P2. Further, O-A20 indicates the first straight line connecting the tip of the vane's peripheral end portion A20 of the vane 2*b* and the center O, and O1-A20 indicates the second straight line connecting the tip of the vane's peripheral end portion A20 of the vane 2*b* and the center O1 of the camber line P0. Further, the reference mark n denotes a first perpendicular of the first straight line O-A20 to the tip of the vane's peripheral end portion A20, the reference mark m denotes a second perpendicular line of the second straight line O1-A20 to the tip of the vane's peripheral end portion A20. The exit angle 2 is an acute angle formed by the first perpendicular and the second perpendicular. Furthermore, the maximum thickness of the vane 2*b* around the center is tm and the thickness of the vane's peripheral end portion, which is the diameter of the circular-arc shaped vane's end portion A2 and the minimum thickness, is t2.

Further, the ratio H/φD2 of the height H of the main body of the air conditioning apparatus to the outside diameter φD2 of the impeller is 2.2 or above and 3.0 or below. Furthermore, the exit angle β2 is within a range from 23 degrees to 30 degrees.

With referring to FIG. 11, the maximum thickness tm is not changed and the thickness of the vane's peripheral end portion t2, which is the vane's minimum thickness, is reduced. Otherwise, the thickness t2 of the vane's peripheral end portion, which is the vane's minimum thickness, is not changed, and the vane's maximum thickness tm is increased. In other words, a thickness ratio tm/t2, which is the ratio of the vane's maximum thickness tm to the vane's minimum thickness t2, is increased.

Figure 53:
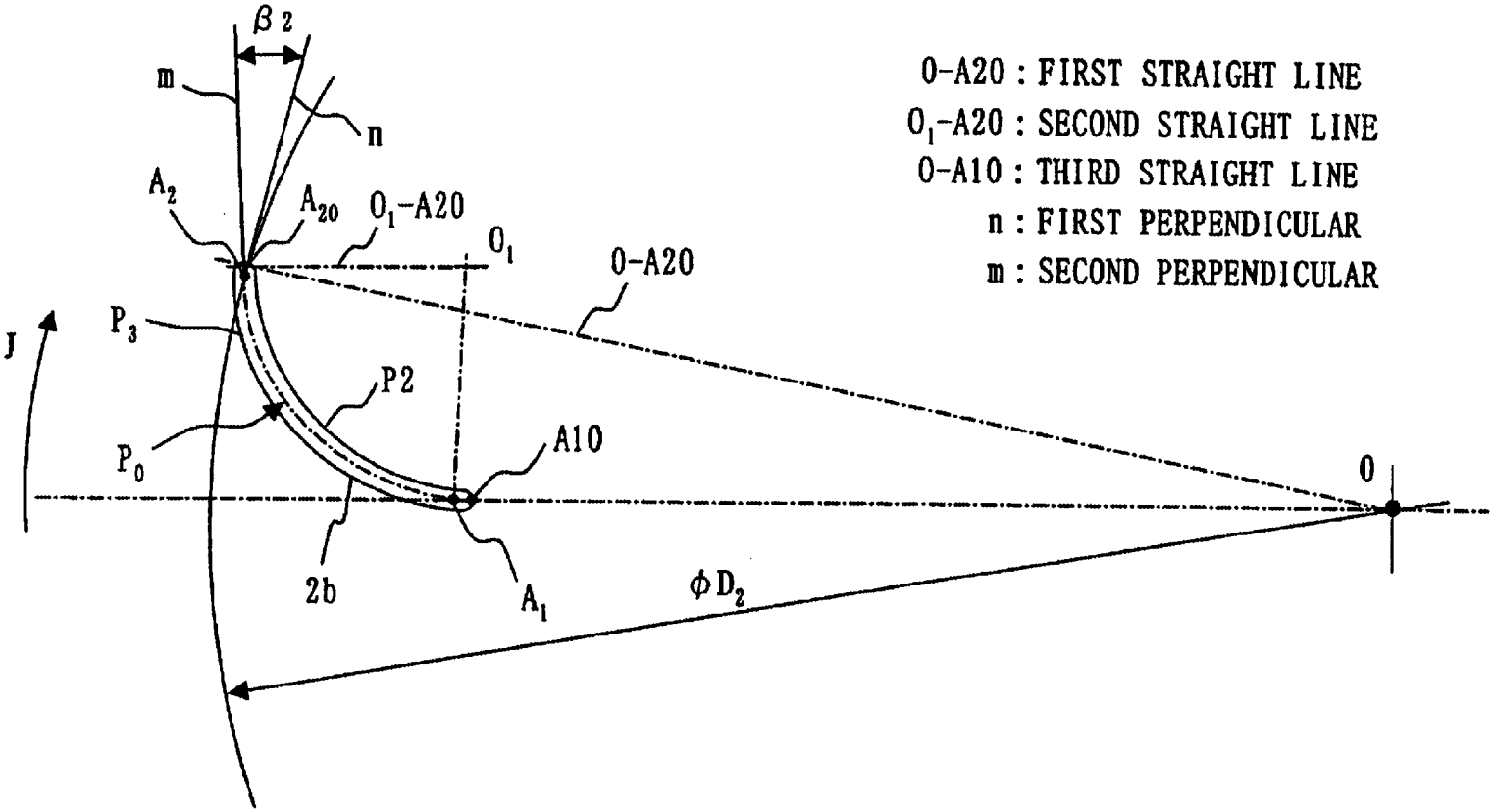
FIG. 53 is a cross-sectional view of a vane of the cross flow fan of the conventional air conditioning apparatus.
Figure 54:
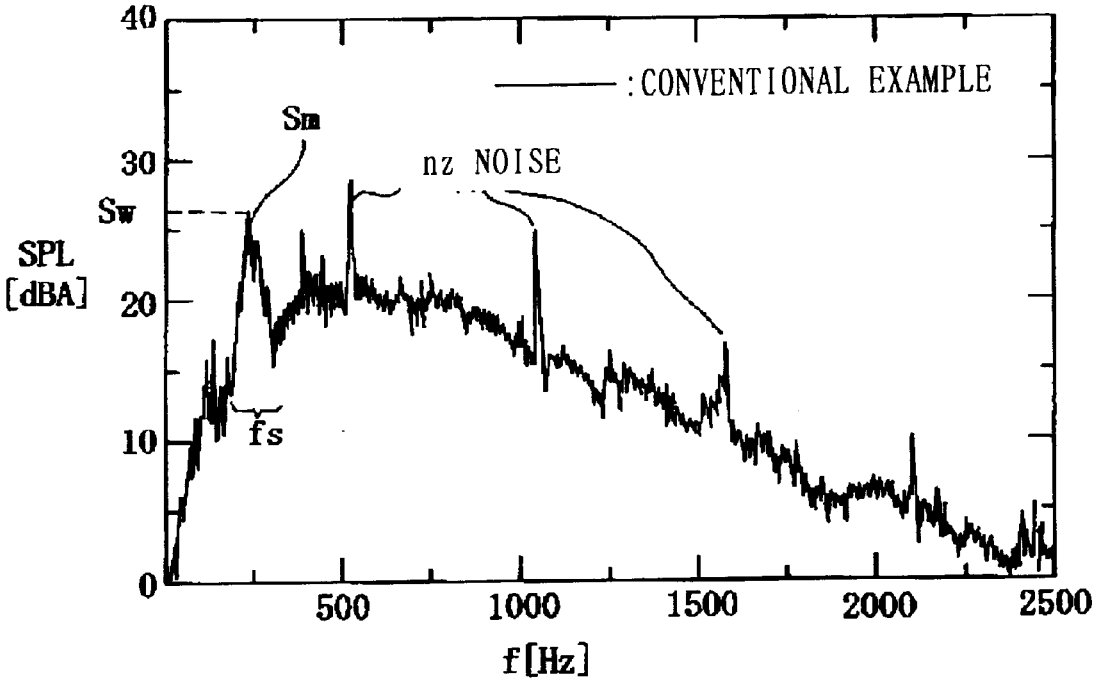
FIG. 54 is a diagram illustrating the frequency characteristic of noise of the air conditioning apparatus in which the conventional cross flow fan is mounted.

However, in the case of the vane 2*b* of the impeller 2 of the conventional cross flow fan, the thickness ratio tm/t2 of which is small and the exit angle β2 of which is 23 degrees or more as shown in FIG. 53, if the ventilating resistance is increased due to such as dust accumulating on the filter 12 of the body 10 of the air conditioning apparatus, when the vane 2*b* passes through an area F1 on the air inlet side of the impeller 2 and also in an upper front portion of the main body of the air conditioning apparatus 10, detachment is caused at the vane's peripheral end portion A2 of the vane 2*b* influenced by an inflow of suction air from the back side of the air conditioning apparatus 10. Then, a detaching vortex G1 is generated in the vicinity of the vane's suction surface P3, and also the flow rate is increased in the vicinity of the pressure face P2 of the next vane 2*b*. This causes singular noise Sm having a broad frequency band in a low frequency range to be generated as shown in FIG. 54.

As discussed above in this invention, by increasing the vane's thickness ratio tm/t2, the curvature of the vane's suction surface P3 is increased, which makes it difficult to detach. As a result, the rate of flow between the vane 2*b* and the next vane 2*b* becomes flat. In such a situation, no singular noise Sm will be generated.

However, if the thickness ratio tm/t2 is too large, the distance δ between vanes, which is the diameter of a circle coming in contact with both of the vane 2*b* and the next vane 2*b*, becomes narrow, and the ventilating resistance between the vanes is increased. As a result, the noise level at the same flow rate becomes aggravated. Hence, there is an optimal range for the thickness ratio.

Figure 12:
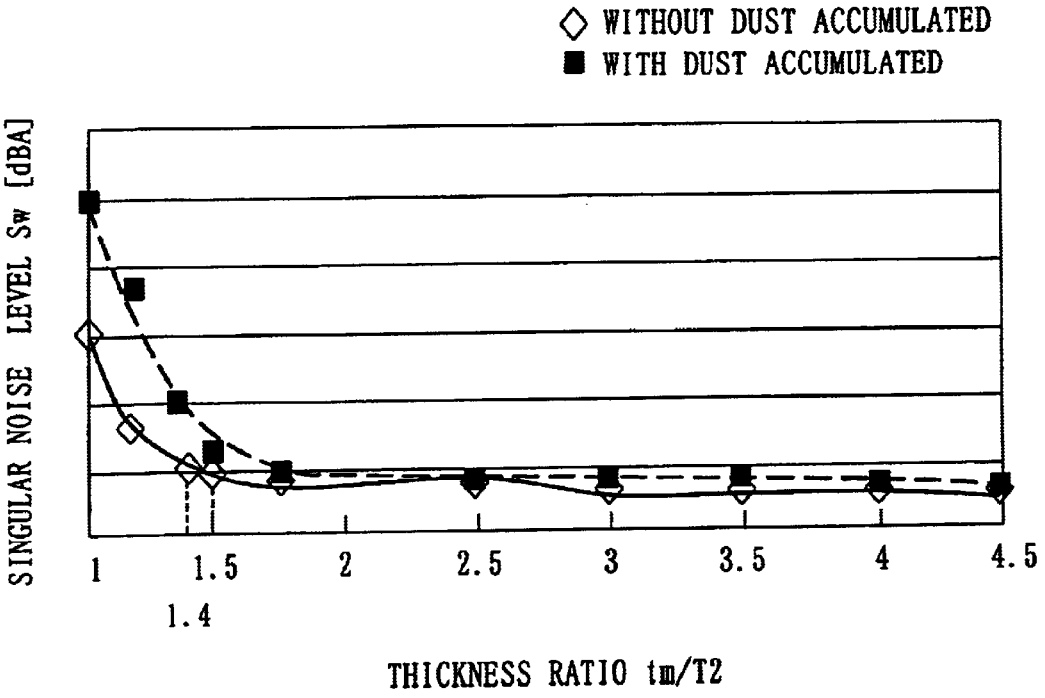
FIG. 12 is a diagram illustrating changes in the level of the singular noise Sm when a thickness ratio tm/t2 is varied in the cases of a filter 12 with and without dust being accumulated.
Figure 13:
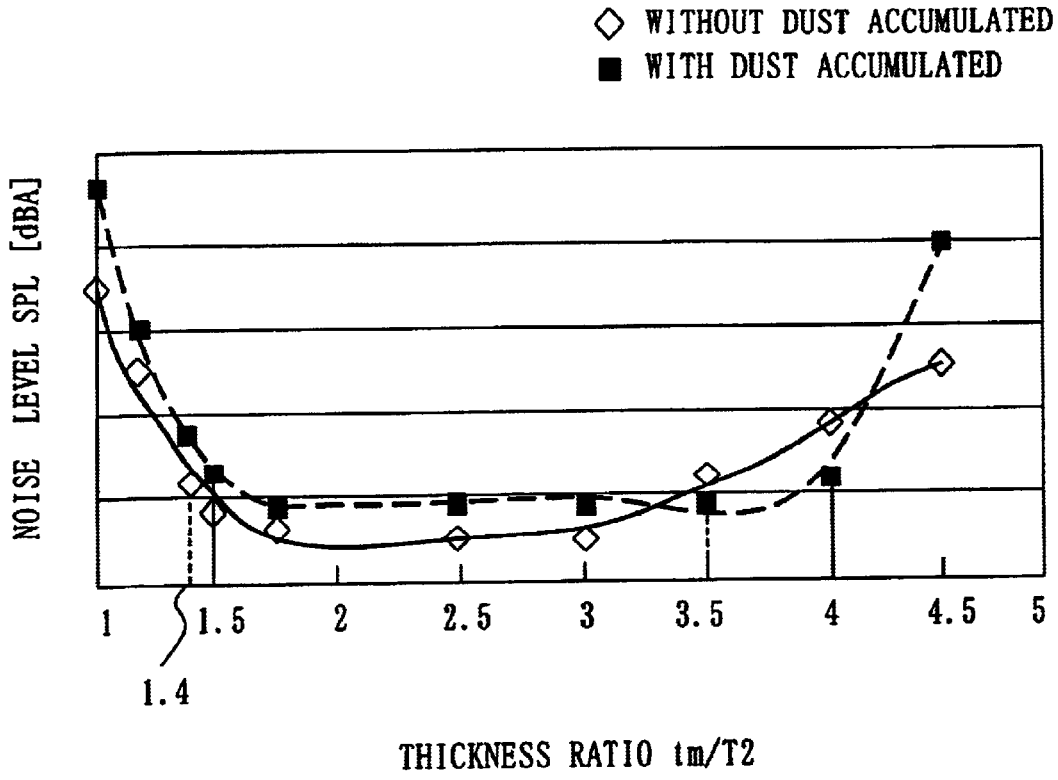
FIG. 13 is a diagram illustrating changes in the noise level SPL[dBA] at the same flow rate in the cases of the filter 12 with and without dust being accumulated.

FIG. 12 is a diagram illustrating a change in the level Sw[dBA] of the singular noise Sm when the thickness ratio tm/t2 is varied in the case of no dust accumulated on the filter 12 and in the case of dust accumulated on the filter 12. FIG. 13 is a diagram illustrating a change in the noise level SPL[dBA] at the same flow rate when the thickness ratio tm/t2 is varied, in the cases of the filter 12 with and without dust accumulated, which is similar to the diagram of FIG. 12.

With referring to FIG. 12, in the case of no dust accumulated on the filter 12, if the thickness ratio is 1.4 or more, then the singular noise Sm becomes low noise. In the case of dust accumulated on the filter 12, if the thickness ratio is 1.5 or more, the singular noise becomes low noise. Further, with reference to FIG. 13, when the filter 12 has no dust accumulated, if the thickness ratio is 1.4 or above and 3.5 or below, the noise level is low. With dust accumulated, if the thickness ratio is 1.5 or above and 4.0 or below, the noise level is low.

Thus, according to FIG. 12 and FIG. 13, if the thickness ratio tm/t2 is at least 1.5 or above and 3.5 or below, the singular noise Sm becomes low noise, and the noise level is not aggravated.

As a result, even if the ventilating resistance is increased due to such as dust accumulated on the filter 12 of the air conditioning apparatus, an air conditioning apparatus which provides a favorable atmosphere to the ear may be obtained.

Embodiment 4

Figure 14:
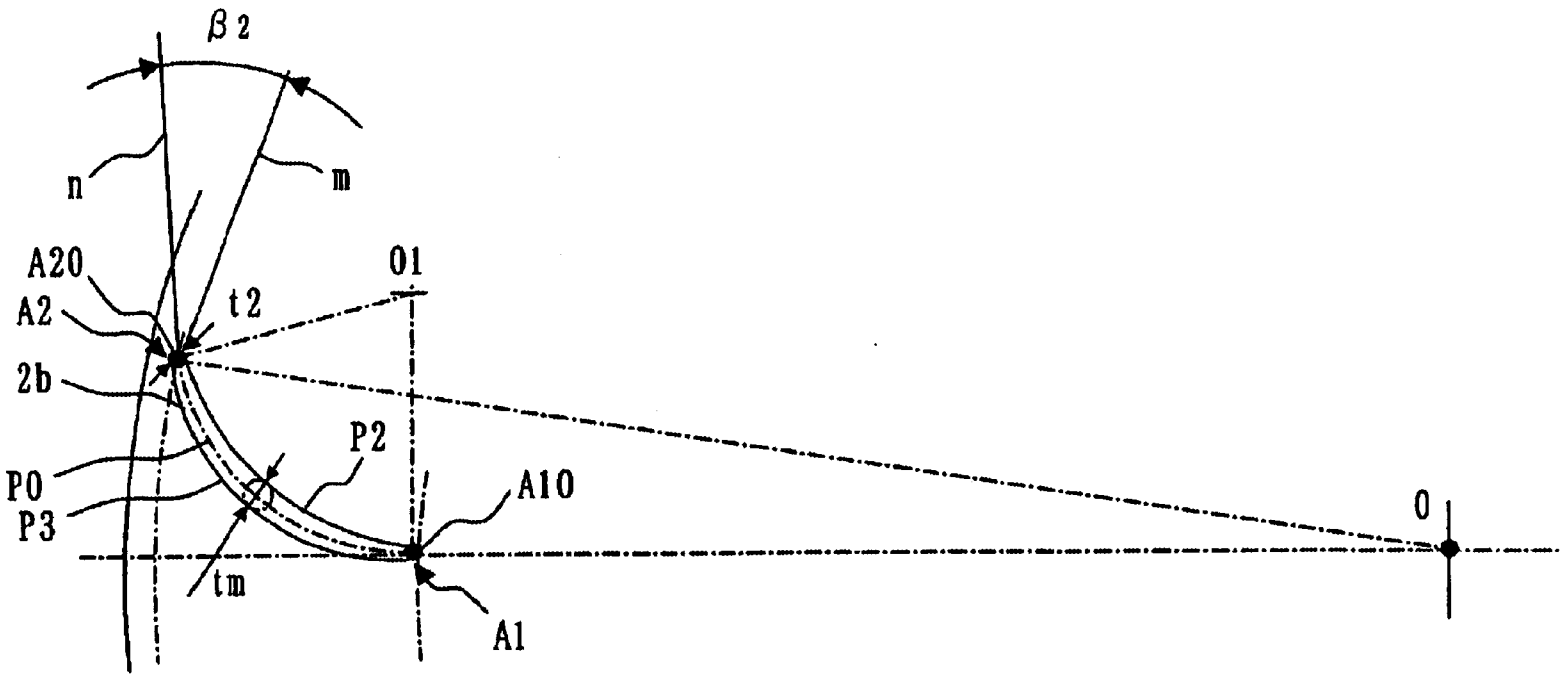
FIG. 14 is a diagram illustrating a shape of a vane 2*b* of the impeller of a cross flow fan to be used as an air blowing means for an air conditioning apparatus of a fourth embodiment of the present invention.

FIG. 14 is a diagram illustrating the shape of a vane 2*b* of the impeller of a cross flow fan to be used as an air blowing means for an air conditioning apparatus according to a fourth embodiment of the present invention. It is to be noted that elements other than the vane 2*b* in this embodiment are the same as those of the air conditioning apparatus and the cross flow fan of FIG. 1 to FIG. 5 discussed above in the first embodiment, therefore the same reference numerals as those of the embodiment are assigned to the elements and the description will be omitted.

With referring to a cross-sectional shape of the vane 2*b* of FIG. 14, the reference numeral A20 denotes the tip of the vane's peripheral end portion A2 of the vane 2*b*. The reference numeral A10 denotes the tip of the vane's internal circumferential end portion A1 of the vane 2*b*. The reference mark O denotes the center of the rotating shaft of the impeller 2 of the cross flow fan, and the reference numeral O1 denotes the center of the camber line P0 formed into a single circular arc, the camber line being the center line of the vane 2*b* in the direction of the thickness. The reference numeral P2 denotes the pressure face of the vane 2*b* on a side facing the direction of rotation of the impeller, and the reference numeral P3 denotes the suction surface opposing to the pressure face P2. Further, O-A20 indicates the first straight line connecting the tip of the vane's peripheral end portion A20 of the vane 2*b* and the center O, and O1-A20 indicates the second straight line connecting the tip of the vane's peripheral end portion A20 of the vane 2*b* and the center O1 of the camber line P0. Further, the reference mark n denotes the first perpendicular of the first straight line O-A20 to the tip of the vane's peripheral end portion A20, the reference mark m denotes the second perpendicular line of the second straight line O1-A20 to the tip of the vane's peripheral end portion A20. The exit angle β2 is an acute angle formed by the first perpendicular and the second perpendicular. Furthermore, a maximum thickness of the vane 2*b* around the center is tm and the thickness of a vane's peripheral end portion, which is the diameter of the circular-arc shaped vane's end portion A2 and a minimum thickness, is t2.

Figure 15:
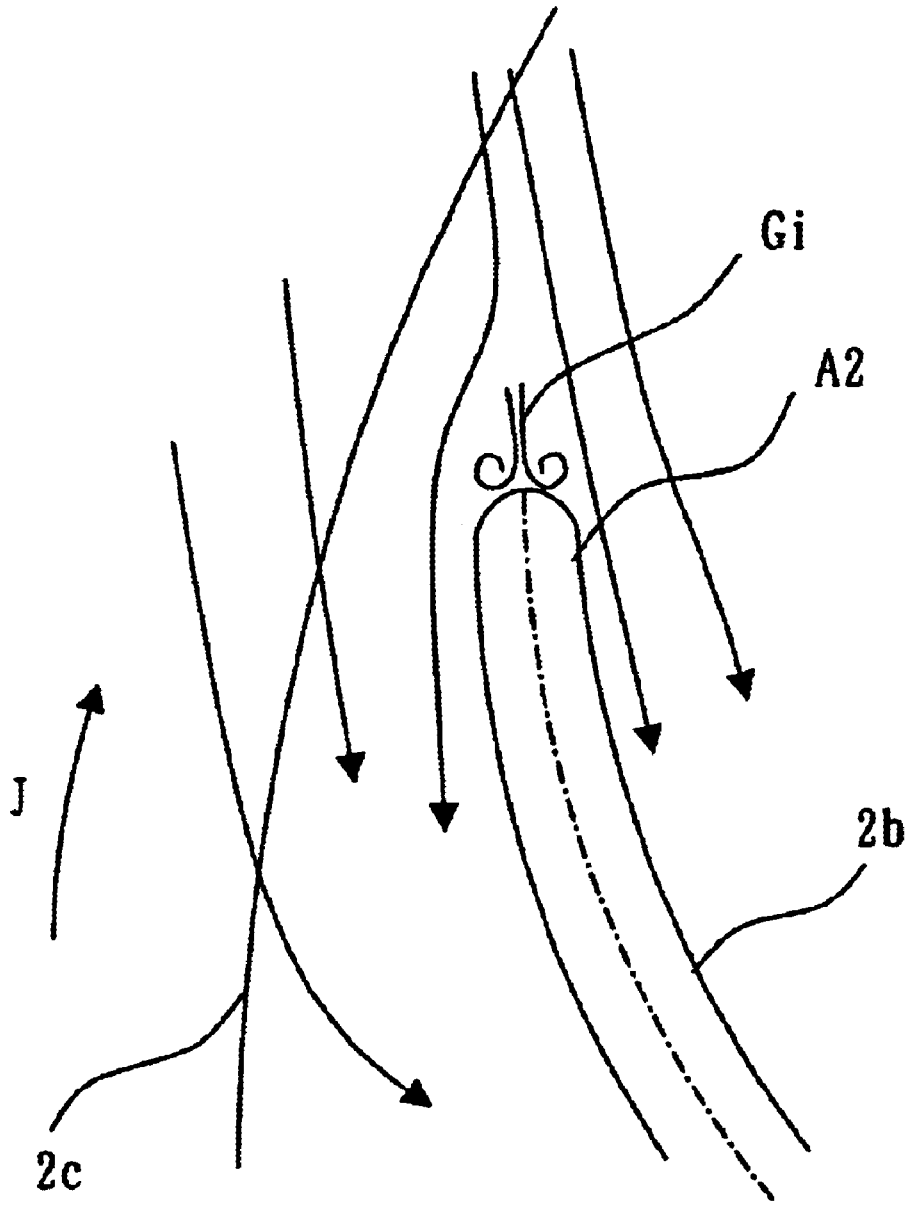
FIG. 15 is a diagram illustrating a state of the suction flow of air at the vane's peripheral end portion A2 of a conventional impeller according to the air conditioning apparatus of this invention.
Figure 16:
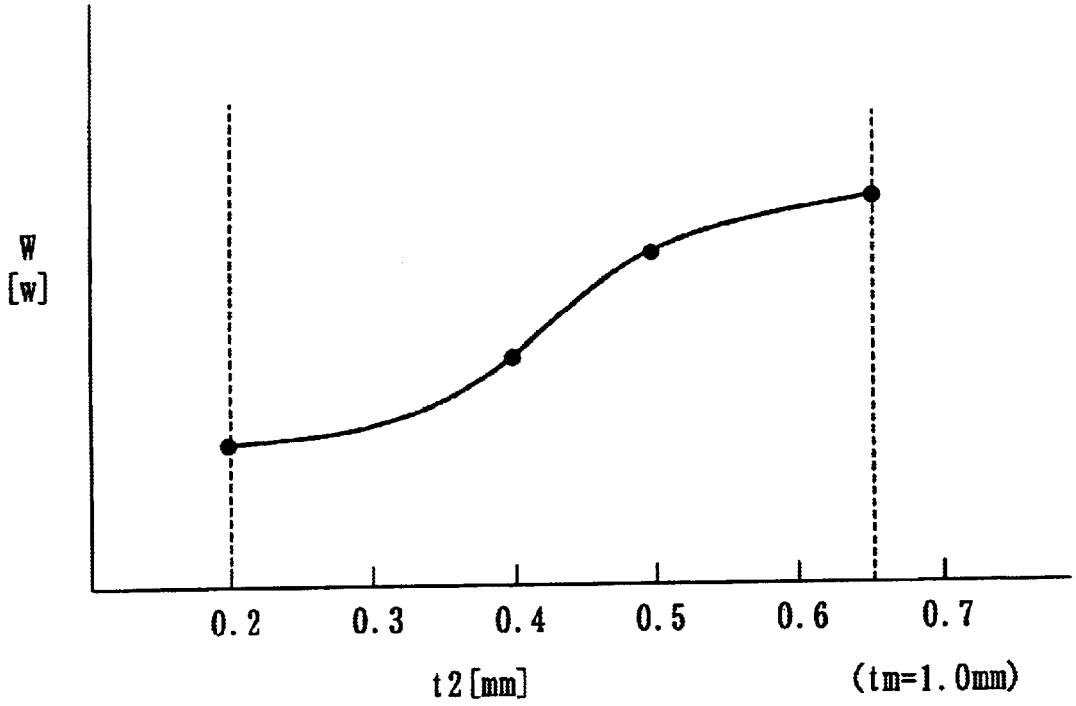
FIG. 16 is a diagram illustrating a change in the power consumption of a fan motor 5 when a vane's minimum thickness is varied according to the air conditioning apparatus of this invention.

With reference to the impeller 2 of a cross flow fan having the ratio H/ϕD2 of the outside diameter ϕD2 of the impeller 2 of the cross flow fan to the height H of the air conditioning apparatus 2.2 or above and 3.0 or below, according to the impeller of the conventional cross flow fan, the vane's maximum thickness tm is between 0.9 mm and 1.5 mm, and the vane's minimum thickness t2, which is the diameter of the circular-arc shaped vane's peripheral end portion, is 0.64 mm. According to the impeller 2 of the cross flow fan to be mounted in the air conditioning apparatus 10 of this invention, the vane's minimum thickness t2, which is the diameter of the circular-arc shaped vane's peripheral end portion, is between 0.2 mm and 0.5 mm. Thus, by making the thickness t2 of the vane's peripheral end portion at least thinner than that of the conventional case, the stagnation of the flow of suction air is reduced at the vane's peripheral end portion A2 as shown in FIG. 15, which allows to reduce the loss. As a result, the shaft power for operating the impeller 2 by the fan motor 5 is reduced, which allows to reduce the power consumption of the fan motor 5 as shown in FIG. 16. FIG. 16 is a diagram illustrating the relationship between the vane's minimum thickness t2 and the motor power consumption Wm[W].

Figure 17:
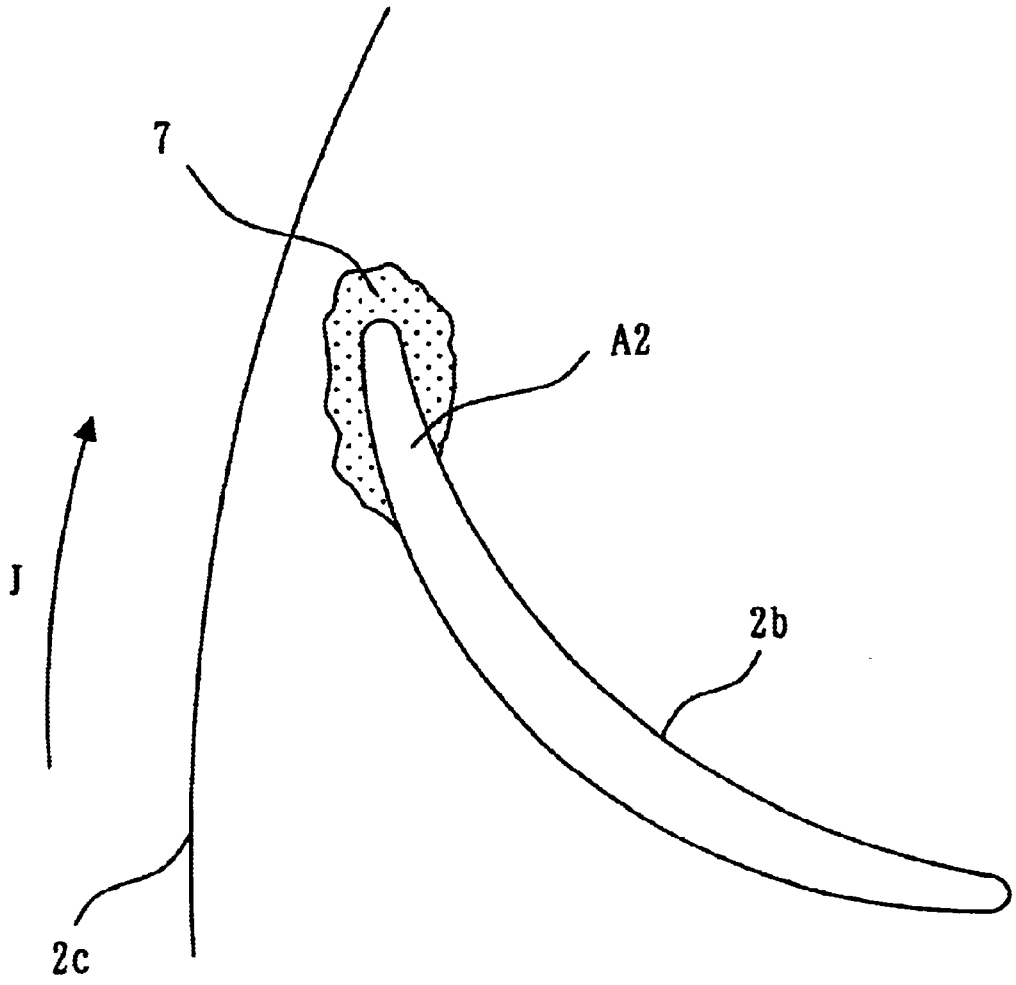
FIG. 17 is a diagram illustrating a state in which minute pieces of dust, being left unremoved through a filter, are accumulated on the tip A20 of the vane's peripheral end portion of the impeller 2 according to the air conditioning apparatus of this invention.
Figure 18:
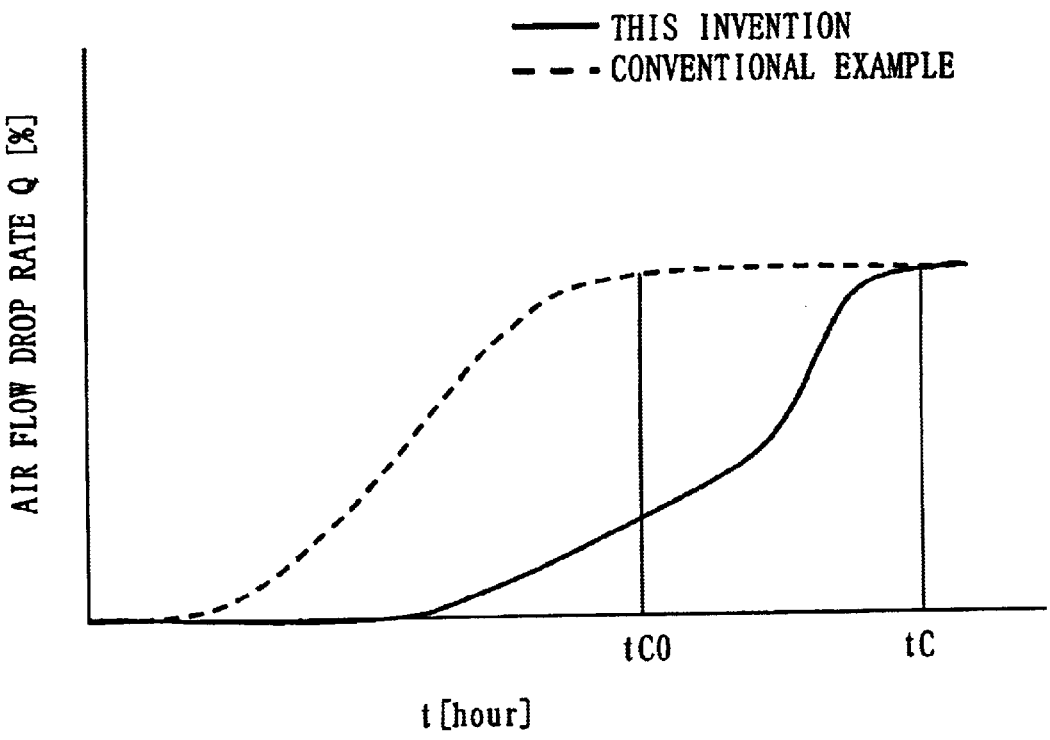
FIG. 18 is a diagram illustrating the operating time and the air flow drop rate at the same rotational frequency of each case of the conventional cross flow fan and the cross flow fan of the air conditioning apparatus of this invention.

Furthermore, if the air conditioning apparatus 10 operates for a long time so that the impeller 2 is rotated and operated for a long time, minute dust which has left unremoved by the filter 12 is accumulated on the vane's peripheral end portion A2 of the impeller 2 as shown in FIG. 17. Consequently, the distance between vanes δ is reduced, and the flow rate Q[$m^3$/min] in the same fan rotational frequency is decreased as the operating time passes. FIG. 18 is a diagram illustrating the operating time and the air flow drop rate ΔQ in the same rotational frequency in the case of the conventional cross flow fan and in the case of the cross flow fan of this invention. As shown in FIG. 18, by making the thickness t2 of the vane's peripheral end portion of the impeller thinner than that of the conventional case, the air flow drop rate in the same operating time may be minimized. As a result, such a problem may be solved that although the air conditioning apparatus has been operating for quite a long time, it does not still get warm enough when heating, and it does not still get cool enough when cooling. In addition to that, a cleaning cycle tc[hour] may become longer than the cleaning cycle tc0[hour] of the conventional case. Consequently, the frequency of cleaning may be reduced.

Thus, by forming the vane as described above in this invention, an energy-saving and highly reliable air conditioning apparatus having low power consumption may be obtained.

Embodiment 5

Figure 19:
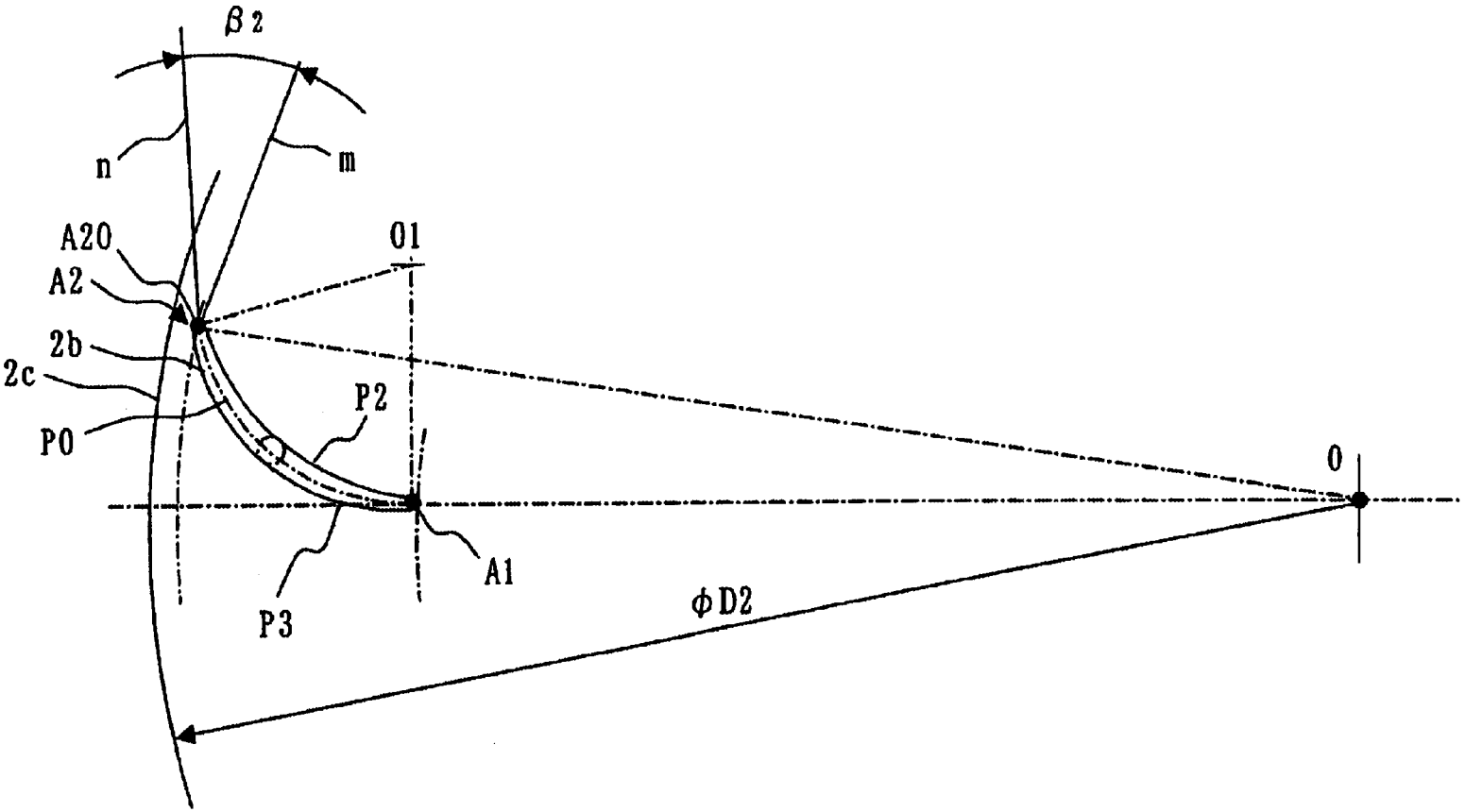
FIG. 19 is a diagram illustrating a basic form of the shape of a vane 2*b* of the impeller 2 of a cross flow fan to be used as an air blowing means for an air conditioning apparatus of a fifth embodiment of the present invention.
Figure 20:
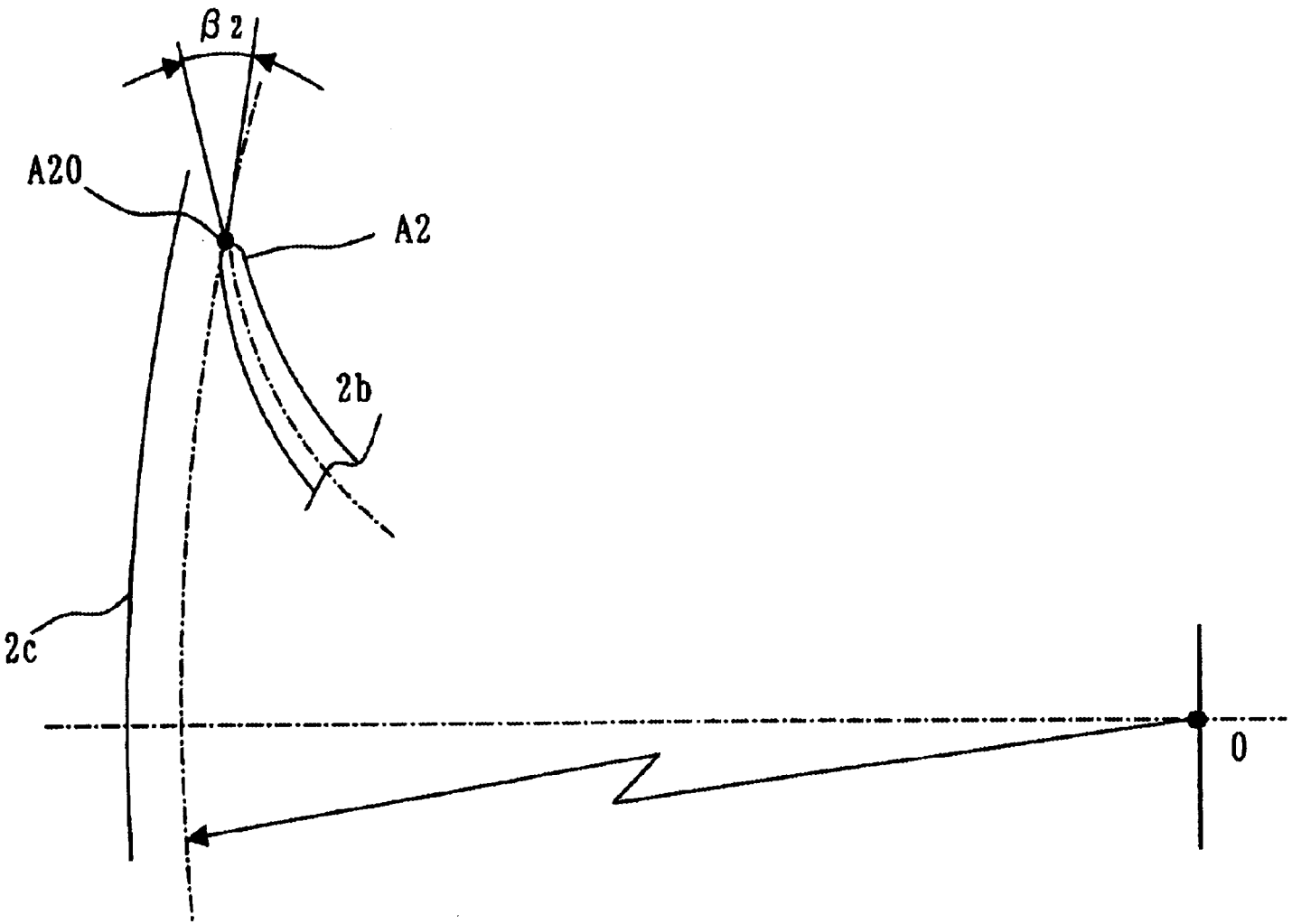
FIG. 20 is an enlarged view of a tip A20 of the vane's peripheral end portion obtained by changing the basic form of the shape of the tip A20 of the vane's peripheral end portion of FIG. 19.

FIG. 19 is a diagram illustrating a basic vane form of the shape of a vane 2*b* of the impeller 2 of a cross flow fan to be used as an air blowing means for an air conditioning apparatus according to a fifth embodiment of the present invention. FIG. 20 is an enlarged view of a vane's peripheral end portion A20 of the fifth embodiment which has a change in the shape of the vane's peripheral end portion A20 in the basic vane form of FIG. 19. It is to be noted that elements other than the vane 2*b* in this embodiment are the same as those of the air conditioning apparatus and the cross flow fan of FIG. 1 to FIG. 5 discussed above in the first embodiment, therefore the same reference numerals as those of the embodiment are assigned to the elements and the description will be omitted.

With referring to a cross-sectional shape of the vane 2*b* of FIG. 19, which is the basic vane form of the fifth embodiment, the reference numeral A20 denotes the tip of the vane's peripheral end portion A2 of the vane 2*b*. The reference numeral A10 denotes the tip of the vane's internal circumferential end portion A1 of the vane 2*b*. The reference mark O denotes the center of the rotating shaft of the impeller 2 of the cross flow fan, and the reference numeral O1 denotes the center of the camber line P0 formed into a single circular arc, the camber line being the center line of the vane 2*b* in the direction of the thickness. The reference numeral P2 denotes the pressure face of the vane 2*b* on a side facing the direction of impeller rotation, and the reference numeral P3 denotes the suction surface opposing to the pressure face P2. Further, O-A20 indicates the first straight line connecting the tip of the vane's peripheral end portion A20 of the vane 2*b* and the center O, and O1-A20 indicates the second straight line connecting the tip of the vane's peripheral end portion A20 of the vane 2*b* and the center O1 of the camber line P0. Further, the reference mark n denotes the first perpendicular of the first straight line O-A20 to the tip of the vane's peripheral end portion A20, the reference mark m denotes the second perpendicular line of the second straight line O1-A20 to the tip of the vane's peripheral end portion A20. The exit angle β2 is an acute angle formed by the first perpendicular and the second perpendicular.

According to this invention, the vane 2*b* is formed into a sharp edge at the vane's peripheral end portion A2. This shape is obtained by excising the vane 2*b* of FIG. 19 along a circle passing through the tip A20 of the vane's peripheral end portion, the center of the circle being the center O of the rotating shaft of the impeller 2 as shown in FIG. 20.

Figure 21:
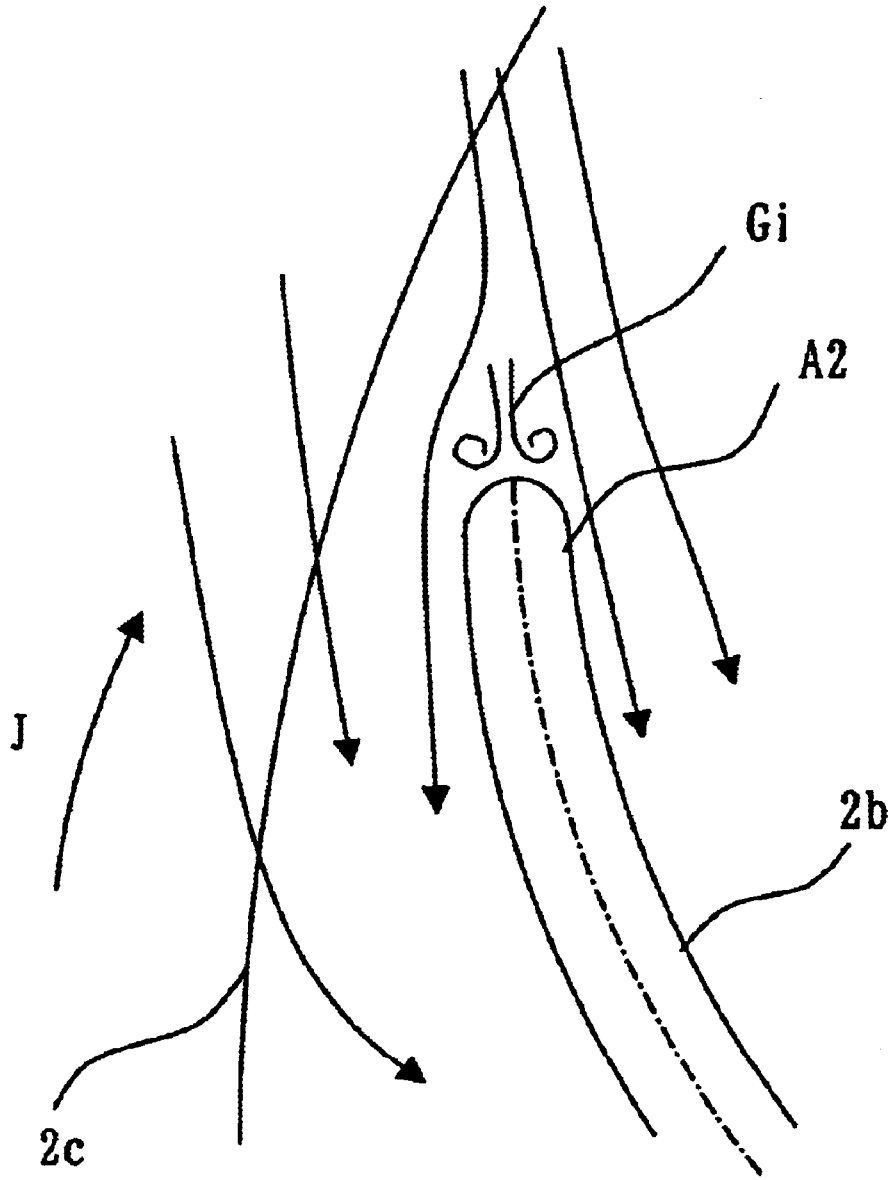
FIG. 21 is a diagram illustrating a state of air flow at the circular-arc shaped vane's peripheral end portion A20 of a conventional vane 2*b* according to the air conditioning apparatus of this invention.
Figure 22:
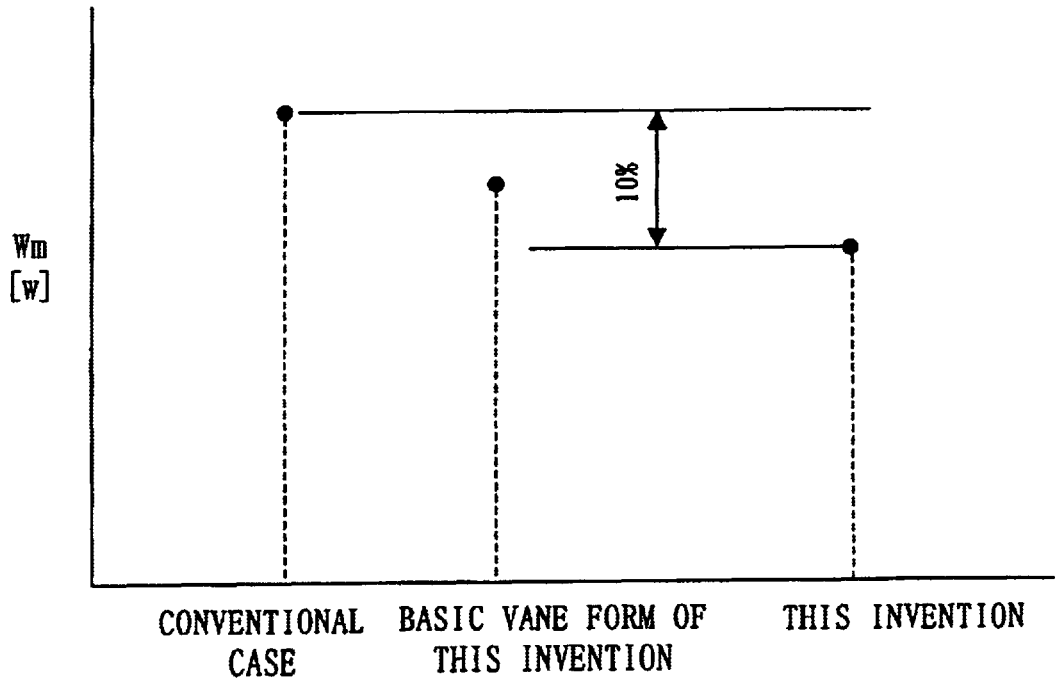
FIG. 22 is a diagram illustrating the power consumption Wm[W] of the fan motor 5 for operating an impeller of a cross flow fan in each case of the conventional cross flow fan and the cross flow fan of the air conditioning apparatus of this invention in comparison.

Thus, by forming the vane 2*b* as described above in this invention, such stagnation of air flow caused at the tip A20 of the vane's peripheral end portion as that shown in a state of air flow at the circular-arc shaped vane's peripheral end portion A2 of the conventional vane 2*b* of FIG. 21 is reduced, and the loss is reduced. For that reason, the shaft power for operating the impeller 2 is more reduced. As a result, the power consumption of the motor may be minimized as shown in a diagram illustrating the power consumption Wm[W] of the fan motor 5 for operating the impeller of the cross flow fan in each case of the conventional example and this invention for comparison. Consequently, a highly energy-saving air conditioning apparatus may be obtained with the power consumption being reduced.

Embodiment 6

Figure 23:
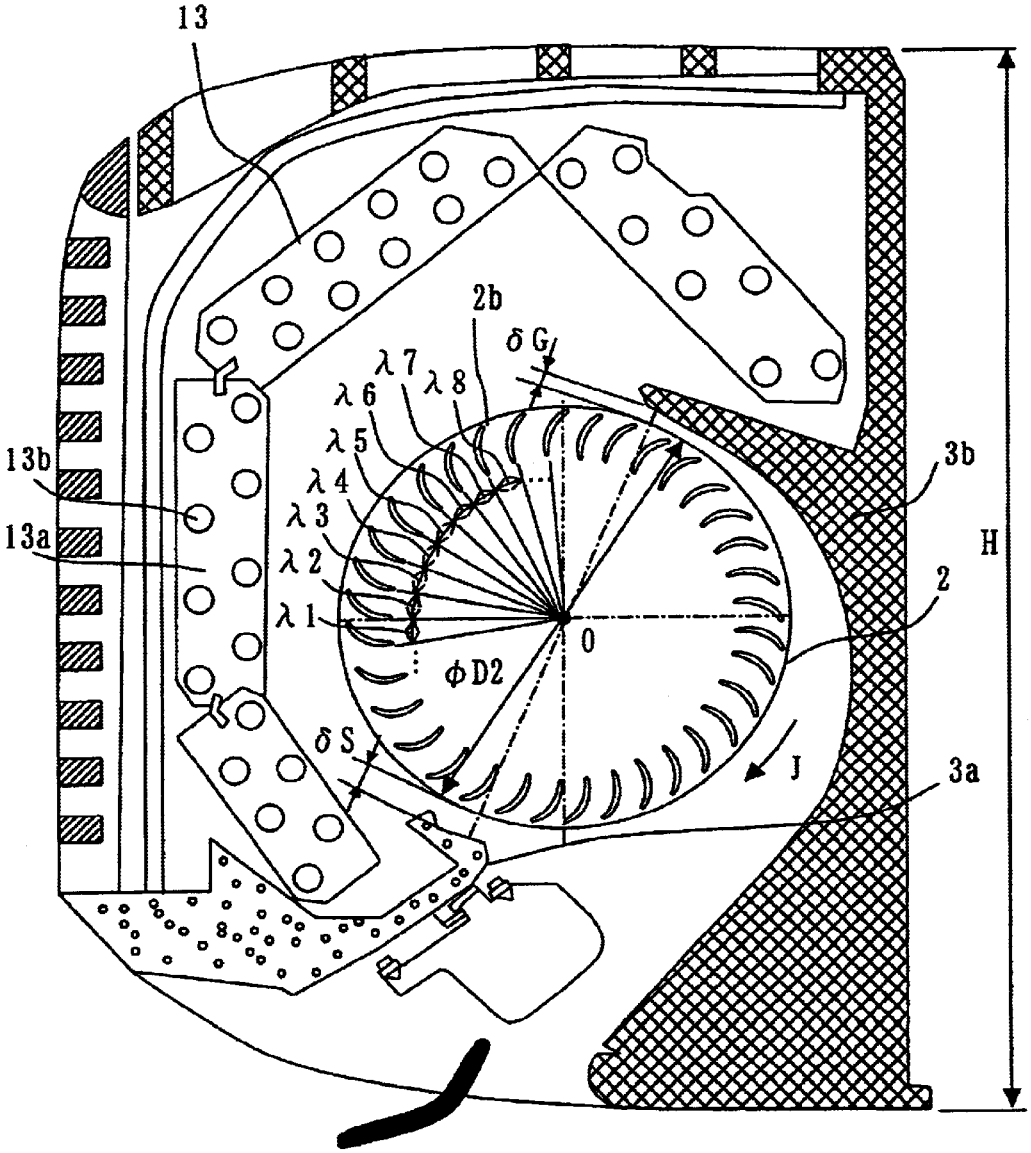
FIG. 23 is a longitudinal cross-sectional view of an impeller 2 of a cross flow fan to be used as an air blowing means for an air conditioning apparatus of a sixth embodiment of the present invention.

FIG. 23 is a longitudinal cross-sectional view of an air conditioning apparatus 10 and the impeller 2 of a cross flow fan of this invention. The ratio H/ϕD2 of the height H of the main body of the air conditioning apparatus to the outside diameter ϕD2 of the impeller is 2.2 or above and 3.0 or below. Spaces λ between the vanes 2*b* of the impeller 2 are irregular in pitch (λ1, λ2, λ3, . . . ). The cross-sectional shape of the vane 2*b* of the impeller 2 of the cross flow fan of FIG. 23 is the shape discussed in the third embodiment, for example. It is to be noted that elements other than the impeller 2 of the cross flow fan of this embodiment are the same as those of the air conditioning apparatus and the cross flow fan of FIG. 1 to FIG. 5 discussed above in the first embodiment, therefore the same reference numerals as those of the embodiment are assigned to the elements and the description will be omitted.

Figure 24:
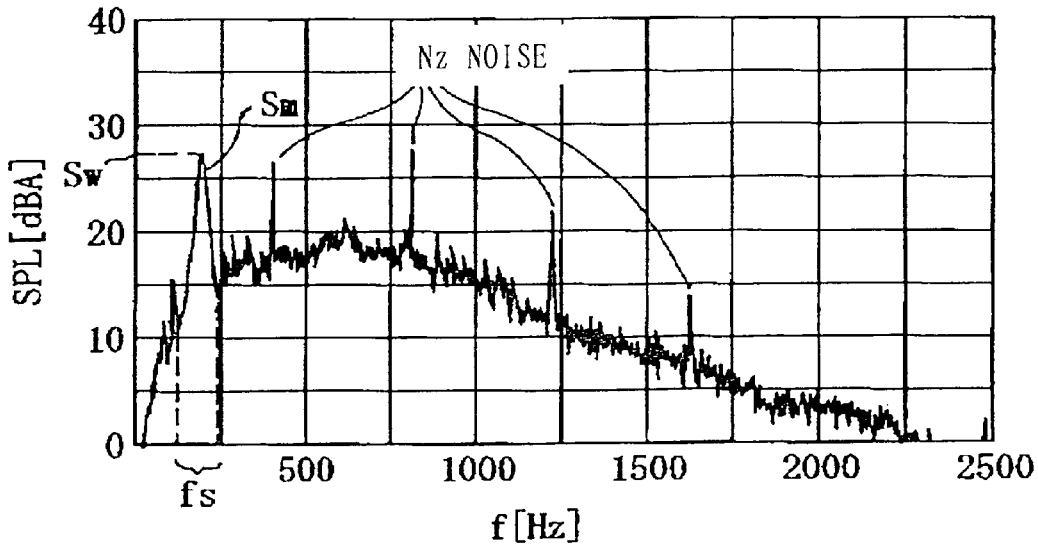
FIG. 24 is a diagram illustrating the frequency characteristic of noise of an air conditioning apparatus in which a conventional cross flow fan is mounted according to the air conditioning apparatus of this invention.

FIG. 24 is a diagram illustrating the frequency characteristic of noise of an air conditioning apparatus in which the conventional cross flow fan is mounted. For example, in a case where the singular noise Sm is generated in the impeller 2 of the conventional cross flow fan, the singular noise Sm is multiplexed, and the frequency characteristic is formed into a sharp pointed shape when the width of the generating frequency fs of the singular noise Sm is around 100[Hz]. This is because the spaces λ between vanes 2*b* and the next vanes 2*b* are regular, when the singular noise Sm is generated, the flow rate of air and the state of the detaching vortex are almost regular at the vane 2*b*.

However, according to the air conditioning apparatus in which the cross flow fan of this invention is mounted, as shown in FIG. 23, the spaces λ between the vanes 2*b* are irregular in pitch. Therefore, when the singular noise Sm is generated at each vane 2*b*, the flow rate of air and the state of a detaching vortex at the vane 2*b* differ from others. As a result, as shown in a diagram illustrating the frequency characteristic of noise of the air conditioning apparatus in which the cross flow fan of this invention is mounted of FIG. 25, the singular noise Sm is dispersed. The width of the generating frequency fs of the singular noise Sm becomes broadband. Furthermore, the generating level Sw[dBA] of the singular noise Sm is lowered, and then the singular noise disappears from the diagram of the frequency characteristic, and cannot be heard in the end.

Figure 26:
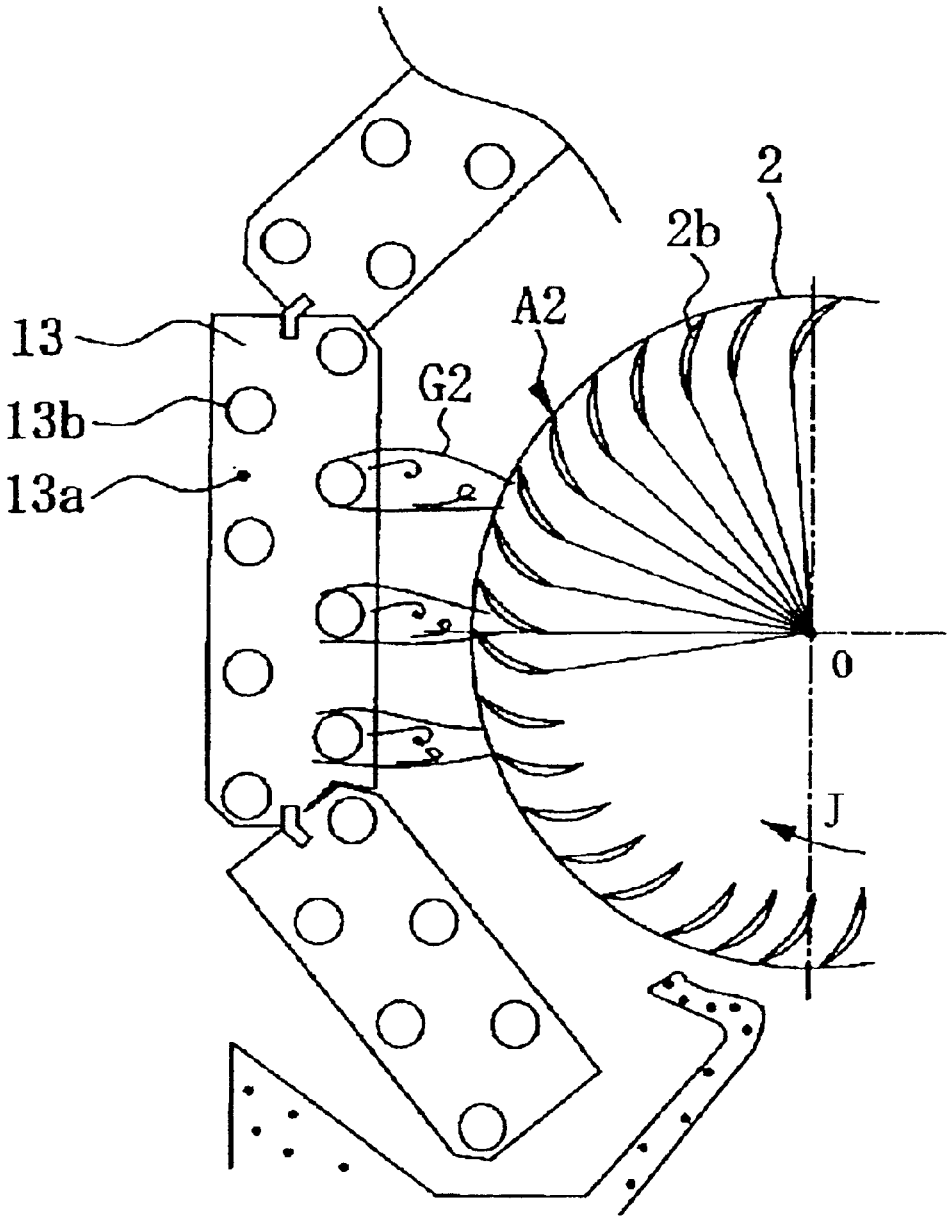
FIG. 26 is a diagram illustrating a state in which a trailing vortex G2 of a pipe 13*a* is directly sucked into the impeller 2, when pipes 13*b* of a heat exchanger 13 are close to the impeller 2, according to the air conditioning apparatus of this invention.

Furthermore, as shown in FIG. 26, in a case where the pipes 13*b* of the heat exchanger 13 are closely disposed to the impeller 2, the trailing vortexes G2 of the pipes 13*a* are directly sucked into the impeller 2. In that case, rotational noise (NZ sound) is also generated by an instantaneous pressure fluctuation caused at the vane's peripheral end portion A2 of the vane 2*b*.

Figure 25:
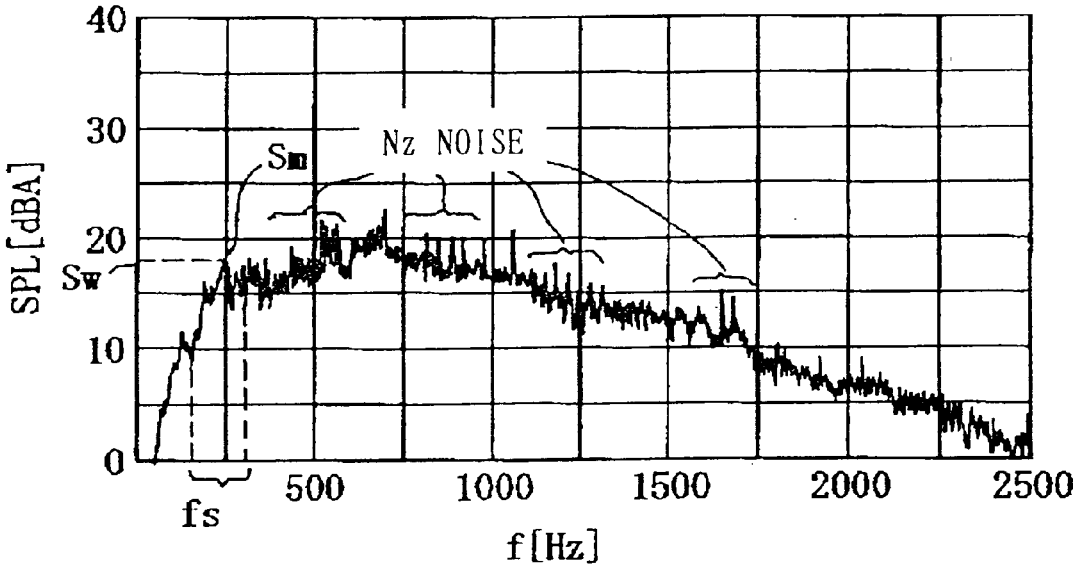
FIG. 25 is a diagram illustrating the frequency characteristic of noise of the air conditioning apparatus in which the cross flow fan of this invention is mounted.

In such a case, as shown in the diagrams of FIG. 24 and FIG. 25 illustrating the frequency characteristic of the air conditioning apparatus of the conventional example and that of this embodiment, respectively, in the case of the impeller 2 of the conventional cross flow fan, because an instantaneous lift fluctuation at the vane's peripheral end portion A2 is the same at each vane 2*b*, the rotational noise is multiplexed, therefore a peak level becomes high in a narrow band. However, if the space λ between the vanes 2*b* is irregular in pitch, then the instantaneous lift fluctuation at the vane's peripheral end portion A2 is dispersed. As a result, the generating frequency of the rotational noise is dispersed and not multiplexed. Consequently, the peak level becomes low.

Figure 27:
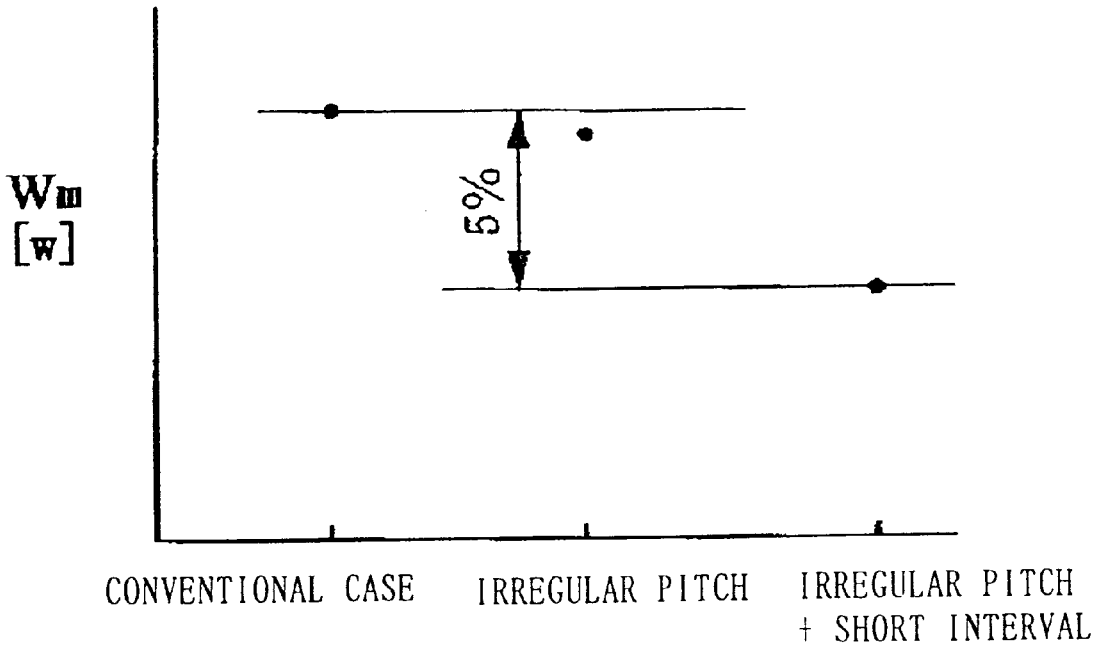
FIG. 27 is a diagram illustrating the relationship in the power consumption of the fan motor for operating a cross flow fan at the same flow rate between the conventional cross flow fan and the inventive cross flow fan according to the air conditioning apparatus of this invention.

With further reference to the conventional cross flow fan in which the vanes 2*b* are fitted at regular intervals, if gaps δs and δG between the impeller 2 and the closest point of the stabilizer 3*a* to the impeller and the closest point of the guide wall 3*b* to the impeller, respectively, are small, then the rotational noise (NZ sound) is generated by the instantaneous pressure fluctuation in those gaps. However, by fitting the vanes 2*b* in the irregular pitch according to this embodiment, the instantaneous lift fluctuation at the vane's peripheral end portion A2 is dispersed. As a result, the generating frequency of the rotational noise is dispersed and not multiplexed, so that the peak level becomes low. For that reason, the gaps δs and δG can be minimized until the peak level becomes the same as that of the conventional case, so that the static air pressure of the impeller 2 may be raised. As a result, a fan rotational frequency N[r.p.m] at the same flow rate Q[$m^3$/min] maybe lowered. Consequently, the power consumption may be reduced as shown in a diagram illustrating the relationship in the power consumption Wm[W] of the fan motor at the same flow rate Q[$m^3$/min] of FIG. 27.

Thus, by forming the impeller of the cross flow fan as discussed above in this embodiment, the singular noise and the rotational noise may become low, and in addition, the power consumption of the fan motor may be reduced. Consequently, an energy-saving as well as silent air conditioning apparatus which provides a favorable atmosphere to the ear may be obtained.

Embodiment 7

Figure 28:
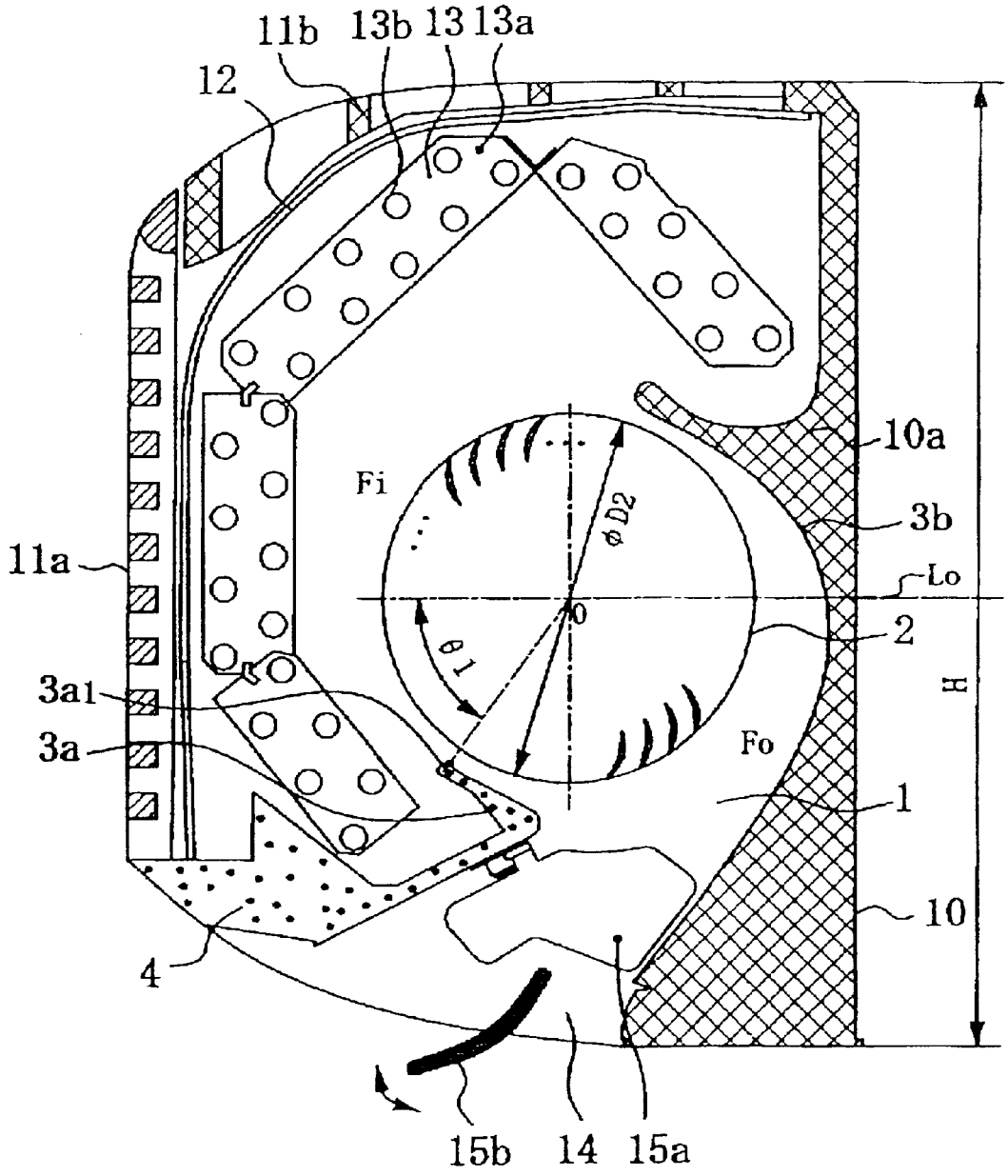
FIG. 28 is a longitudinal cross-sectional view of an air conditioning apparatus according to a seventh embodiment of the present invention.

FIG. 28 is a longitudinal cross-sectional view of an air conditioning apparatus according to a seventh embodiment of this invention. It is to be noted that the main part of the configuration of the air conditioning apparatus of this embodiment is the same as that discussed with reference to FIG. 1 to FIG. 5 in the first embodiment.

With referring to FIG. 28, the reference numeral 10 denotes the main body of the air conditioning apparatus of this invention the height of which is H. The reference numeral 101*a* denotes the housing. The reference numeral 11*a* denotes the front air inlet grille and the reference numeral 11*b* denotes the upper air inlet grille. The reference numeral 12 denotes the filter for removing dust. The reference numeral 13 denotes the heat exchanger, the reference numeral 13*a* denotes the aluminum fin and the reference numeral 13*b* denotes the pipe. The reference 14 denotes the air outlet. The reference numeral 15 denotes the blowing-direction changing vane, the reference numeral 15*a* denotes the left/right vane and the reference numeral 15*b* denotes the up/down vane. The reference numeral 1 denotes the cross flow fan. The reference numeral 2 denotes the impeller of the cross flow fan. The reference numeral 3*a* denotes the stabilizer. The reference numeral 3*b* denotes the guide wall. The reference numeral 4 denotes the nozzle.

The outside of the main body of the thus configured air conditioning apparatus 10 is formed by the housing 10*a* and the detachable front air inlet grille 11*a*. Further, the housing 10*a* is formed by the upper air inlet grille 11*b*, the guide wall 3*b* near the back, and the nozzle 4 at the lower front portion. The air outlet 14 is formed by the nozzle 4 and the guide wall 3*b*. Furthermore, the nozzle 4 is formed in such a manner as to incorporate the stabilizer 3.

Further, on the air inlet side of the cross flow fan 1, the front air inlet grille 11*a*, the upper air inlet grille 11*b* and the filter are disposed, and the heat exchanger 13 is also disposed.

It is to be noted that the ratio of the height H of the main body of the air conditioning apparatus to the outside diameter ϕD2 of the impeller 2 is 2.2 or above and 3.0 or below.

Referring now to the air conditioning apparatus thus configured, a straight line connecting the closest point $3a_1$, of the stabilizer 3*a* to the impeller 2 of the cross flow fan and the center O of the rotating shaft of the impeller is O-$3a_1$, and a horizontal line passing through the center O of the rotating shaft of the impeller is L0. In such a case, the stabilizer is formed in such a manner as to locate at a place where an acute angle θ1 formed by the two straight lines 0-$3a_1$ and L0 is between 30 degrees and 70 degrees from the horizontal line L0 as the base in the opposite direction to the rotation of the impeller.

Figure 29:
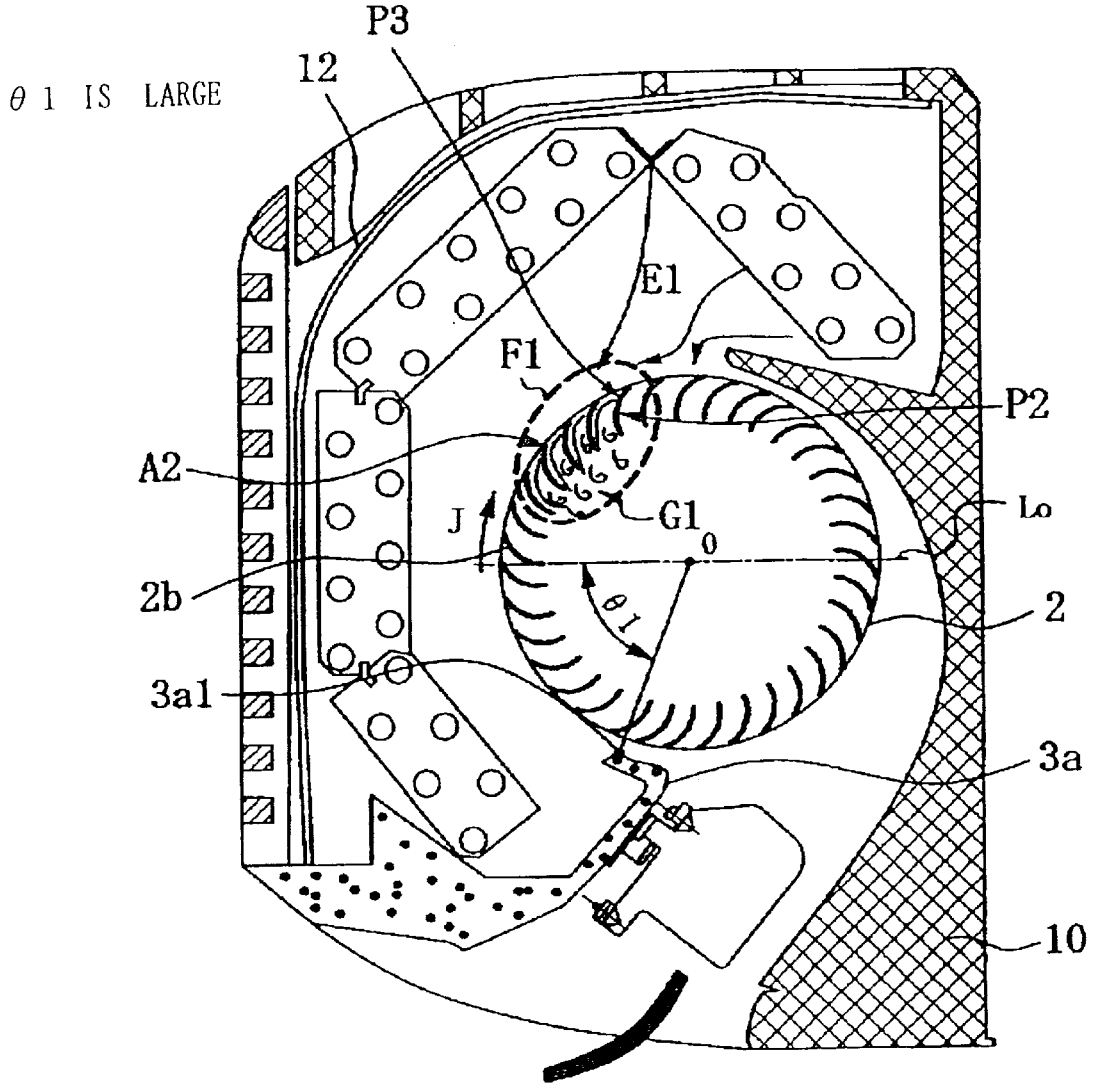
FIG. 29 is a schematic diagram of the air conditioning apparatus of this invention illustrating a case where an acute angle θ1 is more than 70 degrees, the acute angle θ1 being formed by a straight line 0-3$a_1$, which connects a closest point 3$a_1$ of a stabilizer to the impeller of the cross flow fan to the center 0 of the rotating shaft of the impeller, and a horizontal line L0, which passes through the center 0 of the rotating shaft of the impeller.
Figure 30:
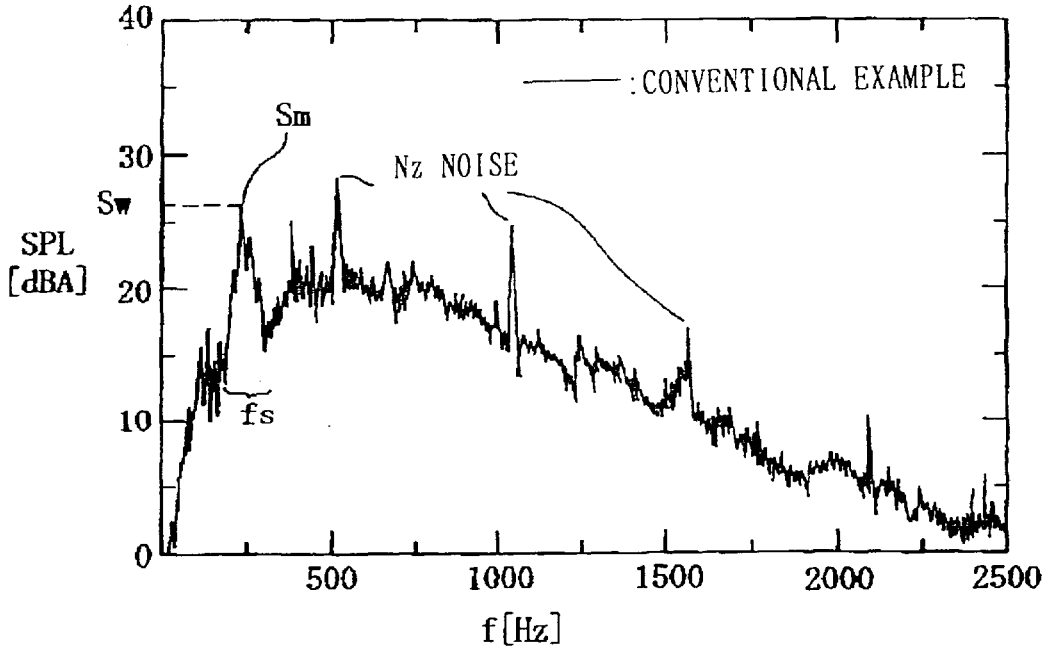
FIG. 30 is a diagram illustrating the frequency characteristic of noise of an air conditioning apparatus in which the conventional cross flow fan is mounted according to this invention.

FIG. 29 shows a conventional air conditioning apparatus in which the acute angle θ1 is more than 70 degrees, and the closest point $3a_1$ of the stabilizer to the impeller 2 of the cross flow fan is disposed at a lower portion of the air conditioning apparatus. In this case, a circulating vortex Cl moves downwards, so that an air inlet side area Fi is expanded. However, a suction air flow E1 flows into an area F1 located on the air inlet side of the impeller 2 and also in an upper front portion of the main body of the air conditioning apparatus 10. For that reason, when the vane 2*b* passes through the area F1, air may easily detach at the vane's peripheral end portion A2 of the vane 2*b*. For that reason, if the ventilating resistance is increased due to such as dust accumulated on the filter 12, in particular, a detaching vortex G1 is generated in the vicinity of the suction surface P3 of the vane. In addition to that, the flow rate in the vicinity of the pressure face P2 of the following vane 2*b* is increased. As a result, as shown in FIG. 30, the singular noise Sm having a broad frequency band is generated in a low frequency range.

Figure 31:
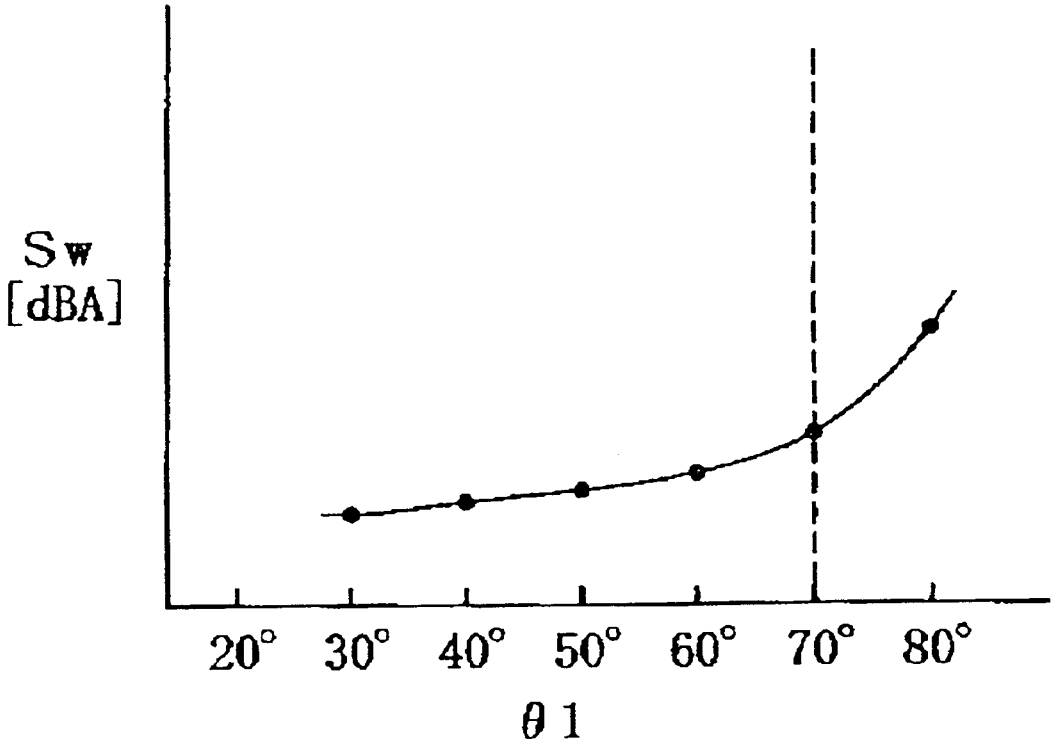
FIG. 31 is a diagram illustrating a change in the singular noise level Sw when the acute angle θ1 is varied according to the air conditioning apparatus of this invention.

In a diagram illustrating a change in the singular noise level Sw[dBA] in relation to the θ1 of FIG. 31, if θ1 is at least 70 degrees or less, there will be no problem with the singular noise Sm.

Figure 32:
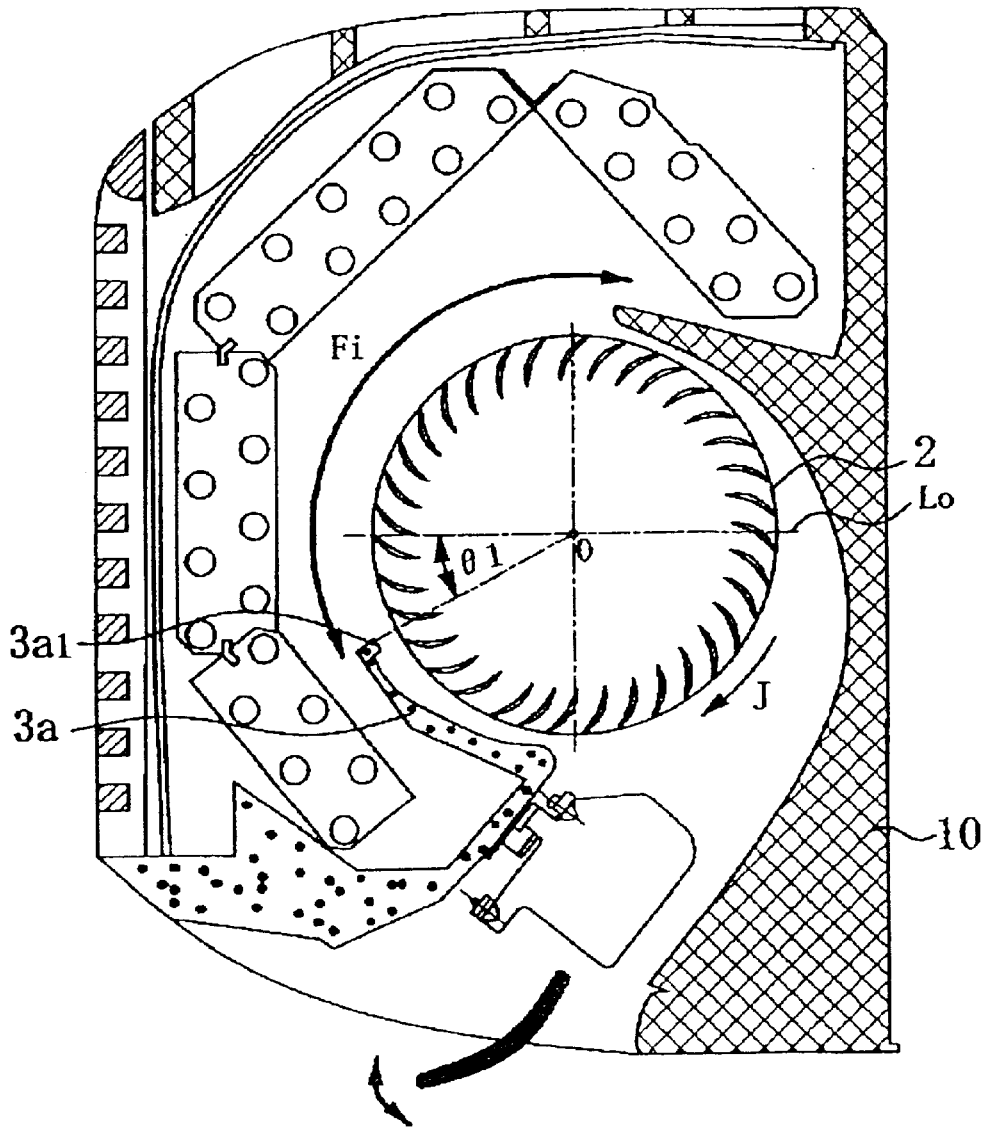
FIG. 32 is a schematic diagram of the air conditioning apparatus of this invention illustrating a case where the acute angle θ1 is small.
Figure 33:
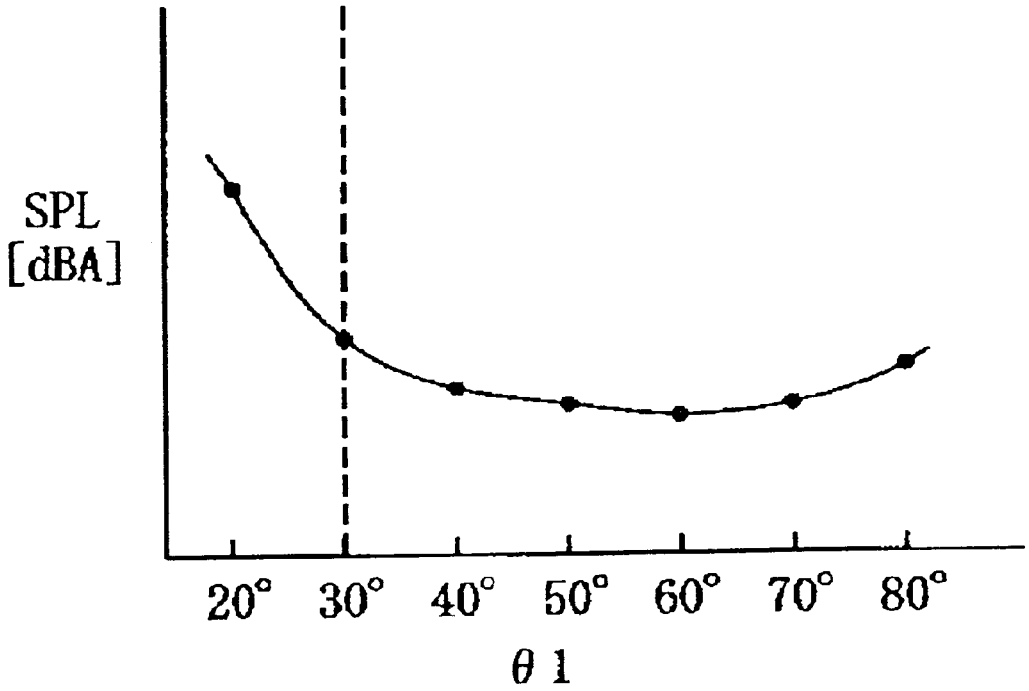
FIG. 33 is a diagram illustrating the relationship between the acute angle θ1 and the noise level, the acute angle θ1 being formed by the straight line 0-3$a_1$ which connects the closest point 3$a_1$ of the stabilizer to the impeller of the cross flow fan to the center 0 of the rotation shaft of the impeller and the horizontal line L which passes through the center 0 of the rotating shaft of the impeller.

Further, as shown in FIG. 32, in a case where the acute angle θ1 is 30 degrees or less, the singular noise Sm is reduced, but the air inlet side area Fi is too narrow, therefore the flow rate of suction air is increased. As a result, as shown in FIG. 33, the noise level SPL[dBA] at the same flow rate is increased rapidly.

According to FIG. 31 and FIG. 33, when a straight line connecting the closest point $3a_1$ of the stabilizer 3*a* to the impeller 2 of the cross flow fan and the center O of the rotating shaft of the impeller is O-$3a_1$, and a horizontal line passing through the center O of the rotating shaft of the impeller is L0, if the acute angle θ1 formed by the two straight lines O-$3a_1$ and L0 is 30 degrees or above and 70 degrees or below, the singular noise becomes low noise and the noise level is low.

Thus, by forming the stabilizer 3*a* as discussed above, a low-noise air conditioning apparatus which provides a favorable atmosphere to the ear without generating the singular noise.

Embodiment 8

Figure 34:
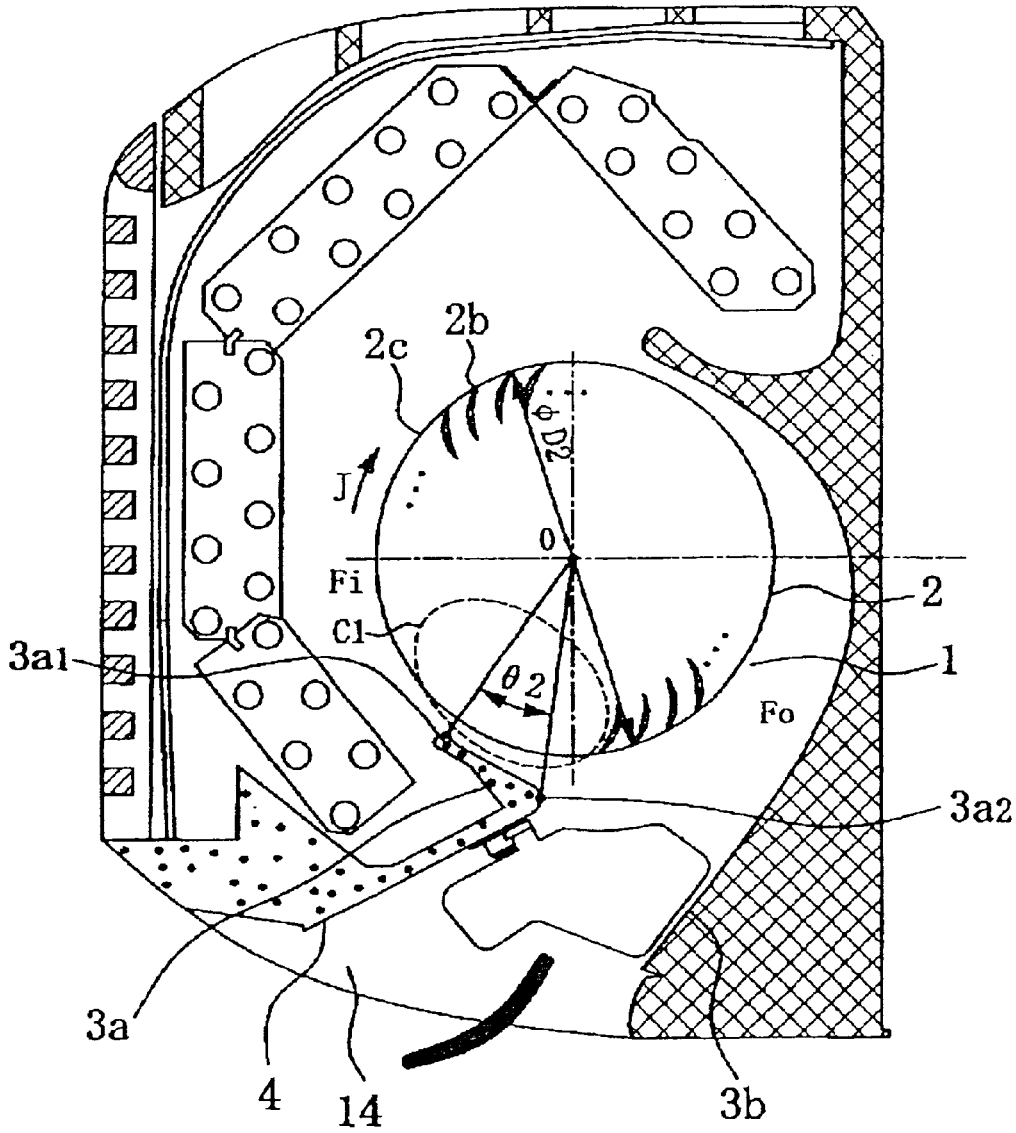
FIG. 34 is a longitudinal cross-sectional view of an air conditioning apparatus according to an eighth embodiment of the present invention.

FIG. 34 is a longitudinal cross-sectional view of an air conditioning apparatus according to an eighth embodiment. It is to be noted that the main part of the configuration of the air conditioning apparatus of this embodiment is the same as that of the air conditioning apparatus and the cross flow fan discussed above with reference to FIG. 28 in the seventh embodiment, therefore the same reference numerals as those of the embodiment are assigned to elements and the description will be omitted.

It is further to be noted that the ratio of the height H of the main body of the air conditioning apparatus to the outside diameter θϕD2 of the impeller 2 is 2.2 or above and 3.0 or below in this embodiment.

With referring to the cross flow fan 1 of the air conditioning apparatus 10 of FIG. 34, the reference numeral 2*b* denotes a vane of the impeller 2, and the reference numeral 2*c* denotes a ring of the impeller 2. The cross flow fan 1 is formed by the impeller 2, the outside diameter of which is ϕD2 , the guide wall 3*b* which surrounds the impeller 2 in such a manner as to cover one portion of the peripheral surface of the impeller 2 so that the flow of air blown off from the impeller 2 is guided to the air outlet 14, and the stabilizer 3*a* which is placed in such a manner as to face the guide wall 3*b* for controlling the position of the circulating vortex C1 generated inside the impeller 2 of the cross flow fan. The impeller 2 rotates and operates about the center O of the rotating shaft in the direction of arrow J.

Further, the stabilizer is formed in such a manner that an acute angle θ2 formed by the two straight lines 0-$3a_1$ and O-$3a_2$ is between 15 degrees and 40 degrees, where the straight line O-$3a_1$ connects the center O of the rotating shaft of the impeller 2 of the cross flow fan and the closest point $3a_1$ of the stabilizer to the impeller of the cross flow fan and the straight line O-$3a_2$ connects the center O of the rotating shaft of the impeller 2 of the cross flow fan and a lower end $3a_2$ of the stabilizer.

Figure 35:
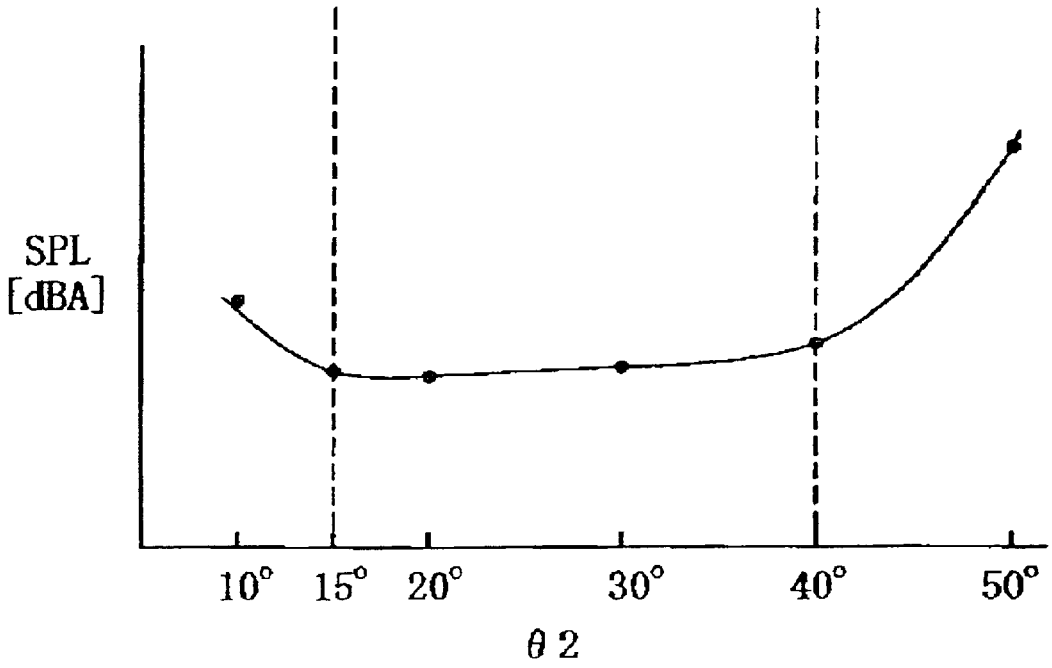
FIG. 35 is a diagram illustrating the relationship between an acute angle θ2 and the noise level, the acute angle θ2 being formed by two straight lines 0-3$a_1$ and 0-3$a_2$ connecting a closest point 3$a_1$ of a stabilizer 3*a* to an impeller and a lower portion 3$a_2$ of the stabilizer, respectively, according to the air conditioning apparatus of this invention.

Thus, by forming the stabilizer 3*a* as discussed above, the movement of the circulating vortex C1 which is generated inside the impeller 2 of the cross flow fan may be kept stable if the ventilating resistance in the air inlet side area Fi is increased due to such as dust accumulated on the filter 12. If the acute angle θ2 is too small, then the stabilizer 3*a* cannot control the movement of the circulating vortex C1 when the ventilating resistance in the air inlet side area F1 is increased. As a result, the flow of blown air becomes unstable. For that reason, humid room air flows towards the refrigerated air outlet 14, and dew is condensed on the surfaces of the nozzle 4 and the guide wall 3*b* at the air outlet 14 when cooling. Furthermore, when the air moves backward from an air outlet side area Fo to the air inlet side area Fi, if θ2 is too small, then the air pressure at the stabilizer 3*a* rapidly fluctuates, so that the noise level is increased as shown in FIG. 35. Besides, if the acute angle θ2 is too large, then the areas Fi and Fo on the air inlet side and the air outlet side, respectively, become narrow, so that the ventilating resistance is increased. For that reason, the ventilating characteristic becomes worse and the noise aggravates at the same flow rate. In addition to that, the power consumption Wm[W] of the fan motor is increased as shown in FIG. 36.

Figure 36:
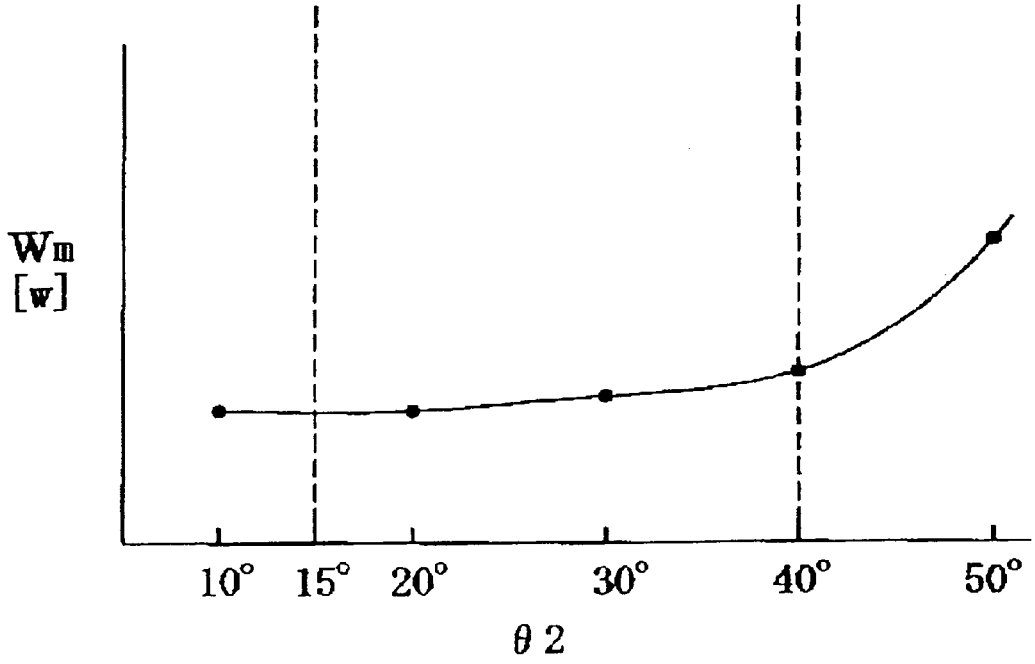
FIG. 36 is a diagram illustrating the relationship between the acute angle θ2 and the power consumption Wm[W] of the fan motor according to the air conditioning apparatus of this invention.

As shown in FIG. 35 and FIG. 36, if the stabilizer is formed in such a manner that the acute angle θ2 is at least between 15 degrees and 40 degrees, then no dew will be condensed when cooling if such as dust is accumulated on the filter. In addition to that, a change in the noise level will become small, and the power consumption of the fan motor 5 will be reduced. For that reason, a highly reliable and energy-saving air conditioning apparatus may be obtained.

Embodiment 9

Figure 37:
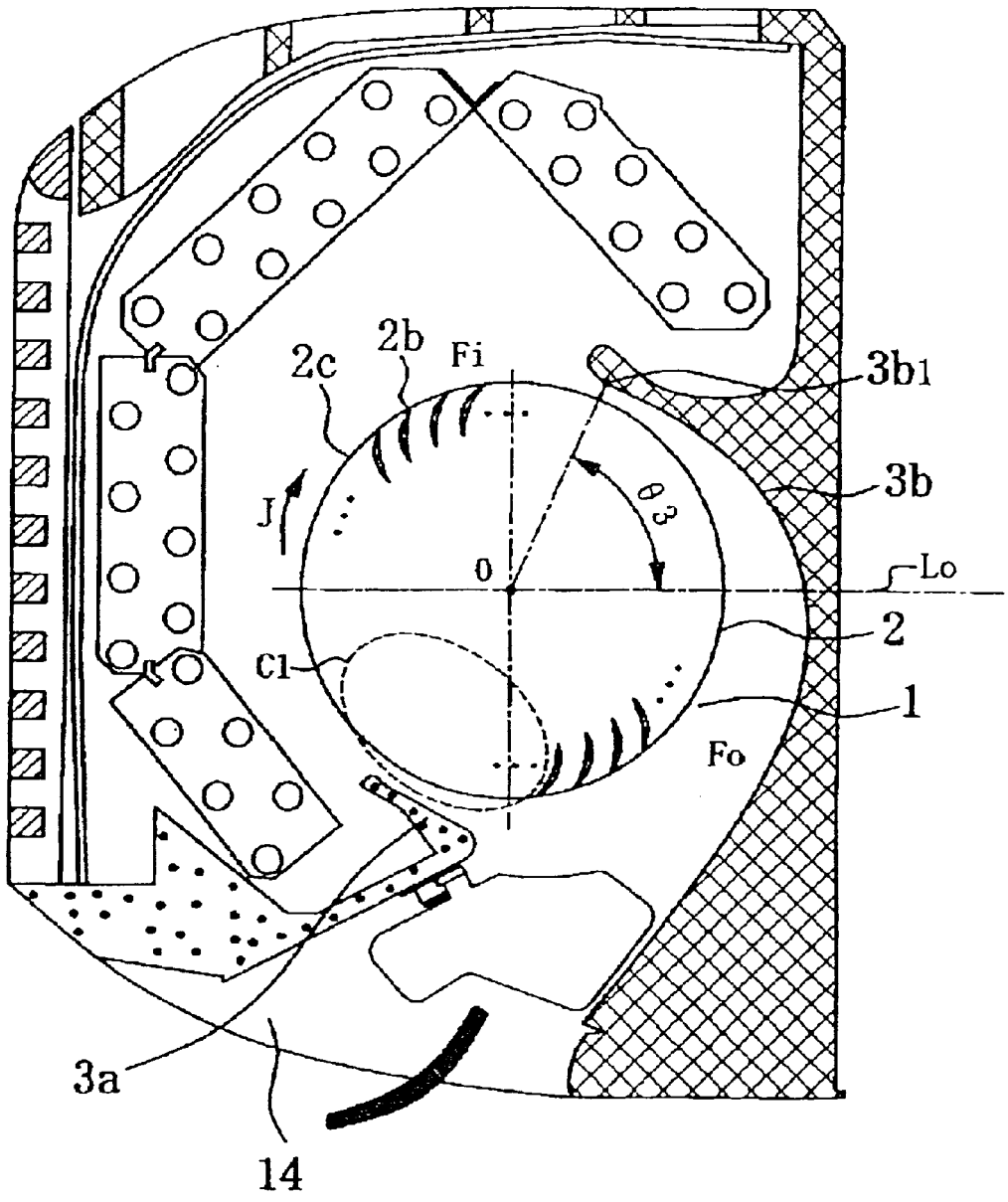
FIG. 37 is a longitudinal cross-sectional view of an air conditioning apparatus according to a ninth embodiment of the present invention.

FIG. 37 is a longitudinal cross-sectional view of an air conditioning apparatus according to a ninth embodiment. It is to be noted that elements other than the cross flow fan 1 of the air conditioning apparatus of this embodiment are the same as those of the air conditioning apparatus and the cross flow fan of FIG. 1 to FIG. 5 discussed above in the eighth embodiment, therefore the same reference numerals as those of the embodiment are assigned to the elements and the description will be omitted.

With referring to the cross flow fan 1 of the air conditioning apparatus of FIG. 37, the reference numeral 2*b* denotes a vane of the impeller 2 and the reference numeral 2*c* is a ring of the impeller 2. The cross flow fan 1 is formed by the impeller 2, the outside diameter of which is ϕD2 , which is formed by a plurality of units 2*a* being connected in the direction of the shaft, each unit being formed by a plurality of vanes 2*b* and the ring 2*c* for supporting the plurality of vanes, the guide wall 3*b* which surrounds the impeller 2 in such a manner as to cover one portion of the peripheral surface of the impeller 2 so that the flow of air blown off from the impeller 2 is guided to the air outlet 14, and the stabilizer 3*a* which is placed in such a manner as to face the guide wall 3*b* for controlling the position of the circulating vortex C1 generated inside the impeller 2 of the cross flow fan. The impeller 2 rotates and operates around the center O of the rotating shaft in the direction of arrow J.

It is to be noted that the ratio of the height H of the main body of the air conditioning apparatus to the outside diameter ϕD2 of the impeller 2 is 2.2 or above and 3.0 or below.

Further, a closest point $3b_1$ of the guide wall 3*b* to the impeller 2 of the cross flow fan is disposed at an upper rear portion of the air conditioning apparatus. In addition to that, the guide wall 3*b* is formed in such a manner that an angle θ3 formed by a straight line O-$3b_1$, which connects the closest point $3b_1$ of the guide wall 3*b* to the impeller and the center O of the rotating shaft of the impeller, and a horizontal line L0, which passes through the center O of the rotating shaft of the impeller, is between 35 degrees to 80 degrees.

At the closest point $3b_1$ of the guide wall 3*b* to the impeller 2, the air inlet side area Fi and the air outlet side area Fo are separated in the cross flow fan.

Figure 38:
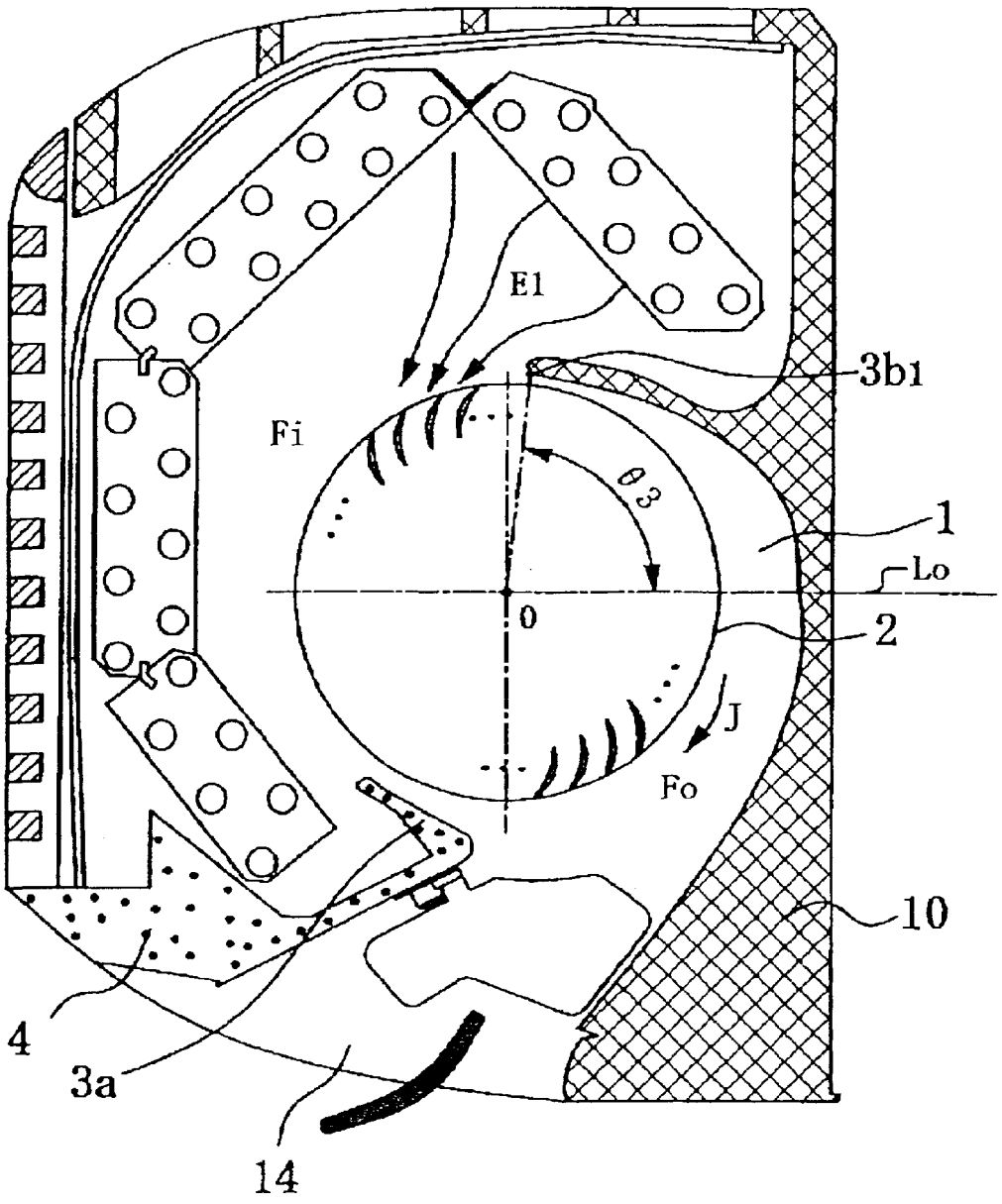
FIG. 38 is a schematic diagram of the air conditioning apparatus of this invention illustrating a case where an angle θ3 is small, the angle θ3 being formed by a straight line 0-3$b_1$ and a horizontal line L0, the straight line 0-3$b_1$ connecting a closest point 3$b_1$ of a guide wall 3*b* to the impeller to the center 0 of the rotating shaft of the impeller and the horizontal line L0 passing through the center 0 of the rotating shaft of the impeller.
Figure 39:
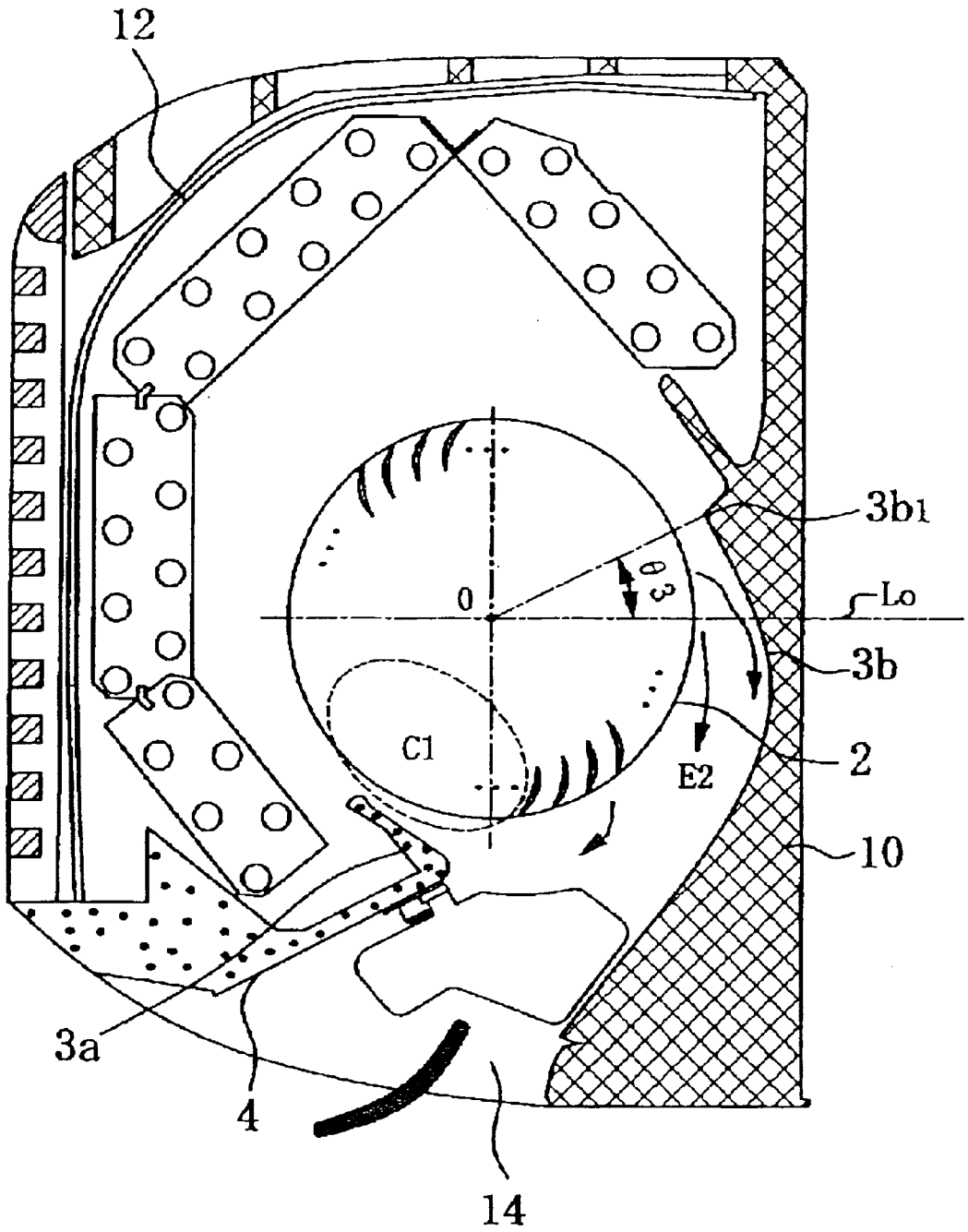
FIG. 39 is a schematic diagram of the air conditioning apparatus of this invention illustrating a case where the angle θ3 is large.

For that reason, if the angle θ3 is too large, then the guide wall 3*b* is extended forward to a front portion of the air conditioning apparatus 10 as shown in FIG. 38, so that the air inlet side area Fi of the impeller becomes narrow. Because the area on the air inlet side becomes narrow, the ventilating resistance becomes high. For that reason, the ventilating characteristic becomes worse, the noise level is aggravated, and the power consumption Wm of the fan motor 5 is increased. In addition to that, the flow rate of the air flow E1 from the back side of the air conditioning apparatus is increased, and the singular noise Sm is easily generated. On the other hand, if the angle θ3 is too small, then the guide wall 3*b* becomes shorter as shown in FIG. 39. For that reason, a flow E2 of blown-off air from the impeller 2 cannot recover its static air pressure sufficiently at the guide wall 3*b*, and becomes unstable. As a result, if the ventilating resistance becomes high due to such as dust accumulated on the filter 12, dew is condensed when cooling at the nozzle 4 of the air outlet 14 and in the vicinity of the guide wall 3*b*. In addition to that, the noise level will become high.

Figure 40:
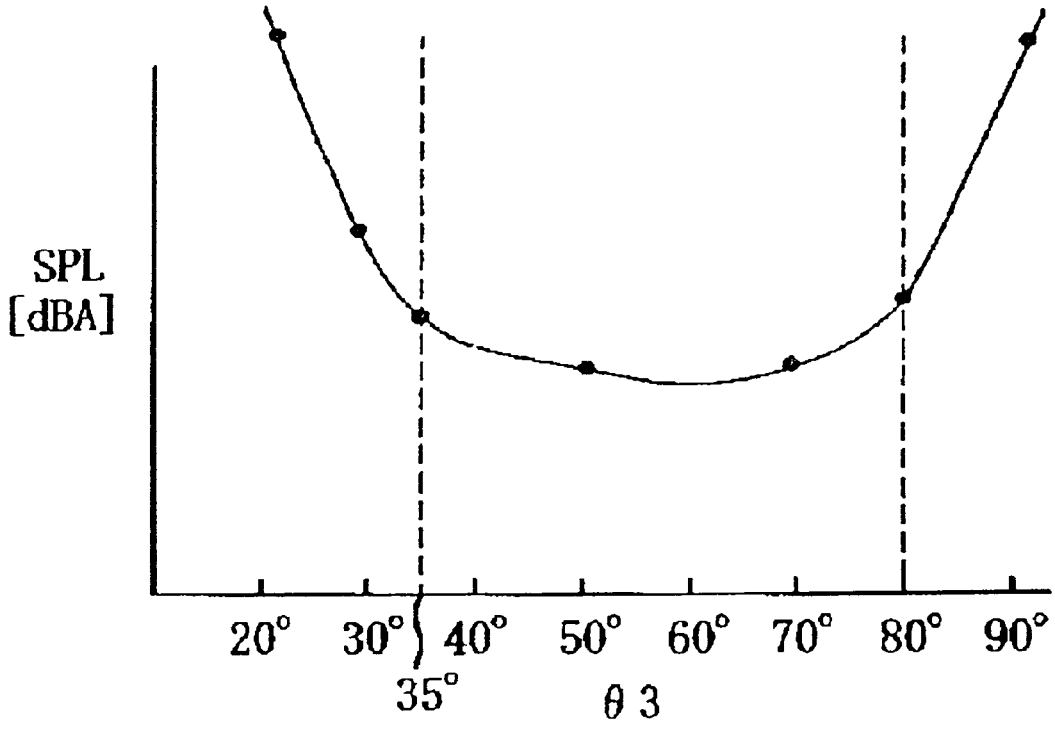
FIG. 40 is a diagram illustrating a change in the noise level at the same flow rate when the angle θ3 is varied, in a case where the closest point 3$b_1$ of the guide wall 3*b* to the impeller 2 of the cross flow fan is disposed in an upper rear portion of the air conditioning apparatus, and the angle θ3 is formed by the straight line 0-3$b_1$, connecting the closest point 3$b_1$ of a guide wall 3*b* to the impeller to the center 0 of the rotating shaft of the impeller, and the horizontal line L0 passing through the center 0 of the rotating shaft of the impeller.
Figure 41:
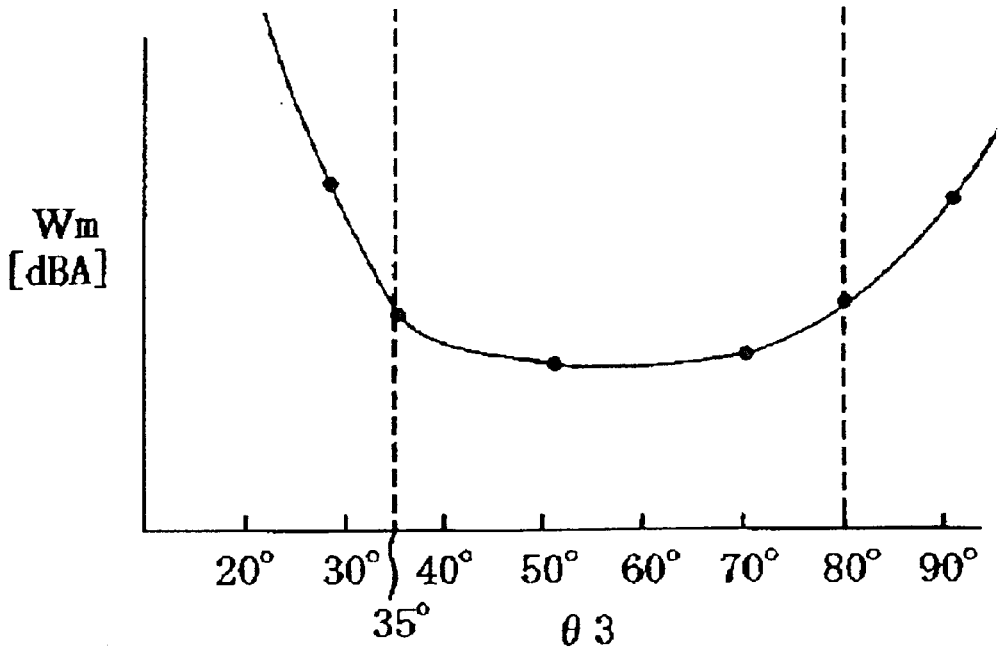
FIG. 41 is a diagram illustrating a change in the power consumption of the fan motor at the same flow rate when the angle θ3 is varied according to the air conditioning apparatus of this invention.

FIG. 40 is a diagram illustrating a change in the noise level at the same flow rate in a situation where the θ3 is varied. FIG. 41 is a diagram illustrating a change in the power consumption of the fan motor at the same flow rate in a situation where the θ3 is varied. By forming the guide wall 3*b* at the upper rear portion of the air conditioning apparatus in such a manner that the angle θ3 formed by the straight line O-$3b_1$, which connects the closest point $3b_1$ of the guide wall 3*b* to the impeller 2 of the cross flow fan and the center O of the rotating shaft of the impeller, and the horizontal line L0, which passes through the center O of the rotating shaft of the impeller, is between 35 degrees and 80 degrees, dew is not condensed when cooling and the power consumption is reduced. Moreover, the noise level is not increased. For that reason, a highly reliable and silent as well as energy-saving air conditioning apparatus may be obtained.

Embodiment 10

Figure 42:
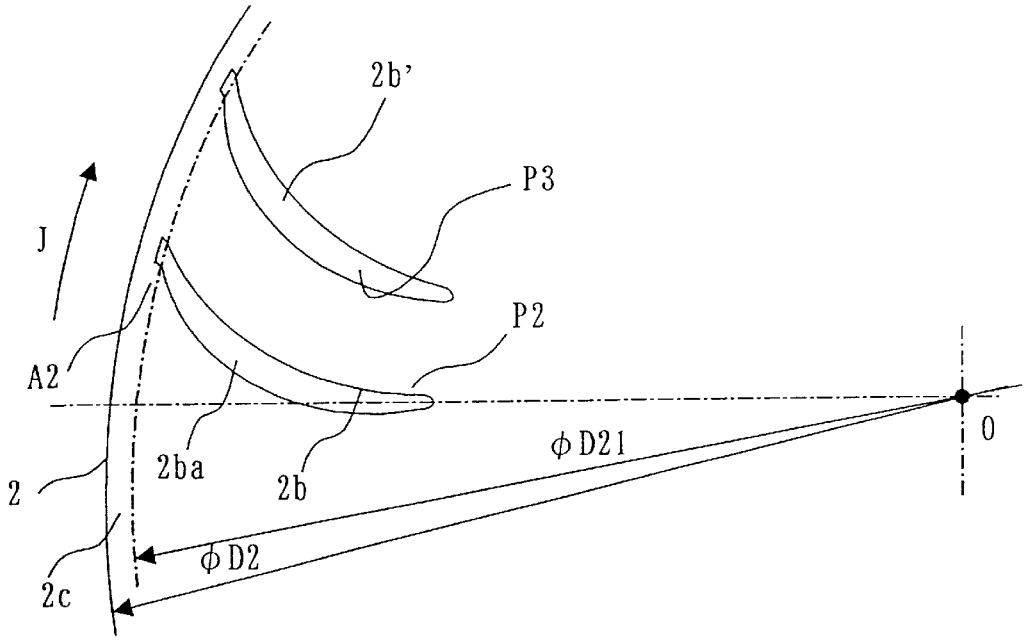
FIG. 42 is a partial cross-sectional view of a vane of the impeller of a cross flow fan to be mounted in an air conditioning apparatus according to a tenth embodiment of the present invention.
Figure 43:
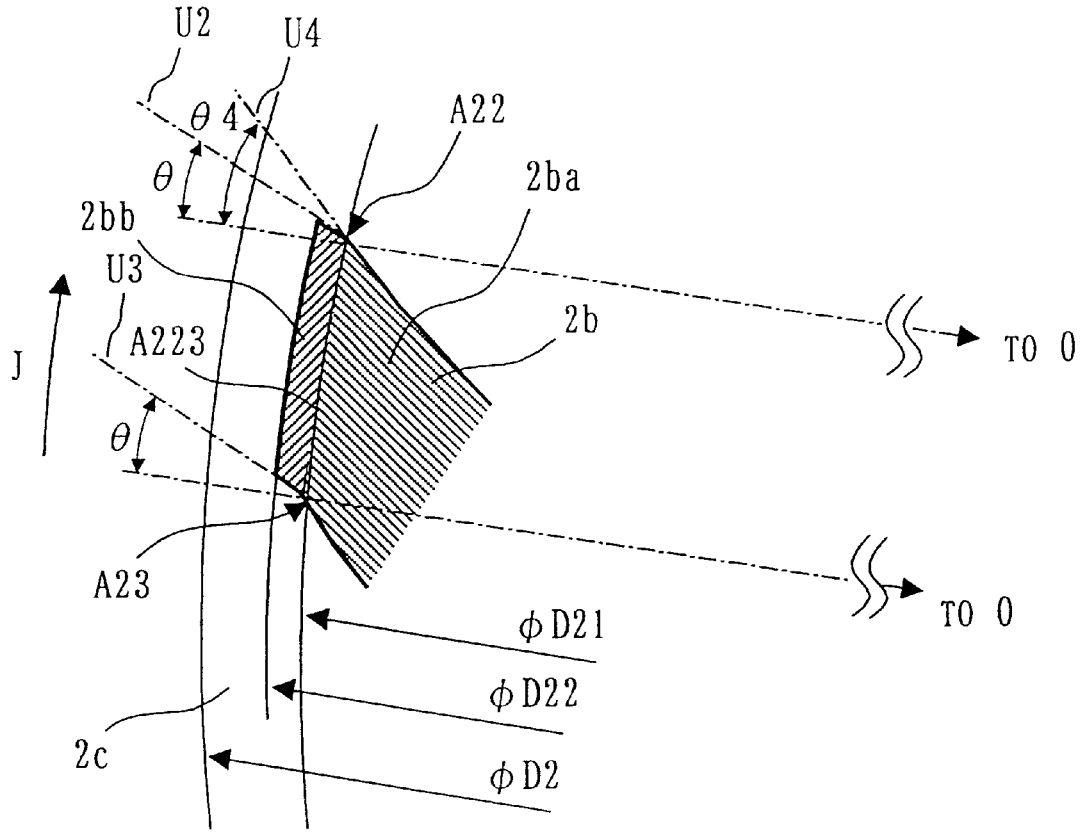
FIG. 43 is an enlarged view of an area in the vicinity of the vane's peripheral end portion of FIG. 42.

FIG. 42 and FIG. 43 are diagrams illustrating an example of the shape of a vane 2*b* of the impeller of a cross flow fan to be used as an air blowing means for an air conditioning apparatus according to a tenth embodiment of the present invention. Those figures are the cross-sectional view of the vane 2*b* and the enlarged view of an area in the vicinity of the peripheral end portion A2 of the vane 2*b*. It is to be noted that elements other than the vane 2*b* in this embodiment are the same as those of the air conditioning apparatus and the cross flow fan of FIG. 1 to FIG. 5 discussed above in the first embodiment, therefore the same reference numerals as those of the embodiment are assigned to the elements and the description will be omitted.

With referring to FIG. 42 and FIG. 43, a vane 2*ba* is a remaining portion on the internal circumferential side of the impeller after cutting the vane 2*b* along a circle which shares the center of the impeller 2 and has a reduced diameter ϕD21 by 2% from the diameter ϕD2 of the peripheral circle of the ring 2*c* which is also the outer diameter of the impeller. Vertexes A22 and A23 and an arc A223 are obtained as a result of cutting the vane 2*b*. Further, a straight line connecting the rotating center O of the impeller and the vertex A22 is O-A22, and a straight line connecting the rotating center O of the impeller and the vertex A23 is O-A23. Further, straight lines obtained by inclining the vertexes A22 and A23 by a fixed same angle θ on the side of the direction of rotation are U2 and U3, respectively. In this situation, the vane 2*b* is formed by the vane 2*b*a and a portion 2*bb* in a similar shape to a parallelogram. The portion 2*bb* in a similar shape to a parallelogram is enclosed by the two straight lines U2 and U3, the arc A223, and a circle having a diameter ϕD22 which is at least smaller than the outside diameter ϕD2 of the impeller and larger than the diameter ϕD21 mentioned above.

Furthermore, the fixed angle θ is formed at least in such a manner as to be smaller than an angle θ4 formed by a tangent U4 at the vertex A22 and the straight line O-A22.

Figure 44:
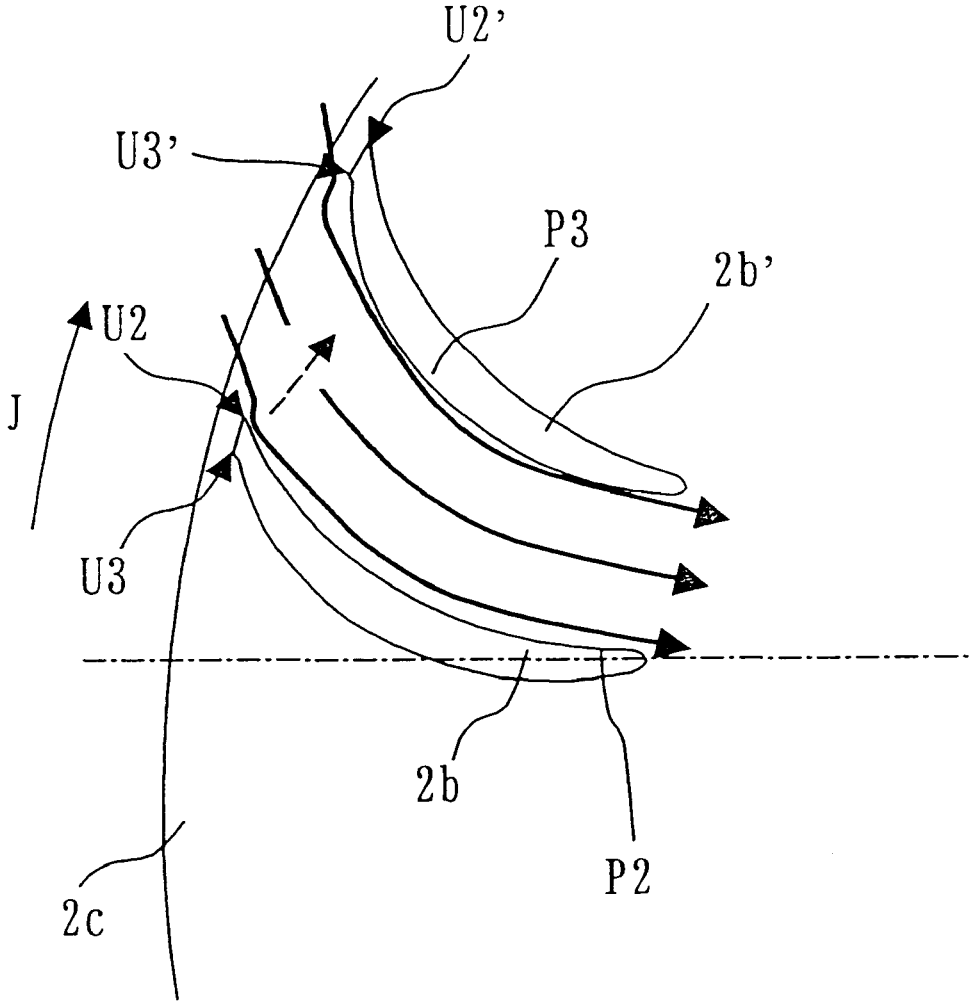
FIG. 44 is a diagram illustrating the flow of air between the vanes when each vane is formed into the shape of this invention.

Thus, by forming the vane 2*b* as discussed above, as shown in FIG. 44, the suction flow of air is a little detached at a segment U3 portion of a vane 2*b*' placed in front of the vane 2*b* in the direction of rotation. However, a pressure is provided to the suction surface P3 of the previous vane 2b' by a segment U2 portion of the vane 2b. Therefore, the main stream of the suction flow of air moves toward a center portion of the passage of air between the vane 2b and the previous vane 2b'. As a result, there is no air flow at a high rate nor detaching vortex appearing in the vicinity of the vane's surfaces P2 and P3. For that reason, if a high resistance such as a high collection dust removing filer is disposed on the air inlet side of the air conditioning apparatus, the singular noise does not appear in a low frequency range and the noise level is lowered.

Embodiment 11

Figure 45:
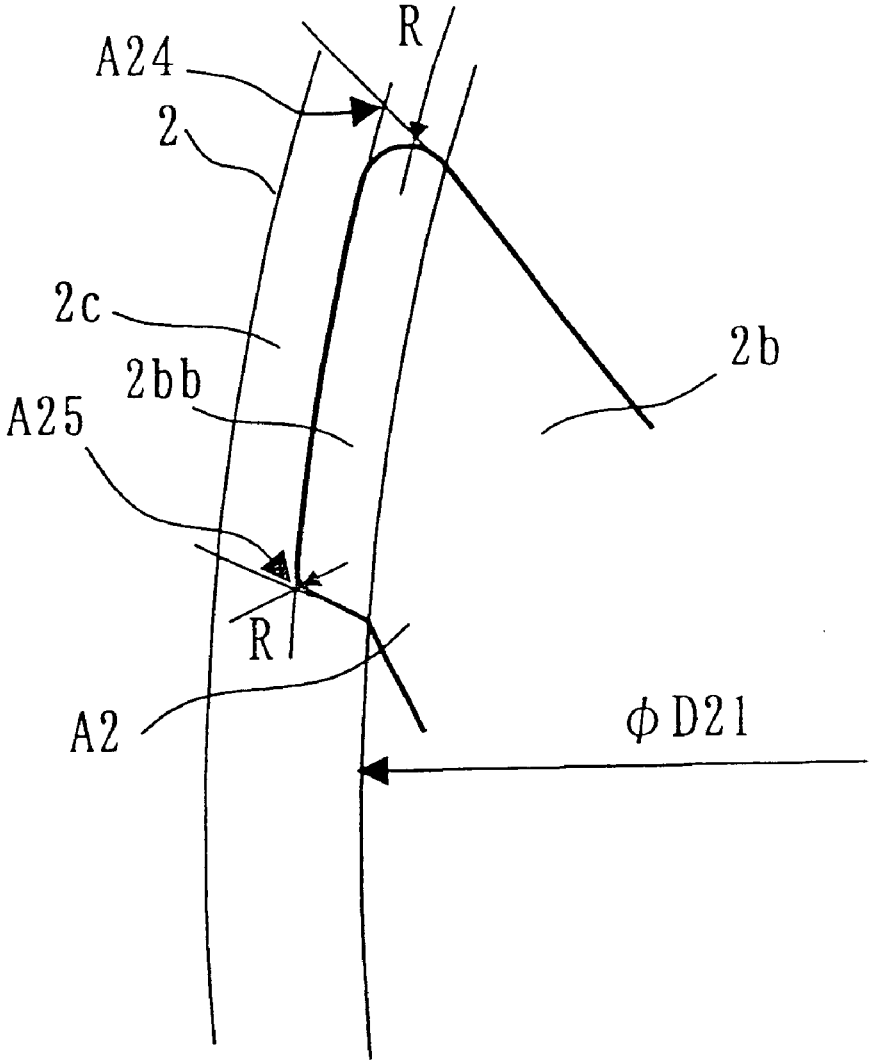
FIG. 45 is an enlarged view of an area in the vicinity of the vane's peripheral end portion of the impeller of a cross flow fan to be mounted in an air conditioning apparatus according to an eleventh embodiment of the present invention.

FIG. 45 is a diagram illustrating a shape of a vane 2*b* of the impeller of a cross flow fan to be used as a air blowing means of an air conditioning apparatus according to an eleventh embodiment of the present invention. The figure is an enlarged diagram of an area in the vicinity of the peripheral end portion A2 of the vane 2*b*. It is to be noted that elements other than the vane 2*b* in this embodiment are the same as those of the enlarged views of the vane 2*b* of the impeller of the cross flow fan shown in FIG. 42 and FIG. 43 discussed above in the tenth embodiment, therefore the same reference numerals as those of the figures are assigned to the elements and the description will be omitted.

With referring to FIG. 45, vertexes A24 and A25 of the portion similar to a parallelogram 2*bb* of the peripheral end portion A2 of the vane 2*b* of FIG. 43 discussed above face the periphery of the impeller 2. The two vertexes A24 and A25 are formed in a fixed shape of R.

Thus, the portion facing the periphery of the impeller 2 of the vane 2*b* is not formed in the shape of an edge but the fixed shape of R (R=0.2 mm or more). This assures a safe cleaning of the impeller 2 without any fear of tearing a cloth and cutting a finger while cleaning the vanes with soft paper (such as waste).

Thus, by forming the shape of the vanes as discussed above in this invention, a safe air conditioning apparatus may be obtained even for cleaning.

Embodiment 12

Figure 46:
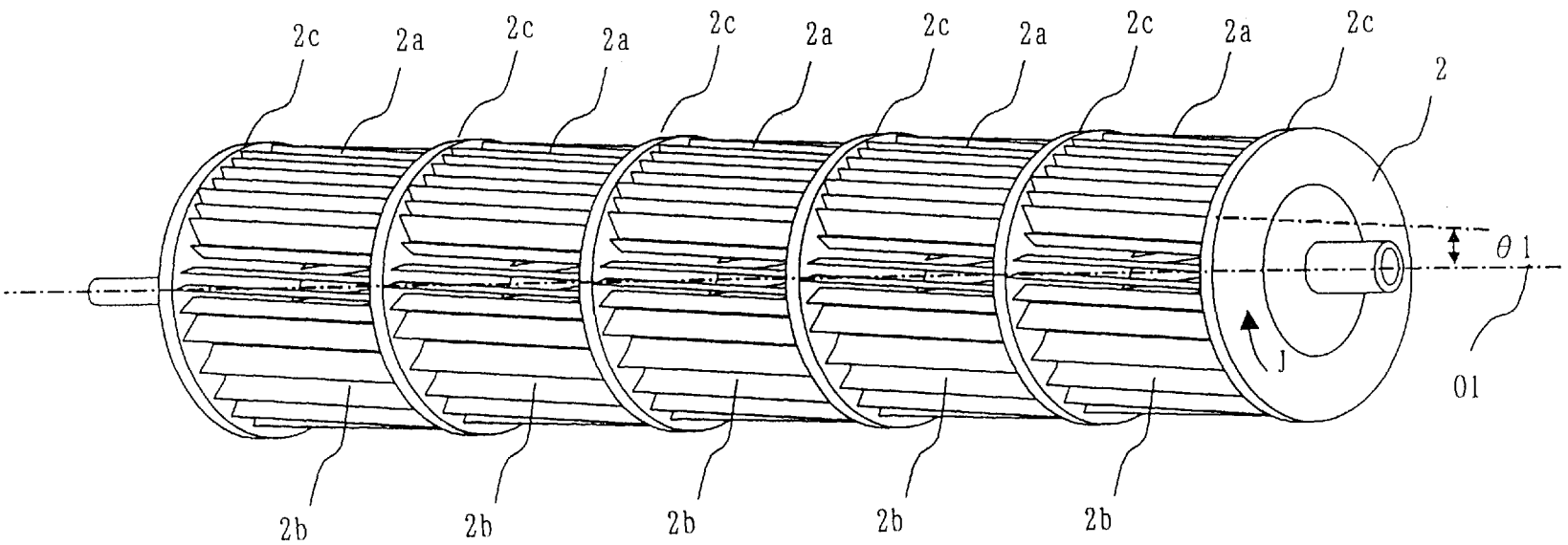
FIG. 46 is a perspective view of the impeller of a cross flow fan to be mounted in an air conditioning apparatus according to a twelfth embodiment of the present invention.

FIG. 46 is a perspective view of an impeller of a cross flow fan to be used as an air blowing means for an air conditioning apparatus according to the present invention. It is to be noted that elements other than the vane 2*b* in this embodiment are the same as those of the air conditioning apparatus and the cross flow fan of FIG. 1 to FIG. 5 discussed above in the first embodiment, therefore the same reference numerals as those of the embodiment are assigned to the elements and the description will be omitted.

As shown in FIG. 46, the plurality of vanes 2*b* incorporated into a single unit supported by the ring 2*c* of the impeller 2 of the cross flow fan is inclined by a fixed angle θ1 to the center line O1 of the rotating shaft of the fan.

Figure 47:
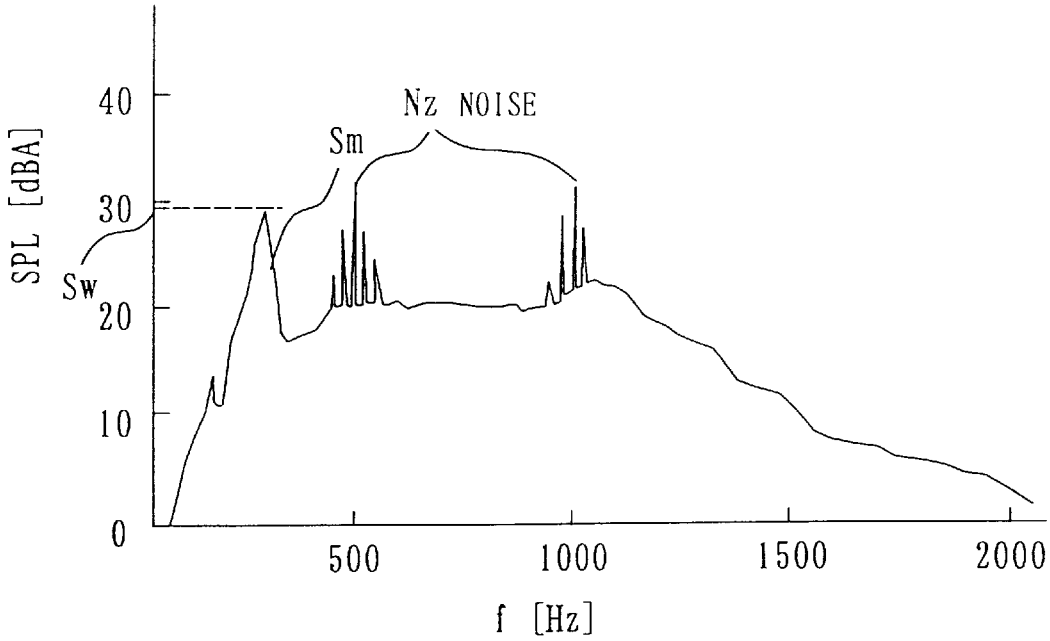
FIG. 47 is a diagram illustrating the frequency characteristic of an air conditioning apparatus in which the impeller of the conventional cross flow fan is mounted.
Figure 48:
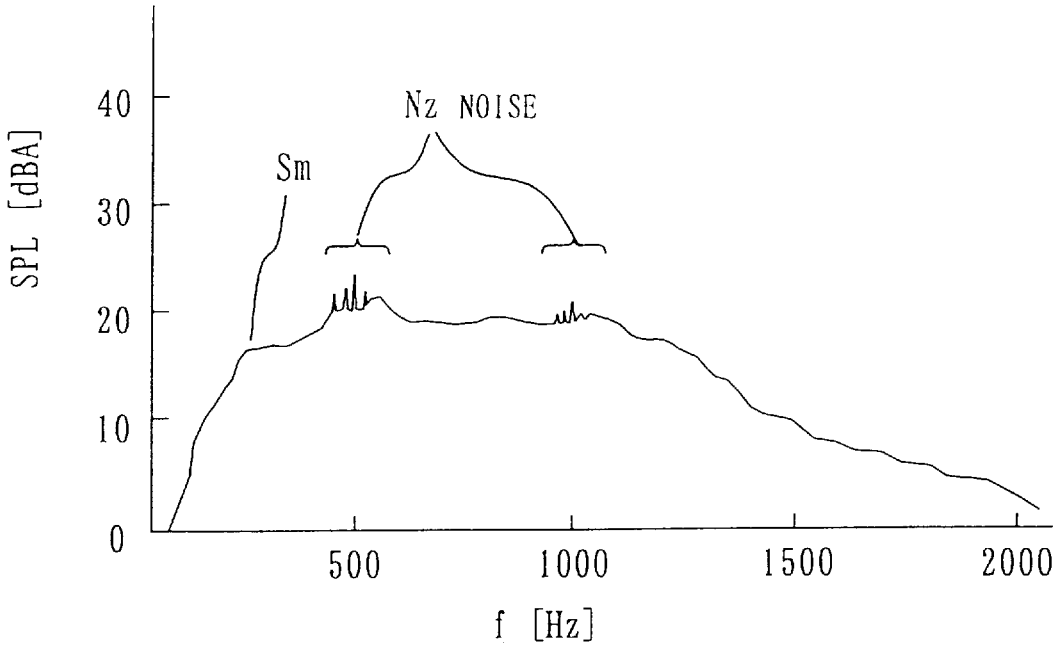
FIG. 48 is a diagram illustrating the frequency characteristic of the air conditioning apparatus in which the impeller of the cross flow fan of this embodiment is mounted.
Figure 50:
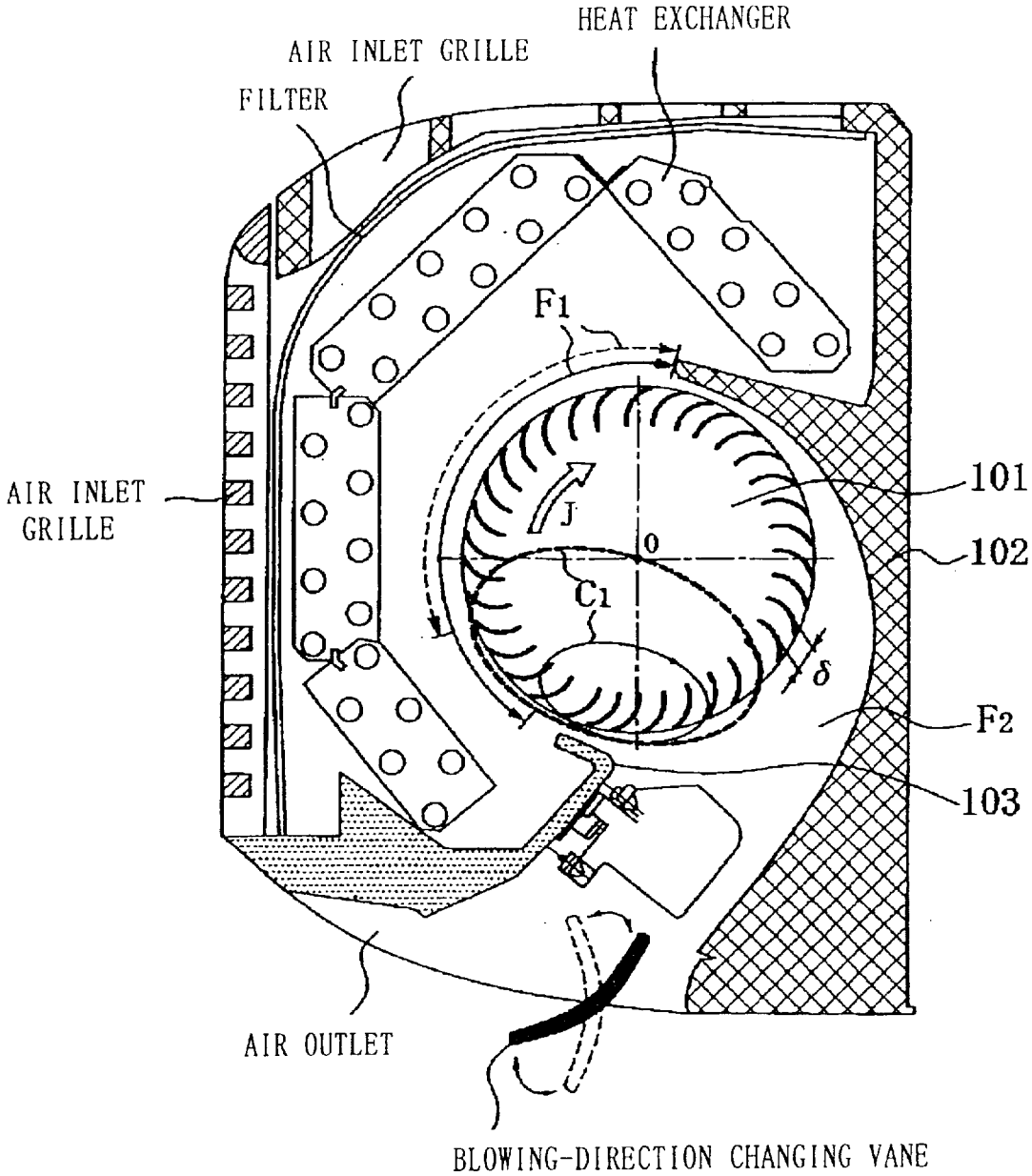
FIG. 50 is a longitudinal cross-sectional view of a conventional air conditioning apparatus.
Figure 51:
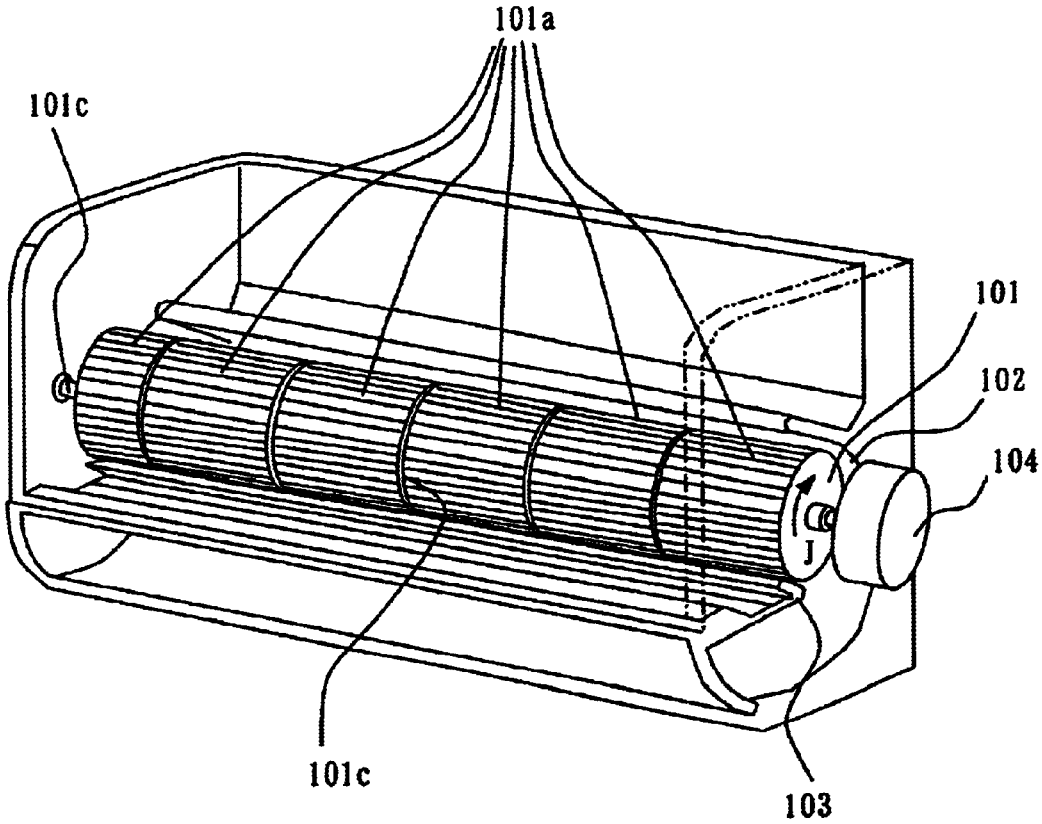
FIG. 51 is a perspective view of the impeller of the cross flow fan of the conventional air conditioning apparatus.
Figure 52:
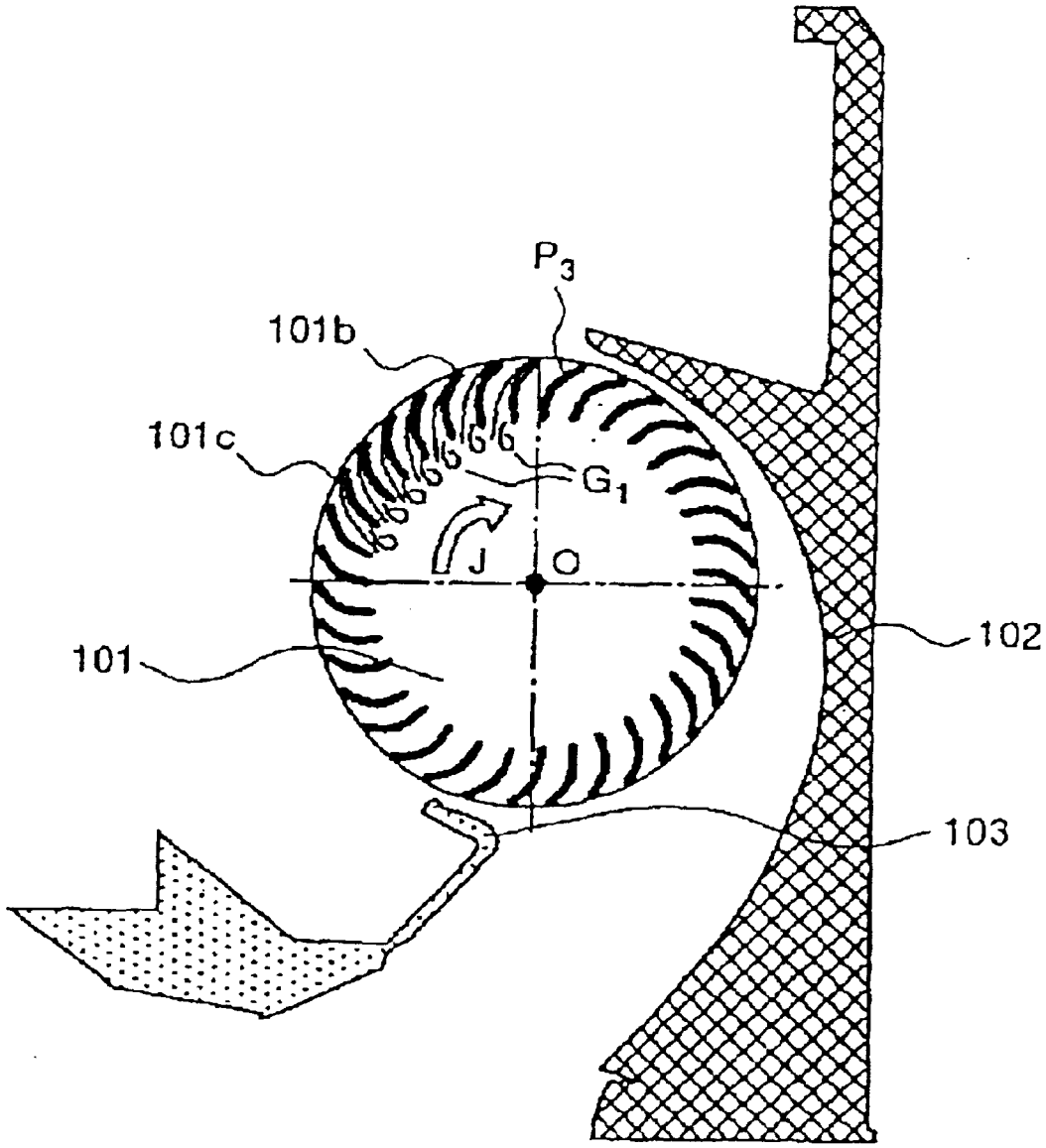
FIG. 52 is a longitudinal cross-sectional view of the cross flow fan of the conventional air conditioning apparatus.

Thus, by forming the impeller 2 of the cross flow fan as discussed above, such problems as stated below will be solved. In a case where the vanes 101*b* are provided in parallel to the rotating shaft 0 and the stabilizer 103 like the impeller 101 of the cross flow fan of the conventional air conditioning apparatus shown in FIG. 50 to FIG. 52, when the impeller 101 rotates and the vanes 101*b* pass through an area in the vicinity of the stabilizer 103, one vane 101*b* of each impeller unit 101*a* passes through the same portion at the same timing. For that reason, as shown in a diagram illustrating the frequency characteristic of FIG. 47, the pressure fluctuation is received at the same timing. Then, the pressure fluctuation level at the vane's peripheral end portion A2 is multiplied and to be increased, which generates rotational noise (NZ sound) and this poses a problem. Another problem is posed when the detaching vortex G1 generates the singular noise Sm at the vane 101*b*, the detaching vortex G1 occurs at the same timing in the direction of the length of the impeller unit 101*a*. For that reason, such phenomenon does not occur that the pressure fluctuation caused by the detaching vortex G1 is multiplied, thereby raising the noise level Sw of the singular noise Sm. As shown in FIG. 48, when the vane 2*b* passes through an area in the vicinity of the stabilizer 3*a*, the timing of each vane 2*b* of each impeller unit 2*a* passing through the stabilizer 3*a* differs from others in the direction of the length. For that reason, the generation timing of the pressure fluctuation at the peripheral end portion A2 of the vane 2*b* differs from others. As a result, the pressure fluctuation level is lowered and the rotational noise is reduced. Therefore, even if the detaching vortex G1 occurs, because the timing of generating the detaching vortex G1 is different from others in the direction of the length, the pressure fluctuation caused by the detaching vortex G1 is dispersed, so that the noise level Sw of the singular noise Sm may be lowered.

Furthermore, if the cross-sectional shape of the vane 2*b* has such shape as that shown in FIG. 42 discussed in the tenth embodiment, the singular noise is not generated. Therefore, a higher collection dust removing filter may be installed.

Embodiment 13

Figure 49:
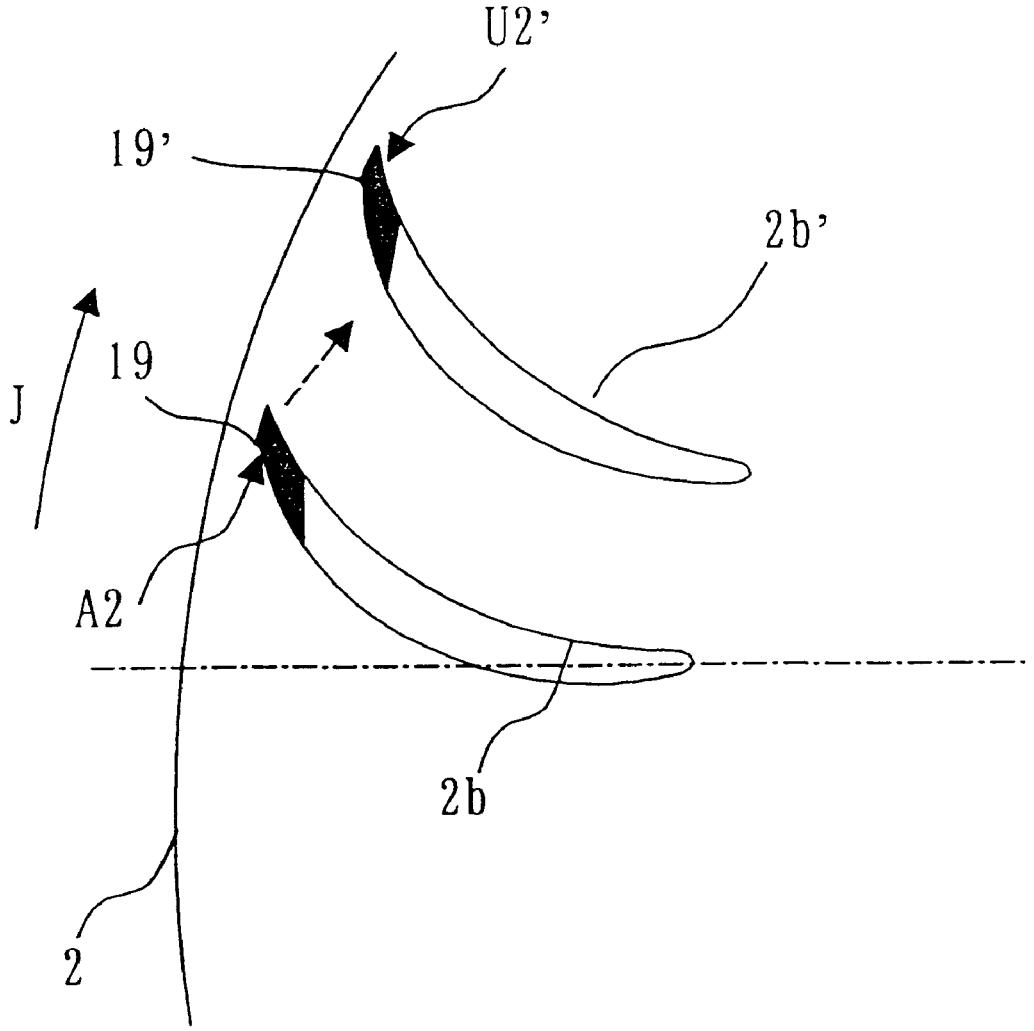
FIG. 49 is a partial cross-sectional view of the impeller of a cross flow fan to be mounted in an air conditioning apparatus according to a thirteenth embodiment of the present invention.

FIG. 49 is a diagram illustrating a shape of a vane 2*b* of the impeller of a cross flow fan to be used as an air blowing means for an air conditioning apparatus according to a thirteenth embodiment of the present invention. The figure is a partial cross-sectional view of the impeller 2. It is to be noted that elements other than the vane 2*b* in this embodiment are the same as those of the air conditioning apparatus and the cross flow fan of FIG. 1 to FIG. 5 discussed above in the first embodiment, therefore the same reference numerals as those of the embodiment are assigned to the elements and the description will be omitted.

With referring to the partial cross-sectional view of the impeller 2 of FIG. 49, the impeller 2 including the rings 2*c* for supporting the plurality of vanes 2*b* is formed in most part by resin materials. The vane's peripheral end portion A2 is formed by an elastic body 19 such as rubber, for example.

Thus, the vane's peripheral end portion A2 of the vane 2*b* facing the peripheral surface of the impeller of the cross flow fan is formed by the elastic body. For that reason, there is no fear of cutting the tip of one's finger or damaging fingernails in case of touching by mistake the impeller 2 of the cross flow fan while rotating, when one puts one's hand into the cross flow fan towards the impeller 2 through the air outlet 14 of the air conditioning apparatus.

Furthermore, in the case of cleaning the impeller, because the vane's peripheral end portion is made of the elastic body, one's finger cannot be cut while cleaning with such as soft paper. Therefore, a safe air conditioning apparatus may be obtained without losing the ventilating performance.

Furthermore, the pressure fluctuation that is received at the peripheral end portion A2 of the vane 2*b* by the impeller 2 while rotating may be reduced, so that the noise may be lowered.

Industrial Applicability

As discussed above, according to the present invention, as long as the ratio H/ϕD2 of the height H of the air conditioning apparatus to the outer diameter ϕD2 of the impeller of the cross flow fan is 2.2 or above and 3.0 or below, then the size of the main body of the air conditioning apparatus is not increased and the speed of air flow on the vane's surface is reduced at the same flow rate. As a result, the noise becomes low, and the singular noise is not generated. Moreover, the pressure of the impeller can be raised, therefore if a resistance is added on the air inlet side, the drop rate of air flow at the same fan rotation frequency is reduced, and the flow of blowing air at the air outlet becomes stable. Hence, there is no fear of dew condensed at the air outlet when cooling. If such as dust accumulates on the filter, there is not much aggravation caused in the characteristic.

Hence, a highly reliable and silent air conditioning apparatus which produces a favorable atmosphere to the ear may be obtained.

According to the next invention, the exit angle β2 of the vane of the impeller of the cross flow fan is between 23 degrees and 30 degrees. Therefore, the distance between vanes is expanded. When the flow of air passes through the vanes, because the ventilating resistance is small, the flow of air is not detached at the vane's peripheral end portion. Accordingly, the power consumption of the fan motor for operating the impeller may be reduced. Hence, an energy-saving air conditioning apparatus having low motor power consumption may be obtained.

According to the next invention, the maximum thickness tm near the center of the vane of the impeller of the cross flow fan to the thickness ratio of the thickness of the vane's peripheral end portion t2, which is the minimum thickness and the diameter of the circular-arc shaped vane's peripheral end portion is 1.5 or above and 3.5 or below. This prevents the flow of suction air from detaching on the vane's suction surface. Moreover, the speed of air flow between vanes becomes flat, therefore no singular noise is generated. Furthermore, even if such as dust is accumulated on the filter, thereby increasing the ventilation resistance of suction air, the noise is not aggregated. As a result, if such as dust is accumulated on the filter, thereby increasing the ventilation resistance, no singular noise is generated, and the noise is not aggregated. Hence, an air conditioning apparatus which provides a favorable atmosphere to the ear may be obtained.

According to the next invention, the thickness of the vane's peripheral end portion of the impeller of the cross flow fan is between 0.2 mm and 0.5 mm. By thus making it thinner than the thickness of the conventional case, the stagnation of the suction flow of air at the tip of the vane's peripheral end portion is reduced and the loss is reduced. Consequently, the power consumption of the fan motor may be reduced. Moreover, even if minute dust is left unremoved through the filter and accumulated on the vane's peripheral end portion after operating the air conditioning apparatus for a long time, the air flow drop rate during the same operating time becomes small compared to the conventional case. For that reason, the problem that it does not become warm enough when heating and it does not become cool enough when cooling may be solved. Hence, an energy-saving and highly reliable air conditioning apparatus may be obtained.

According to the next invention, the vane is excised along the circle which passes through the circular-arc shaped tip of the vane's peripheral end portion of the vane 2*b* of the impeller of the cross flow fan and has the center of the rotating shaft of the impeller as its center, so that the vane's peripheral end portion is formed into the shape of a sharp edge. As a result, the stagnation of the flow of air at the tip of the vane's peripheral end portion is further reduced and the loss is further reduced. For that reason, the consumption power of the fan motor is reduced. Hence, a further energy-saving air conditioning apparatus may be obtained.

According to the next invention, the vane's fitting spaces between vanes of the impeller of the cross flow fan are irregular in pitch. Therefore, in case of the singular noise being generated in a regular pitch, if the vanes are irregularly fitted in pitch, the speed of air flow and the state of a detaching vortex on the vane's surface differ from one another. For that reason, the singular noise is dispersed and the level of the singular noise is reduced. Furthermore, if the trailing vortex of the pipes is sucked into the impeller when the impeller and the heat exchanger come near to each other, the instantaneous lift fluctuation at the vane's peripheral end portion is dispersed. Consequently, the peak level of the rotation noise becomes low. Moreover, this prevents the rotation noise from being generated, therefore the gap between the impeller and the stabilizer as well as the gap between the impeller and the guide wall are allowed to become narrower. As a result, the static air pressure of the impeller may be raised and the power consumption of the fan motor may be reduced at the same flow rate.

As a result, the singular noise and the rotation noise may be reduced. Hence, an energy-saving and silent air conditioning apparatus which provides a favorable atmosphere to the ear may be obtained.

According to the next invention, the stabilizer is formed in such a manner as to locate at the place where the acute angle θ1 formed by the horizontal line and the straight line is between 30 degrees and 70 degrees in the opposite direction to the rotation of the impeller, where the straight line connects the closest point of the stabilizer to the impeller of the cross flow fan and the center of the rotating shaft of the impeller, and the horizontal line passes through the center of the rotating shaft of the impeller. This restricts the generation of the singular noise. Thus, the suction area is guaranteed, and the blowing rate of the impeller may be reduced. As a result, the noise becomes low. Hence, a low-noise air conditioning apparatus which provides a favorable atmosphere to the ear may be obtained.

According to the next invention, the stabilizer is formed in such a manner that the acute angle θ2 formed by the two straight lines is between 15 degrees and 40 degrees, where one of the straight lines connects the center of the rotating shaft of the impeller of the cross flow fan and the closest point of the stabilizer to the impeller of the cross flow fan and the other straight line connects the center of the rotating shaft of the impeller of the cross flow fan and the lower end of the stabilizer. Thus, the movement of the circulating vortex being generated inside the impeller may be kept stable even if the ventilating resistance on the air inlet side is increased due to such as dust accumulated on the filter. For that reason, dew is not condensed in the vicinity of the air outlet 14 when cooling. Furthermore, the area on the air outlet side of the impeller is guaranteed, therefore the noise becomes low and the input of the fan motor may be reduced. Hence, an energy-saving, low-noise, and highly reliable air conditioning apparatus may be obtained.

According to the next invention, the closest point of the guide wall to the center of the rotating shaft of the impeller of the cross flow fan is disposed at an upper rear portion of the air conditioning apparatus. Furthermore, the guide wall is formed in such a manner that the acute angle θ3 formed by the straight line connecting the closest point of the guide wall to the impeller and the center of the rotating shaft of the impeller and the horizontal line passing through the center of the rotating shaft of the impeller is between 35 degrees to 80 degrees. For that reason, the area on the air inlet side of the cross flow fan is guaranteed, the noise is not aggravated, and the power consumption is reduced. Moreover, in the area on the air outlet side, because the guide wall is extended long, the flow of blown-off air from the impeller can recover the static air pressure sufficiently enough, and the movement of blowing air flow becomes stable. As a result, if the ventilating resistance is increased on the suction side due to such as dust being accumulated on the filter, there is no problem when cooling that air flows backward at the air outlet which causes the condensation of dew. Hence, a silent and highly reliable air conditioning apparatus with low noise may be obtained.

According to the next invention, the vane 2*b* is excised along the circle sharing the center with the center of the impeller 2 and having the 2% reduced diameter ϕD21 from the diameter ϕD2 of the peripheral circle of the ring 2*c* which is also the outer diameter of the impeller. The remaining internal circumferential portion of the impeller is the vane 2*b*a. Vertexes A22 and A23 and an arc A223 are obtained as a result of the vane 2*b* being excised. Furthermore, the straight line connecting the rotating center O of the impeller and the vertex A22 is O-A22, and the straight line connecting the rotating center O of the impeller and the vertex A23 is O-A23. Still further, straight lines obtained by inclining the vertexes A22 and A23 by the fixed same angle θ on the side of the direction of rotation are U2 and U3, respectively. In this situation, the vane 2*b* is formed by the vane 2*b*a and the portion 2*b*b in a similar shape to a parallelogram. The portion 2*bb* in the similar shape to a parallelogram is enclosed by the two straight lines U2 and U3, the arc A223, and the circle having the diameter ϕD22 which is at least smaller than the outside diameter ϕD2 of the impeller and larger than the diameter ϕD21 mentioned above. Furthermore, the vane 2*b* is formed with the fixed angle θ being formed at least in such a manner as to be smaller than the angle θ4 formed by the tangent U4 at the vertex A22 and the straight line O-A22. Accordingly, the suction flow of air is a little detached at the segment U3 portion of the vane 2*b*' placed in front of the vane 2*b* in the direction of rotation. However, the pressure is provided to the suction surface P3 of the previous vane 2*b*' by the segment U2 portion of the vane 2*b*. Therefore, the main stream of the suction flow of air moves toward the center portion of the passage of air between the vane 2*b* and the previous vane 2*b*'. As a result, there is no air flow at a high rate and there is no detaching vortex in the vicinity of the vane's surfaces P2 and P3. Hence, if a high resistance such as a high collection dust removing filer is disposed on the air inlet side of the air conditioning apparatus, the singular noise is not generated in a low frequency range and the noise level becomes low.

In other words, a silent air conditioning apparatus may be obtained.

According to the next invention, the portion facing the periphery of the impeller 2 of the vane 2*b* is not formed in the shape of an edge but formed into the fixed shape of R. Therefore, cleaning is allowed to be done for the impeller without tearing a cloth or cutting a finger while cleaning with soft paper (such as waste).

In other words, there is no fear of injury while cleaning. Hence, a safe and highly reliable air conditioning apparatus may be obtained.

According to the next invention, the plurality of vanes 2*b* incorporated into a single unit supported by the ring 2*c* of the impeller 2 of the cross flow fan is inclined by the fixed angle θ1 to the center line O1 of the rotating shaft of the fan. Thus, when the vane 2*b* passes through the area in the vicinity of the stabilizer 3*a*, the timing of each vane 2*b* of each impeller unit 2*a* passing through the stabilizer 3*a* differs from one another in the direction of the length. Accordingly, the generation timing of the pressure fluctuation at the peripheral end portion A2 of the vane 2*b* differs from one another. As a result, the pressure fluctuation level is lowered and the rotation noise is reduced. Therefore, even if the detaching vortex G1 occurs, because the timing of generating the detaching vortex G1 is different from one another in the direction of the length, the pressure fluctuation caused by the detaching vortex G1 is dispersed, so that the noise level Sw of the singular noise Sm may be lowered.

In other words, a further silent and high-quality air conditioning apparatus which provides a favorable atmosphere to the ear may be obtained.

According to the next invention, in the cross-sectional shape which is enlarged the area in the vicinity of the peripheral end portion A2 of the vane 2*b*, the impeller 2 including the rings 2*c* for supporting the plurality of vanes 2*b* is formed in most part by resin materials. The vane's peripheral end portion A2 is formed by the elastic body 19 such as rubber, for example. For that reason, there is no fear of cutting the tip of one's finger or damaging fingernails in case of touching by mistake the impeller 2 of the cross flow fan while rotating, when one puts one's hand into the cross flow fan towards the impeller 2 through the air outlet 14 of the air conditioning apparatus.

Furthermore, in the case of cleaning the impeller, because the vane's peripheral end portion is made of the elastic body, one's finger cannot be cut while cleaning with such as soft paper. Hence, a safe air conditioning apparatus may be obtained without losing the ventilating performance.

Moreover, the pressure fluctuation at the peripheral end portion A2 of the vane 2*b* that is received by the impeller 2 while rotating may be reduced, so that the noise may be lowered.

What is claimed is:

1. An air conditioning apparatus having a cross flow fan and a heat exchanger, the cross flow fan being provided with an impeller formed by a plurality of vanes and a ring for supporting the plurality of vanes, the cross flow fan being formed by a nozzle portion formed by a stabilizer and an outlet, and a guide wall, wherein a ratio H/ϕD2 of an outside diameter ϕD2 of the impeller to a height H of a main body of the air conditioning apparatus is 2.2 or above and 3.0 or below.

2. The air conditioning apparatus of claim 1, wherein the impeller of the cross flow fan includes a vane's exit angle β2 which is between 23 degrees and 30 degrees.

3. The air conditioning apparatus of claim 2, wherein a ratio tm/t2 of a maximum thickness tm of the vane of the impeller of the cross flow fan to a minimum thickness t2 of the vane is at least 1.5 or above and 3.5 or below so as to reduce singular noise generated in a frequency range lower than that of rotation noise, the minimum thickness t2 being a diameter of a peripheral end portion of the vane in a shape of a circular arc, and wherein a thickness of the vane is gradually varied.

4. The air conditioning apparatus of claim 1, wherein a ratio tm/t2 of a maximum thickness tm of the vane of the impeller of the cross flow fan to a minimum thickness t2 of the vane is at least 1.5 or above and 3.5 or below so as to reduce singular noise generated in a frequency range lower than that of rotation noise, the minimum thickness t2 being a diameter of a peripheral end portion of the vane in a shape of a circular arc, and wherein a thickness of the vane is gradually varied.

5. The air conditioning apparatus of claim 3, wherein the maximum thickness of the vane of the impeller of the cross flow fan is between 0.9 mm and 1.5 mm, and wherein the minimum thickness t2 of the vane of the impeller of the cross flow fan is between 0.2 mm and 0.6 mm, the minimum thickness t2 being the diameter of the peripheral end portion of the vane in the shape of the circular arc.

6. The air conditioning apparatus of claim 4, wherein the vane of the impeller of the cross flow fan is formed into a shape of an edge obtained by cutting the vane along a circle passing through the peripheral end portion of the vane when a center of the circle is a center O of a rotating shaft of the impeller.

7. The air conditioning apparatus of claim 4, wherein the plurality of vanes of the impeller of the cross flow fan is fitted with an irregular space between the vanes in pitch.

8. The air conditioning apparatus of claim 1, wherein a maximum thickness of a vane of the impeller of the cross flow fan is between 0.9 mm and 1.5 mm, and wherein a minimum thickness t2 of the vane of the impeller of the cross flow fan is between 0.2 mm and 0.6 mm, the minimum thickness t2 of the vane being a diameter of a peripheral end portion of the vane in a shape of a circular arc.

9. The air conditioning apparatus of claim 1, wherein the vane of the impeller of the cross flow fan is formed into a shape of an edge obtained by cutting the vane along a circle passing through a peripheral end portion of the vane when a center of the circle is a center O of a rotating shaft of the impeller.

10. The air conditioning apparatus of claim 1, wherein the plurality of vanes of the impeller of the cross flow fan is fitted with an irregular space between the vanes in pitch.

11. The air conditioning apparatus of claim 1, wherein the stabilizer is formed at a lower front portion of the air conditioning apparatus in such a manner that an acute angle formed by a straight line, which connects a closest point of the stabilizer to the impeller of the cross flow fan to a center O of a rotating shaft of the impeller, and a horizontal line, which passes through the center O of the rotating shaft of the impeller, is between 30 degrees and 70 degrees.

12. The air conditioning apparatus of claim 1, wherein the stabilizer is formed in such a manner that an acute angle formed by two straight lines, which connect a center O of the impeller of the cross flow fan, respectively, to a closest point of the stabilizer to the impeller of the cross flow fan and to a lower portion of the stabilizer, is between 15 degrees and 40 degrees.

13. The air conditioning apparatus of claim 1, wherein the guide wall is formed at an upper rear portion of the air conditioning apparatus in such a manner that an angle θ3 formed by a straight line connecting a closest point of the guide wall to the impeller of the cross flow fan and a center of a rotating shaft of the impeller and a horizontal line passing through the center O of the rotating shaft of the impeller, is between 35 degrees and 80 degrees.

14. The air conditioning apparatus of claim 1, wherein in a cross-sectional view at right angles to a line of a rotating shaft of the impeller of the cross flow fan, a shape of a peripheral end portion of the vane extends to a peripheral side of the impeller in a shape of an inclining parallelogram forward in a direction of rotation of the impeller, but the shape is not projecting outside a periphery of the ring for supporting the plurality of vanes.

15. The air conditioning apparatus of claim 1, wherein two vertexes of a peripheral end portion of the vane facing a peripheral side of the impeller are formed in a fixed shape of R when the vertexes extend to the peripheral side of the impeller in a shape of parallelogram.

16. The air conditioning apparatus of claim 1, wherein each of the plurality of vanes of the impeller of the cross flow fan is inclined by a fixed angle to a rotating shaft of the cross flow fan.

17. The air conditioning apparatus of claim 1, wherein a peripheral end portion of the vane of the impeller of the cross flow fan is formed by an elastic body.

* * * * *

UNITED STATES PATENT AND TRADEMARK OFFICE

CERTIFICATE OF CORRECTION

PATENT NO. : 6,692,223 B2
DATED : February 17, 2004
INVENTOR(S) : Takashi Ikeda et al.

It is certified that error appears in the above-identified patent and that said Letters Patent is hereby corrected as shown below:

Column 1,
Line 32, change "110*a*" to -- 101*a* --.

Column 11,
Line 67, change "2" to -- $\beta$2 --.

Column 16,
Line 63, change "101*a*" to -- 10*a* --.

Column 18,
Line 24, change "$\theta\phi$D2" to -- $\phi$D2 --.

Signed and Sealed this

Twenty-ninth Day of June, 2004

JON W. DUDAS
*Acting Director of the United States Patent and Trademark Office*